US011992135B2

(12) United States Patent
Bullwinkel et al.

(10) Patent No.: US 11,992,135 B2
(45) Date of Patent: May 28, 2024

(54) DEVICES, SYSTEMS AND METHODS FOR HANGING AND SECURING ITEMS FOR DISPLAY

(71) Applicant: Innovation Lock, LLC, Palm Beach Gardens, FL (US)

(72) Inventors: William H. Bullwinkel, Farmingdale, NY (US); Robert Ludwig, Newton, NJ (US); David R. Wachsman, Palm Beach Gardens, NY (US); Alvin Ma, Irvine, CA (US)

(73) Assignee: Innovation Lock, LLC, Palm Beach Gardens, FL (US)

( * ) Notice: Subject to any disclaimer, the term of this patent is extended or adjusted under 35 U.S.C. 154(b) by 0 days.

(21) Appl. No.: 17/951,324

(22) Filed: Sep. 23, 2022

(65) Prior Publication Data

US 2023/0102705 A1 Mar. 30, 2023

Related U.S. Application Data

(60) Provisional application No. 63/261,795, filed on Sep. 29, 2021.

(51) Int. Cl.

| | |
|---|---|
| ***A47F 5/00*** | (2006.01) |
| ***A47F 1/12*** | (2006.01) |
| ***A47F 5/08*** | (2006.01) |

(52) U.S. Cl.

CPC ..... *A47F 5/0006* (2013.01); *A47F 1/128* (2013.01); *A47F 5/0823* (2013.01); (Continued)

(58) Field of Classification Search

CPC .... A47F 5/0006; A47F 5/0823; A47F 5/0853; A47F 1/128; A47F 5/0861; A47F 5/0807; A47F 5/083; A47F 5/0838; A47F 5/0846; E05B 69/006

USPC ..... 211/57.1, 59.1, 7, 94.01, 106.01; 248/221.11, 223.41, 224.61, 222.52, 248/222.51

See application file for complete search history.

(56) References Cited

U.S. PATENT DOCUMENTS 578,787 A 3/1897 Tily
3,343,684 A * 9/1967 Galier ..... A63D 15/10 211/89.01

(Continued)

OTHER PUBLICATIONS

Hangzhou Langhong Technology Co., Ltd., Hooks Offer Sheet; Hangzhou, China; 1 page; Sep. 29, 2018.

*Primary Examiner* — Jennifer E. Novosad

(74) *Attorney, Agent, or Firm* — Michael J Porco; Gerald E Hespos

(57) ABSTRACT

Devices, systems and methods for hanging and securing items for display whereby the hanger devices and systems are self-locking, secure and do not require special tools to install and/or remove. A hanger for displaying at least one item of merchandise relative to a structure includes a first hanger member and a second hanger member that are removably coupled to each other, the first hanger member and second hanger member forming a retaining portion that retains the hanger to a structure and a hanging portion that enable items of merchandise to be placed thereon and be displayed. Additionally, a hanger capture device is provided to be mounted to a slatwall to prevent hangers from being removed from the slatwall.

6 Claims, 58 Drawing Sheets

(52) U.S. Cl.
CPC ..... *A47F 5/0838* (2013.01); *A47F 5/0853* (2013.01); *A47F 5/0876* (2013.01)

(56) References Cited

U.S. PATENT DOCUMENTS 3,409,260 A * 11/1968 Bleed ..... A47F 5/0823 248/222.51
3,545,711 A * 12/1970 Scheneman ..... A47F 5/0823 248/223.31
3,677,415 A * 7/1972 Radek ..... A47F 5/0823 248/220.42
3,853,293 A * 12/1974 Larson ..... A47F 5/0823 248/222.12
3,985,324 A * 10/1976 Larson ..... A47F 5/0823 248/220.42
4,026,134 A * 5/1977 Woolfson ..... E05B 47/0044 70/276
4,303,217 A * 12/1981 Garfinkle ..... A47F 5/0823 248/221.11
4,327,888 A * 5/1982 Scheneman ..... A47F 5/0823 248/220.43
4,506,856 A * 3/1985 Rich ..... A47F 5/0823 248/222.13
4,512,481 A * 4/1985 Thalenfeld ..... A47F 5/0823 248/222.51
4,607,753 A 8/1986 Radek
4,666,115 A * 5/1987 Schiro ..... A47G 7/045 248/225.11
4,674,721 A * 6/1987 Thalenfeld ..... A47F 5/0869 248/222.51
4,678,151 A * 7/1987 Radek ..... A47F 5/0846 248/223.41
4,832,298 A * 5/1989 Metcalf ..... A47F 5/083 248/222.51
4,882,868 A 11/1989 Fast
4,889,304 A 12/1989 Glickman et al.
5,080,238 A 1/1992 Hochman
5,109,992 A 5/1992 Miller
5,423,436 A * 6/1995 Morrow ..... A47F 5/0823 248/220.31
5,913,499 A * 6/1999 Kiggins ..... A47F 5/0823 248/220.31
6,003,685 A * 12/1999 Malin ..... A47F 5/0861 248/220.42
6,250,597 B1 6/2001 Kuo
6,357,609 B1 * 3/2002 Van Noord ..... A47B 45/00 211/90.03
6,364,141 B1 * 4/2002 Ehrgott ..... B60P 7/15 211/208
6,393,877 B1 * 5/2002 Church ..... A47F 5/0846 70/57
6,564,949 B1 * 5/2003 Saathoff ..... B25H 3/006 211/94.01
6,622,875 B2 * 9/2003 Humphrey ..... A47F 5/0815 211/87.01
6,681,940 B1 * 1/2004 Cash ..... B25H 3/04 211/70.6
6,749,161 B1 6/2004 Will et al.
6,957,555 B1 * 10/2005 Nagel ..... A47F 5/0861 70/57.1
6,971,614 B2 * 12/2005 Fischer ..... A47F 5/0846 248/222.51
7,197,902 B1 * 4/2007 Barkdoll ..... A47F 5/0861 70/57.1
7,204,375 B2 * 4/2007 Paiste ..... A47F 7/00 211/85.6
7,484,701 B2 * 2/2009 Hsieh ..... F16B 2/12 211/85.6
7,669,723 B2 * 3/2010 Kao ..... B25H 3/04 206/349
7,753,217 B2 7/2010 Lawson
7,757,869 B2 7/2010 Lawson
7,900,781 B2 * 3/2011 Baine ..... A47F 5/0838 211/106.01
8,240,623 B2 8/2012 Collins et al.
8,286,454 B2 * 10/2012 Richardson ..... E05B 73/00 70/57.1
8,297,572 B2 * 10/2012 Fox ..... A47F 5/0823 248/222.51
8,307,995 B2 * 11/2012 Surma ..... E05B 47/004 70/57.1
8,662,322 B2 * 3/2014 Magnusson ..... F16M 13/02 248/303
10,051,978 B2 * 8/2018 Gupta ..... F16M 13/022
10,197,217 B2 * 2/2019 Will ..... A47G 1/16
10,470,590 B2 * 11/2019 Wills ..... A47F 5/103
10,827,853 B2 11/2020 Ma et al.
D988,835 S * 6/2023 Bullwinkel ..... D8/338
11,672,361 B2 * 6/2023 Keller ..... A47F 5/0853 211/189
2005/0121573 A1 * 6/2005 Ahlund ..... A47F 5/0823 248/220.21
2006/0261016 A1 * 11/2006 Magid ..... A47F 5/0823 211/57.1
2007/0251904 A1 * 11/2007 Winig ..... A47B 96/06 211/106.01
2008/0105636 A1 5/2008 Lawson
2008/0105637 A1 5/2008 Lawson
2009/0057244 A1 * 3/2009 Conti ..... A47F 5/0861 211/7
2010/0206825 A1 * 8/2010 Johnston ..... A47F 5/0869 248/220.21
2013/0125495 A1 * 5/2013 Thrush ..... E04F 13/072 248/223.41
2018/0116427 A1 * 5/2018 Gupta ..... A47F 5/0823
2019/0290023 A1 9/2019 Ma et al.
2019/0331288 A1 * 10/2019 Gupta ..... A47B 96/027
2021/0022527 A1 * 1/2021 Keller ..... A47F 5/0846
2022/0248875 A1 * 8/2022 Fenerty ..... A47F 5/112
2023/0102705 A1 * 3/2023 Bullwinkel ..... A47F 5/0006 211/123

* cited by examiner

DEVICES, SYSTEMS AND METHODS FOR HANGING AND SECURING ITEMS FOR DISPLAY

PRIORITY

This application claims priority to U.S. Provisional Patent Application Ser. No. 63/261,795, filed Sep. 29, 2021, the contents of which are hereby incorporated by reference in its entirety.

TECHNICAL FIELD

The present disclosure relates generally to devices, systems and methods for preventing unauthorized removal of goods from a product display, fixture or the like, and more particularly, devices, systems and methods for hanging and securing items for display.

BACKGROUND

Conventionally, items of merchandise are commonly displayed for sale on long protruding rods supported from a support structure in the nature of a peg board, a slat board, or a wire rack. These protruding rods are commonly referred to in the art as hangers, display hooks, peg board hooks, or slat board hooks. Similar rods may also protrude from a wire display rack for the same purpose.

Slatwall is used to support or display a wide variety of products in an organized manner. The slatwall is typically mounted flush against a wall, and is particularly useful in retail stores, garages and the like where goods or items need to be displayed or stored, and a more finished look is desired but bulky cabinets or conventional shelving are inappropriate due to lack of space. Slatwall includes a number of horizontal boards or slats. Adjacent slats are spaced apart a given distance to form a number of uniform, horizontal slots. The slots are evenly spaced, one above the other, through the height of the slatwall. A number of hangers or supporting hardware are secured to the slatwall by inserting them into the slots. The hangers are generally cantilevered from the slatwall so that items can be hung from or supported by the hangers. The hangers or hardware can also be used to support a platform for displaying or storing smaller items such as shoes, packaged fasteners or the like.

Likewise, pegboard is used to support or display a wide variety of products. The pegboard is typically mounted a predetermined distance from a wall and includes a plurality of rows of holes or apertures. A number of hangers or supporting hardware are secured to the pegboard by inserting them into the holes. The hangers are generally cantilevered from the pegboard so that items can be hung from or supported by the hangers.

A problem with conventional slatwall, pegboard or the like is that the hangers or supporting hardware can be dislodged. When people walk by such a structure or quickly reach for an item on the slatwall, they can inadvertently bump one or more of the hangers with enough force to rotate and dislodge the hanger and cause it and the item it is supporting to fall to the ground. This can be particularly frustrating and embarrassing to customers and storekeepers in a retail store setting and can damage the goods being displayed.

Typically, hanging merchandise used on such structures is relatively small but may be expensive, such as batteries, small tools, jewelry, cosmetic products, health care products, electronics and other high theft items. Such merchandise may be a target for shoplifters because of its relatively small size and easy accessibility. A shoplifter may be able to easily and quickly remove the items hanging from a display hanger, and then attempt to leave the store without being detected. Furthermore, a shoplifter may be able to easily and quickly remove the whole hanger from the structure with all the items disposed on the hanger, and then attempt to leave the store.

Therefore, a need exists for devices, systems and methods that securely display items of merchandise on various support structures and prevent the easy removal of the items of merchandise from such support structures.

SUMMARY

Devices, systems and methods for hanging and securing items for display are provided. Hanger devices of the present disclosure are self-locking, secure and do not require special tools to install and/or remove.

According to one aspect of the present disclosure, a hanger for displaying at least one item of merchandise relative to a structure is provided including a first hanger member and a second hanger member that are removably coupled to each other; the first hanger member and second hanger member forming a retaining portion that retains the hanger to a structure and a hanging portion that enable items of merchandise to be placed thereon and be displayed.

In another aspect, the first hanger member includes a support member configured to come into full contact with a slat of a slatwall, a first hanger leg that extends perpendicularly from the support member and an offset member couples the support member to a retaining member configured to be disposed in a slot of the slatwall.

In one aspect, the second hanger member includes a first securing member and a second securing member, a second hanger leg extends from the first securing member, first securing member comes into contact with a slat above the slot where the retaining member is disposed and the second securing member comes into contact with a lower lip of the slot.

In a further aspect, the first hanger member is rotatably coupled to the second hanger member via coupling member.

In one aspect, a locking device is disposed over the hanging portion to prevent removal of the hanger from the structure.

In another aspect, each of the first and second hanger members include a support member configured to come into contact with a pegboard; a hanger leg that extends perpendicularly from the support member; and a first retaining member and a second retaining member that extend perpendicularly from the support member in a direction opposition of the hanger leg, wherein, the first and second retaining members form right angle legs that are disposed in apertures of the pegboard.

In a further aspect, the first and second hanger members are coupled by a clip.

In yet another aspect, each of the first and second hanger members include a support member configured to come into contact with a slatgrid; a hanger leg that extends perpendicularly from the support member; and a first retaining member and a second retaining member that are offset substantially parallel from the support member, the first and second retaining members are configured to be disposed between two wire rails of the slatgrid when the support member is brought into contact with the slatgrid.

In still another aspect, the support member includes an aperture for receiving a fastener to be coupled to a portion of the slatgrid.

In one aspect, the first hanger member includes a support member configured to come into full contact with a rod-like member of a slatgrid, a first hanger leg that extends perpendicularly from the support member and an offset member couples the support member to a retaining member configured to be disposed in slot of a slatgrid.

In another aspect, the second hanger member includes a first securing member and a second securing member, a second hanger leg extends from the first securing member, first securing member comes into contact with the rod-like member above the slot where the retaining member is disposed and second securing member includes a semi-circular recess that comes into contact with the rod-like members of the slot.

In a further aspect, the first hanger member includes a support member configured to be disposed over a generally rectangular bar.

In another aspect, the first hanger member includes a first hanger leg and the second hanger member includes a second hanger leg, the first hanger leg include at least one aperture and the second hanger leg includes at least one corresponding slot, wherein the first and second hanger members are slidingly coupled together via at least one coupling member disposed in the at least one aperture and at least one corresponding slot.

In yet another aspect, the first hanger member includes a first hanger leg and the second hanger member includes a securing member, the first hanger leg include at least one slot and the securing member includes at least one aperture, wherein the first and second hanger members are slidingly coupled together via at least one coupling member disposed in the at least one aperture and at least one slot.

In one aspect, the first hanger member includes a support member and a first hanger leg including a projection that extends perpendicularly from the support member, an offset member couples the support member to a retaining member configured to be disposed in a slot of a slatwall, where the offset member comes to rest on an edge of a lower slat; and the second hanger member includes a support member having a slot, an offset member and a securing member configured to be disposed in the slot of a slatwall toward an upper slat, a second hanger leg extends perpendicularly from the support member, the second hanger leg is then brought into alignment with the first hanger leg, where projection of the first hanger leg enters the slot of the support member of the second hanger member.

In still another aspect, each of the first and second hanger members include a support member configured to come into contact with a slat of a slatwall; a first hanger leg that extends perpendicularly from the support member; an offset member that couples the support member to a retaining member configured to be disposed in a slot of a slatwall, wherein the support member further includes a projection tab that mates with the other hanger member and the first hanger member and the second hanger member are identical.

In one aspect, each of the first and second hanger members are identical and include a support member and a hanger leg that extends perpendicularly from the support member, the support member further includes a projection tab which extends perpendicularly from the support member; a retaining member that extends perpendicularly from the hanger leg and is disposed adjacent the support member; and a projection member that extends in parallel from the support member opposite from the projection tab, wherein the first hanger member and second hanger member are slid into contact with each other in the slot of the slatwall, where projection members interlock with support members and the projection tabs stabilize the hanger the slot to prevent the hanger from rotating within the slot.

In a further aspect, the first hanger member includes at least one magnet and the second hanger member includes at least one second magnet of an opposite polarity to retain the first and second hanger members together.

In another aspect, a fastener for securing the hanger to the structure.

In yet another aspect, the fastener includes at least one of security screws, security screws with compression, push fasteners, thumb screws and/or quick-release fasteners.

In one aspect, the first hanger members is rotatably coupled to the second hanger member via a magnetically-actuated coupling member.

According to another aspect of the present disclosure, a device is provided for securing at least one hanger to a slatwall the slat wall including a plurality of horizontal slats, adjacent slats are spaced apart a given distance to form a number of uniform, horizontal slots, the device includes a retaining member including a first elongated member and at least two arms extending from the first elongated member, the at least two arms configured to be disposed in a first slot where at least one hanger is disposed, the elongated member configured to make contact with the at least one hanger to prevent removal of the at least one hanger; a securing member including a second elongated member, the elongated member including a perpendicular edge on a first side and a perpendicular lip on an opposite side, the edge configured to be disposed in a second slot of the slatwall below the first slot, the lip configured to make contact with the first elongated member to prevent removal of the first elongated member; and a locking member configured to couple the securing member to the retaining member to secure the retaining member and the securing member to the slatwall.

In one aspect, the retaining member includes a first receiving member and the securing member includes a second receiving member, the first and second receiving members configured to receive the locking member when the first and second receiving members are aligned.

In another aspect, the locking member is a lock.

In a further aspect, the locking member is a plunger-type lock.

In yet another aspect, the locking member is a fastener.

In still another aspect, each arm includes an offset member and a tab, wherein the tab is disposed in the slot of the slatwall.

BRIEF DESCRIPTION OF THE DRAWINGS

The above and other aspects, features, and advantages of the present disclosure will become more apparent in light of the following detailed description when taken in conjunction with the accompanying drawings in which:

FIG. 41H is a rear view and FIG. 411 is a front view of a hanger member shown in FIG. 41C in accordance with the present disclosure;

FIG. 42H is a rear view and FIG. 421 is a front view of a hanger member shown in FIG. 42C in accordance with the present disclosure;

FIG. 44C is a side view of a hanger in accordance with an embodiment of the present disclosure;

FIG. 50H is a rear view and FIG. 501 is a front view of a hanger member shown in FIG. 50C in accordance with the present disclosure;

Figure 1:
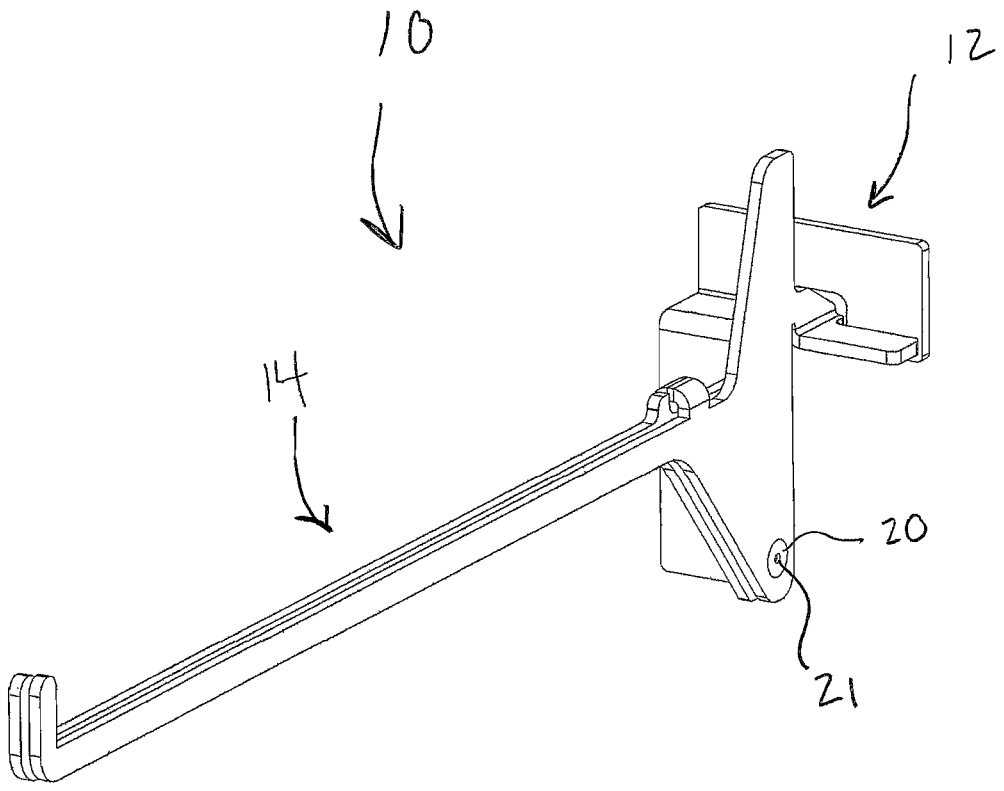
FIG. 1 is a right, perspective view of a slatwall hanger according to an embodiment of the present disclosure.
Figure 2:
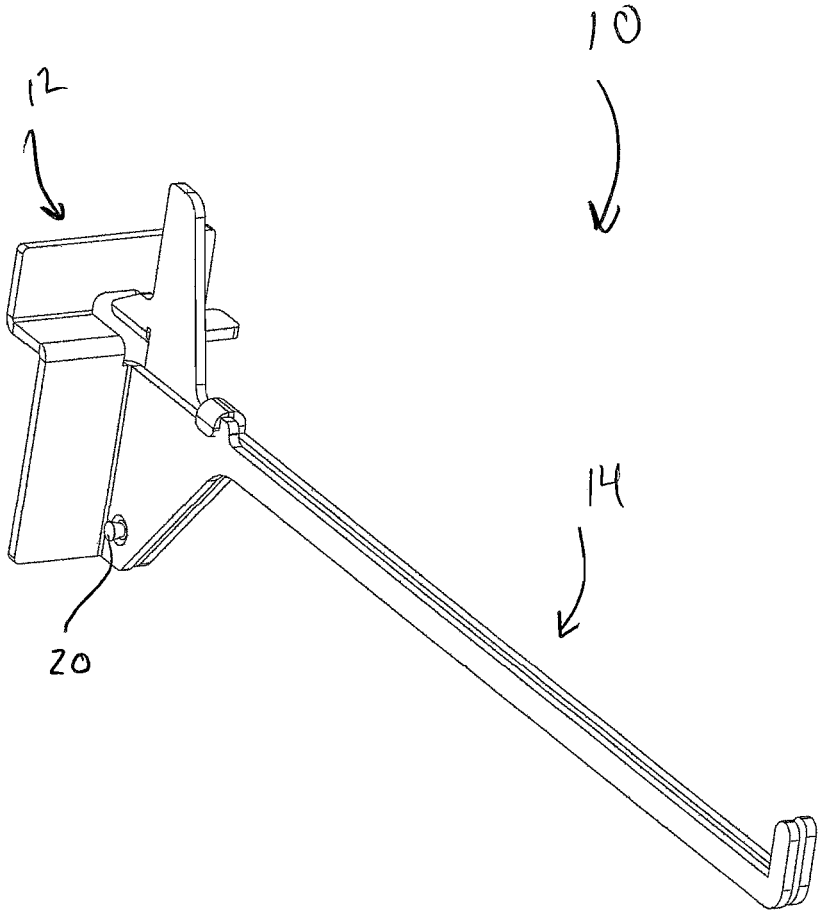
FIG. 2 is a left, perspective view of the hanger shown in FIG. 1 in accordance with the present disclosure.
Figure 3:
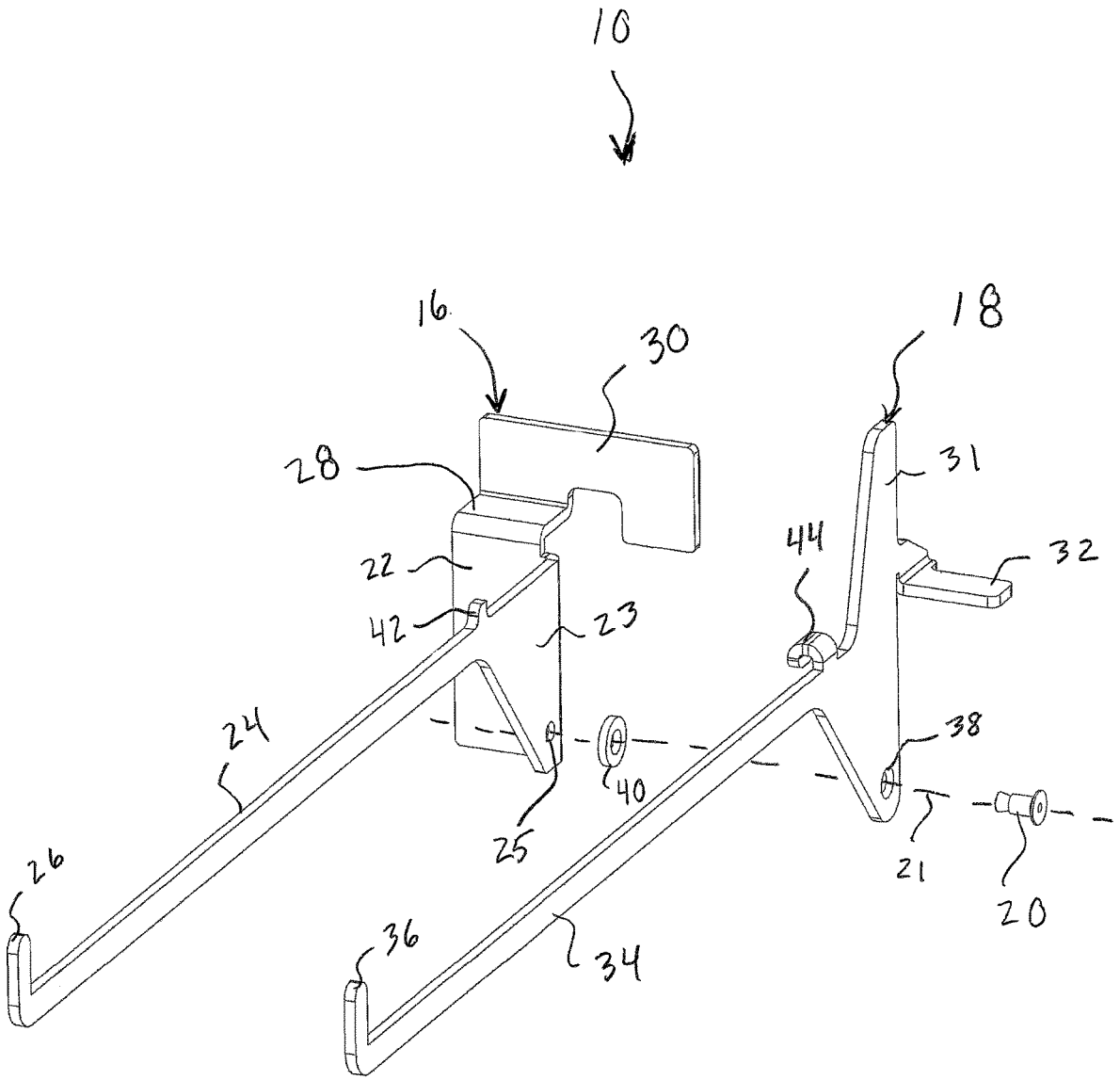
FIG. 3 is a right exploded perspective view of the hanger shown in FIG. 1.
Figure 4:
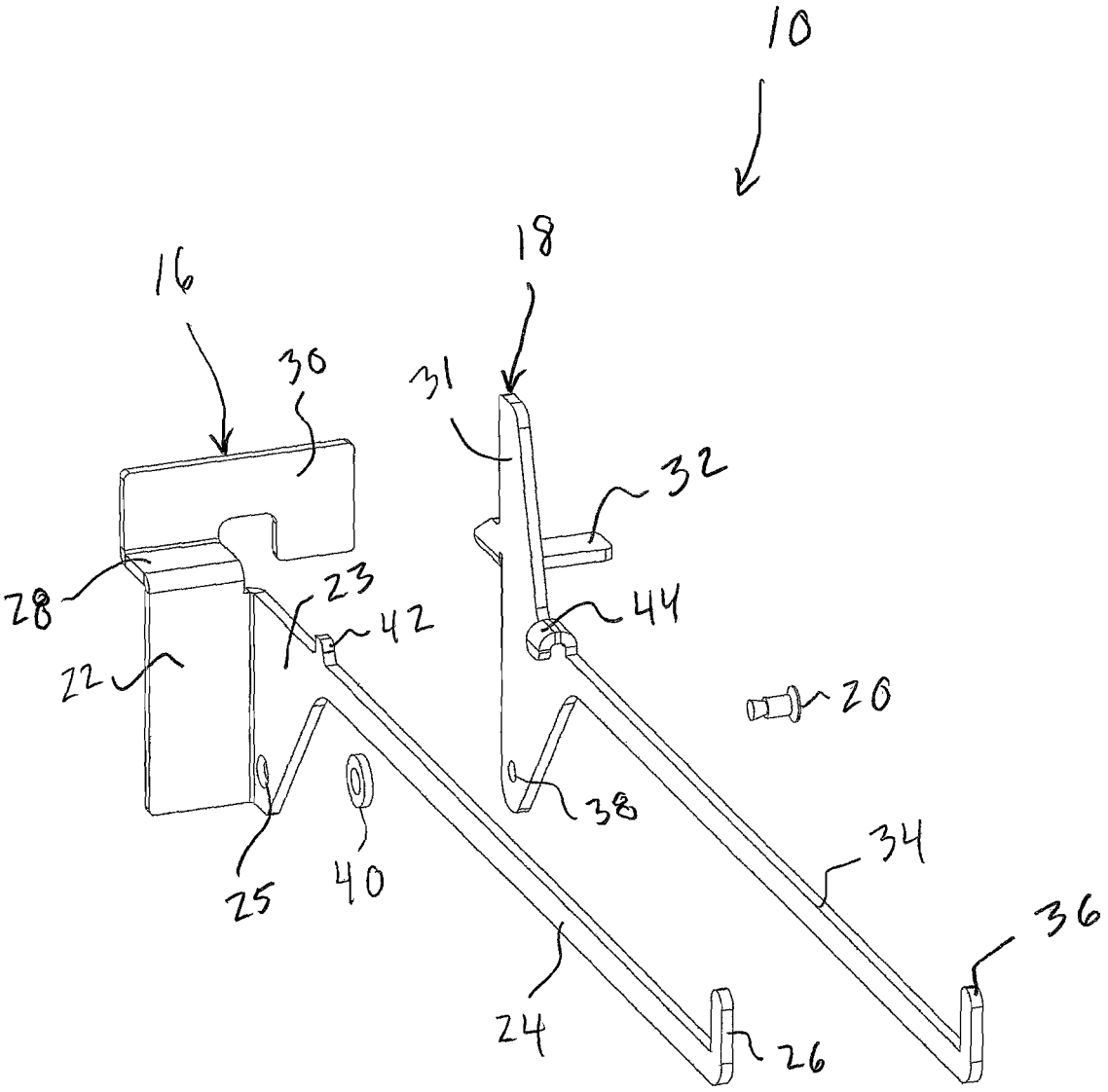
FIG. 4 is a left exploded perspective view of the hanger shown in FIG. 1.

It should be understood that the drawings are for purposes of illustrating the concepts of the disclosure and are not necessarily the only possible configuration for illustrating the disclosure.

DETAILED DESCRIPTION

Preferred embodiments of the present disclosure will be described herein below with reference to the accompanying drawings. In the following description, well-known functions or constructions are not described in detail to avoid obscuring the present disclosure in unnecessary detail.

Devices, systems and methods for hanging and securing items for display are provided. Hanger devices of the present disclosure are self-locking, secure and do not require special tools to install and/or remove.

Referring to FIGS. 1-4, a hanger 10 in accordance with an embodiment of the present disclosure is provided. Hanger 10 includes a retaining portion 12 that retains the hanger 10 in a slot of a slatwall and a hanging portion 14 that enable items of merchandise to be placed thereon and be displayed. Hanger 10 includes first hanger member 16 and second hanger member 18 which are rotatably coupled to one another via coupling member 20, e.g., a rivet.

First hanger member 16 includes a support member 22 configured to come into full contact with a slat of a slatwall. A first hanger leg 24 extends perpendicularly from the support member 22 via portion 23. The first hanger leg 24 includes a first extension member 26 which extends perpendicularly from the first hanger leg 24. An offset member 28 couples the support member 22 to a retaining member 30 configured to be disposed in a slot of a slatwall, the details of which will be described below. It is to be appreciated that the support member 22 is in a parallel relationship with retaining member 30 offset by the width of member 28.

The second hanger member 18 includes a first securing member 31 and a second securing member 32. A second hanger leg 34 extends from the first securing member 31 and a second extension member 36 extends perpendicularly from the second hanger leg 34. The first securing member 31, second hanger leg 34 and second extension member 36 are substantially in the same parallel plane. The second securing member 32 is coupled to the first securing member 31 in a perpendicular relationship.

The first hanger member 16 is rotatably coupled to the second hanger member 18 via coupling member 20. The first hanger member 16 includes an aperture 25 disposed in portion 23 and second hanger member 18 includes aperture 38 disposed in first securing member 31. To assemble hanger 10, first hanger member 16 is brought into contact with second hanger member 18 so that aperture 25 of portion 23 aligns with aperture 38 of first securing member 31. Optionally, a spacer 40 is disposed between portion 23 and first securing member. When apertures 25, 38 are aligned, coupling member 20 is disposed through the apertures 25, 38 (and optionally through spacer 40). In this manner, first hanger member 16 is rotatably coupled to second hanger member 18 having a pivot point 21 (depicted by dashed line 21 in FIG. 3) where the apertures align. To prevent over rotation, first hanger member 16 includes a detent 42 and second hanger member 18 includes a catch 44. When rotated about pivot point 21, detent 42 will come into contact with catch 44 preventing further rotation.

Figure 5:
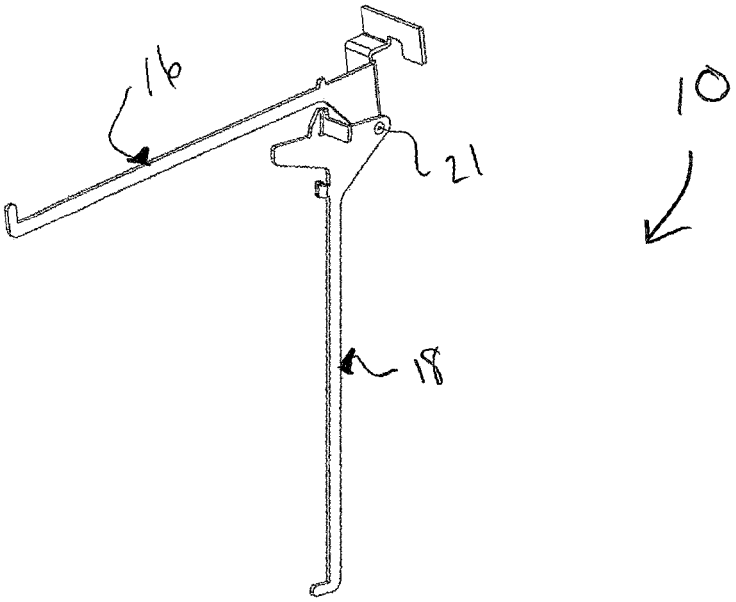
FIG. 5 is a view of the hanger shown in FIG. 1 in an open position in accordance with the present disclosure.
Figure 6:
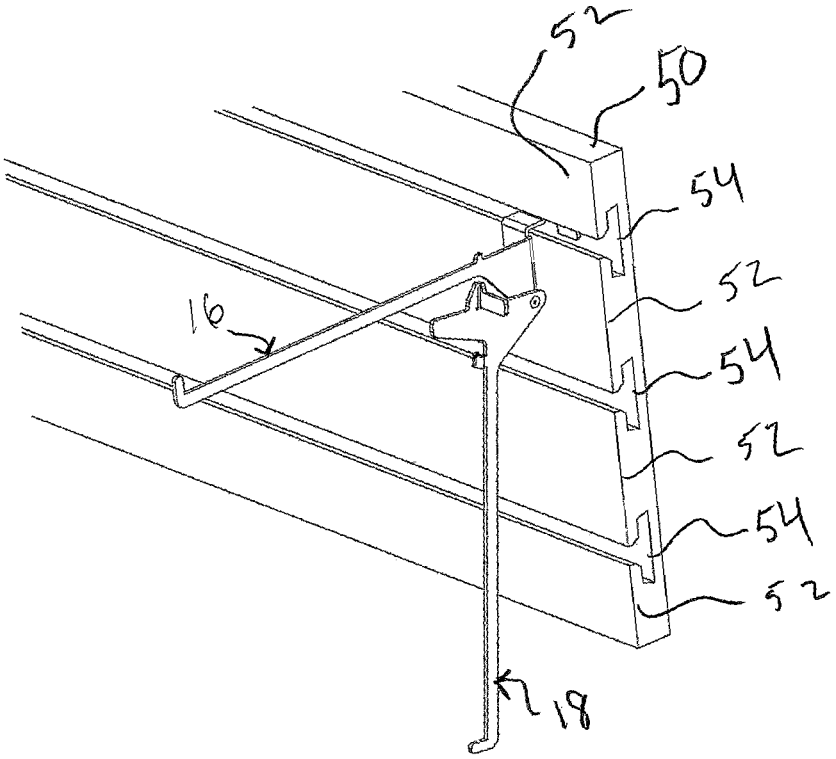
FIG. 6 is a perspective view of the hanger shown in FIG. 1 in the open position being applied to a slatwall in accordance with the present disclosure.
Figure 7:
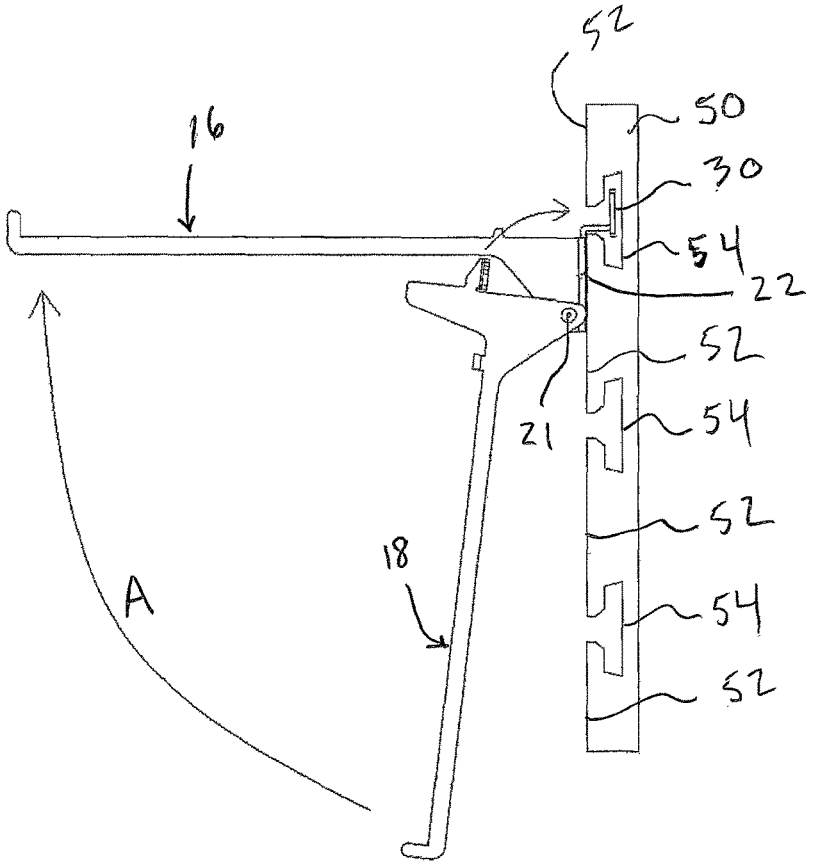
FIG. 7 is a side view of the hanger shown in FIG. 1 in the open position being applied to a slatwall, where the slatwall is shown in cross-section.

Referring to FIG. 5, hanger 10 is illustrated in an open position. First hanger member 16 is rotated relative to second hanger member 18 about pivot point 21. FIGS. 6 and 7 illustrate hanger 10 coupled to slatwall 50 in an open position. Slatwall 50 includes a number of horizontal boards or slats 52. Adjacent slats are spaced apart a given distance to form a number of uniform, horizontal slots 54. Retaining member 30 is disposed in an appropriate slot 54 of slatwall 50 and first hanger member 16 is rotated toward slatwall 50 until support member 22 comes into contact with slat 52. Second hanger member 18 is then rotated about pivot point 21, in the direction of arrow A shown in FIG. 7, until the first hanger leg 24 is aligned with second hanger leg 34.

Figure 8:
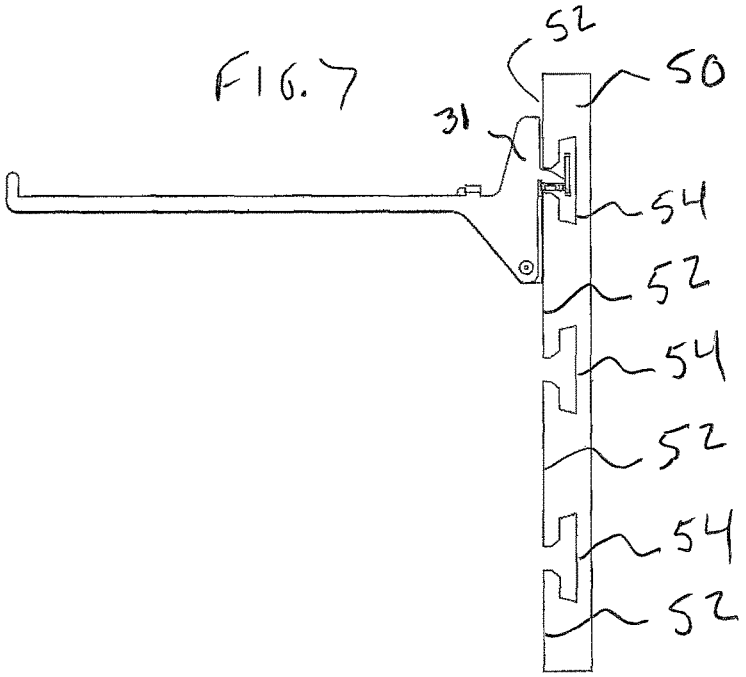
FIG. 8 is a side of the hanger shown in FIG. 1 in a closed position applied to a slatwall.
Figure 9:
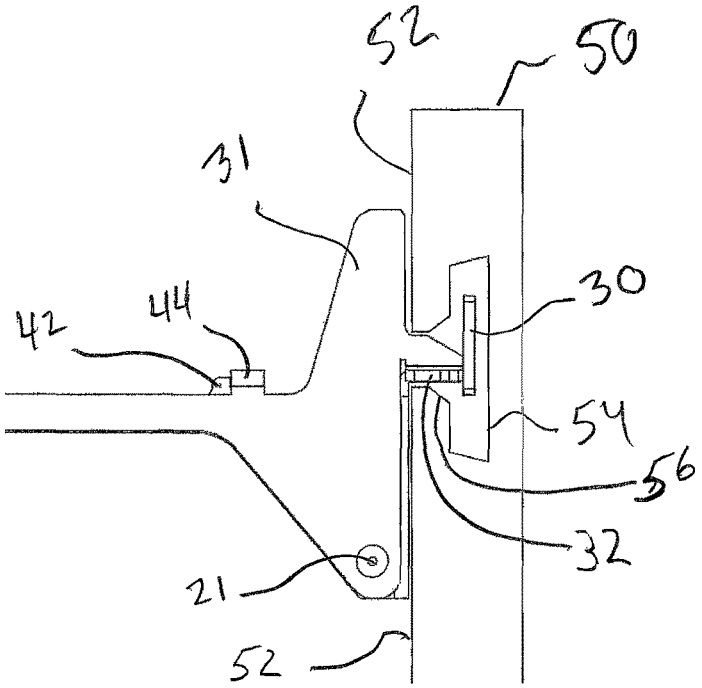
FIG. 9 is an enlarged side view of one end of the hanger disposed in the slatwall in accordance with the present disclosure.
Figure 10:
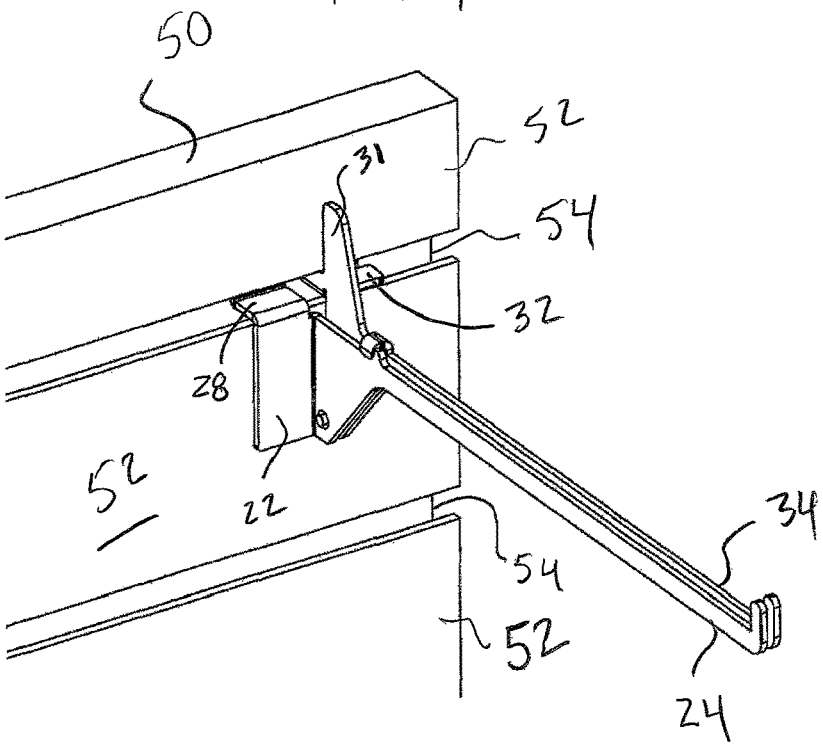
FIG. 10 is a left perspective view of the hanger shown in FIG. 1 mounted to a slatwall in accordance with the present disclosure.

FIGS. 8, 9 and 10 illustrate the hanger 10 coupled to the slatwall 50 in a closed position. In the closed position, first securing member 31 comes into contact with the slat 52 above the slot 54 where the retaining member 30 is disposed. Additionally, second securing member 32 comes into contact with a lower lip 56 of slot 54. In this manner, hanger 10 is securely disposed in slot 54. Due to the retaining member 30 in the slot 54 and the second securing member 32 in contact with a lower lip 56 of slot 54, the hanger 10 is prevented from being removed from the slatwall 50 when in the closed position.

Figure 11:
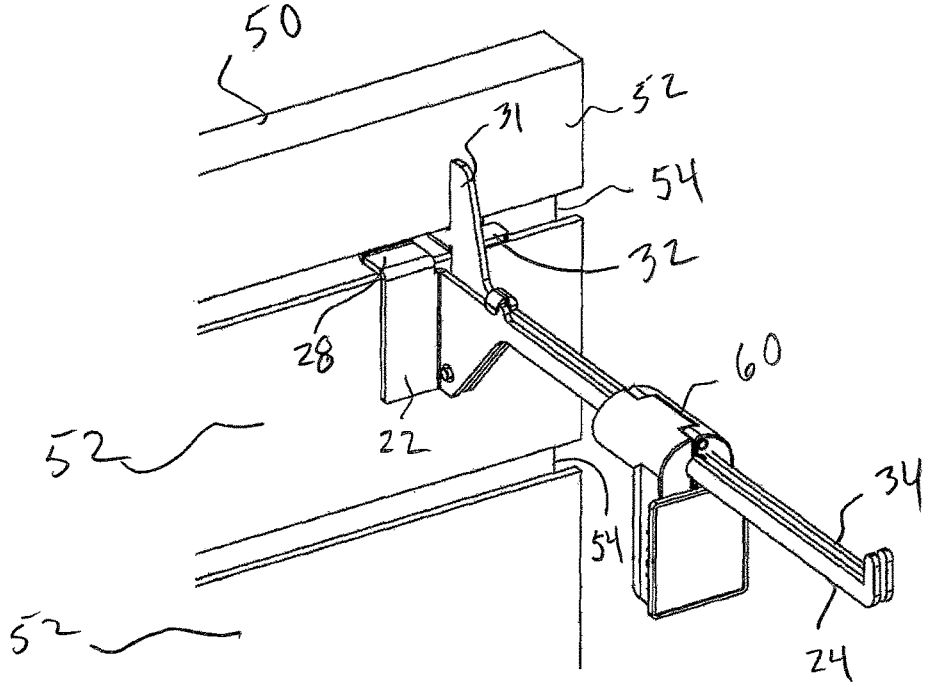
FIG. 11 is a left perspective view of the hanger of FIG. 1 mounted to a slatwall with a locking device mounted thereon.

FIG. 11 illustrates hanger 10 coupled to slatwall 50 with a locking device 60 disposed thereon. Exemplary locking devices are shown and described in commonly-owned U.S. Pat. Nos. 10,156,008 and D899,218, the contents of which are incorporated by reference. By providing a locking device disposed over first hanger leg 24 and second hanger leg 34, second hanger member 18 is prevented from rotating relative to first hanger member 16 (i.e., prevented from moving to an open position), thus preventing removal of the hanger 10 from the slatwall 50.

Figure 12:
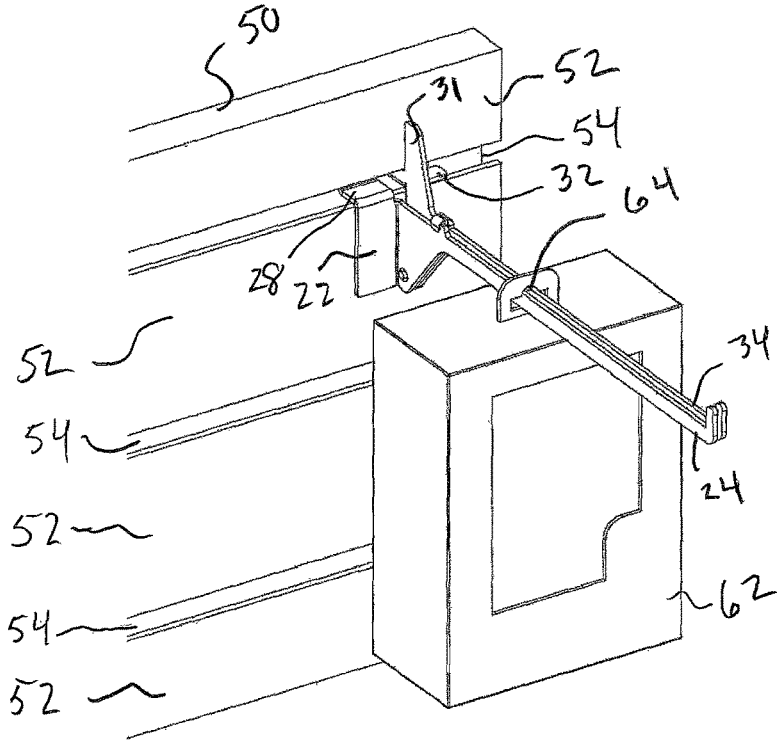
FIG. 12 is a left perspective view of the hanger shown in FIG. 1 mounted to a slatwall with an merchandise item disposed thereon.
Figure 13:
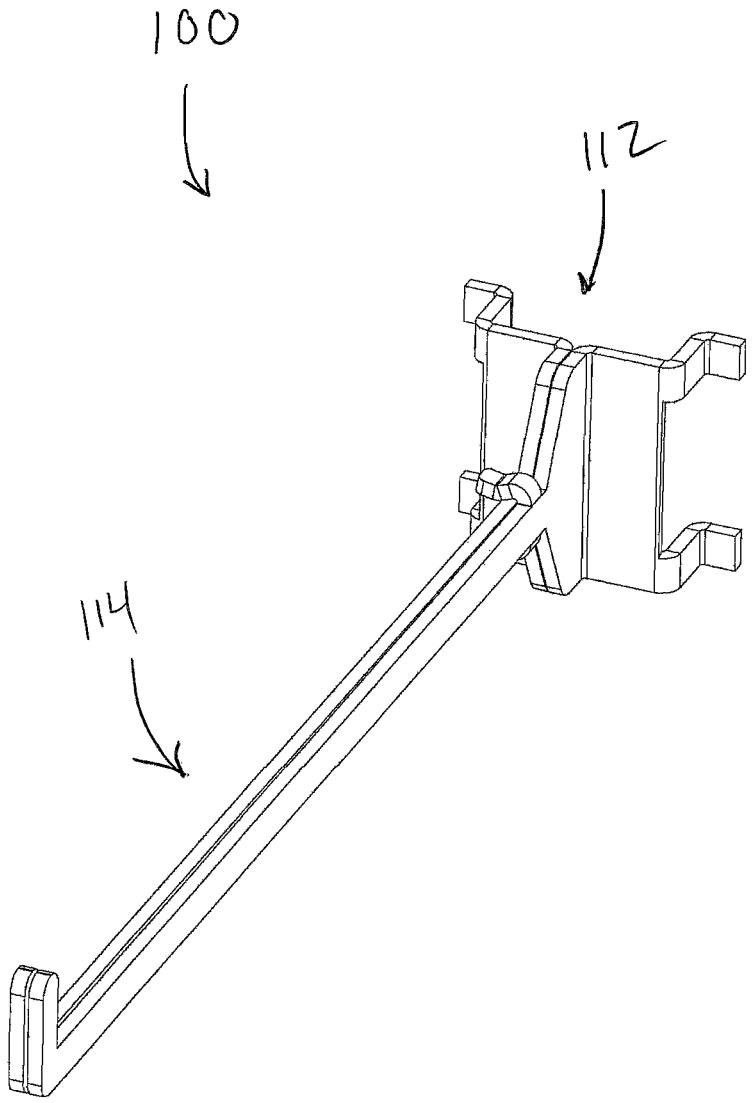
FIG. 13 is a right, perspective view of a pegboard hanger according to a second embodiment of the present disclosure.
Figure 14:
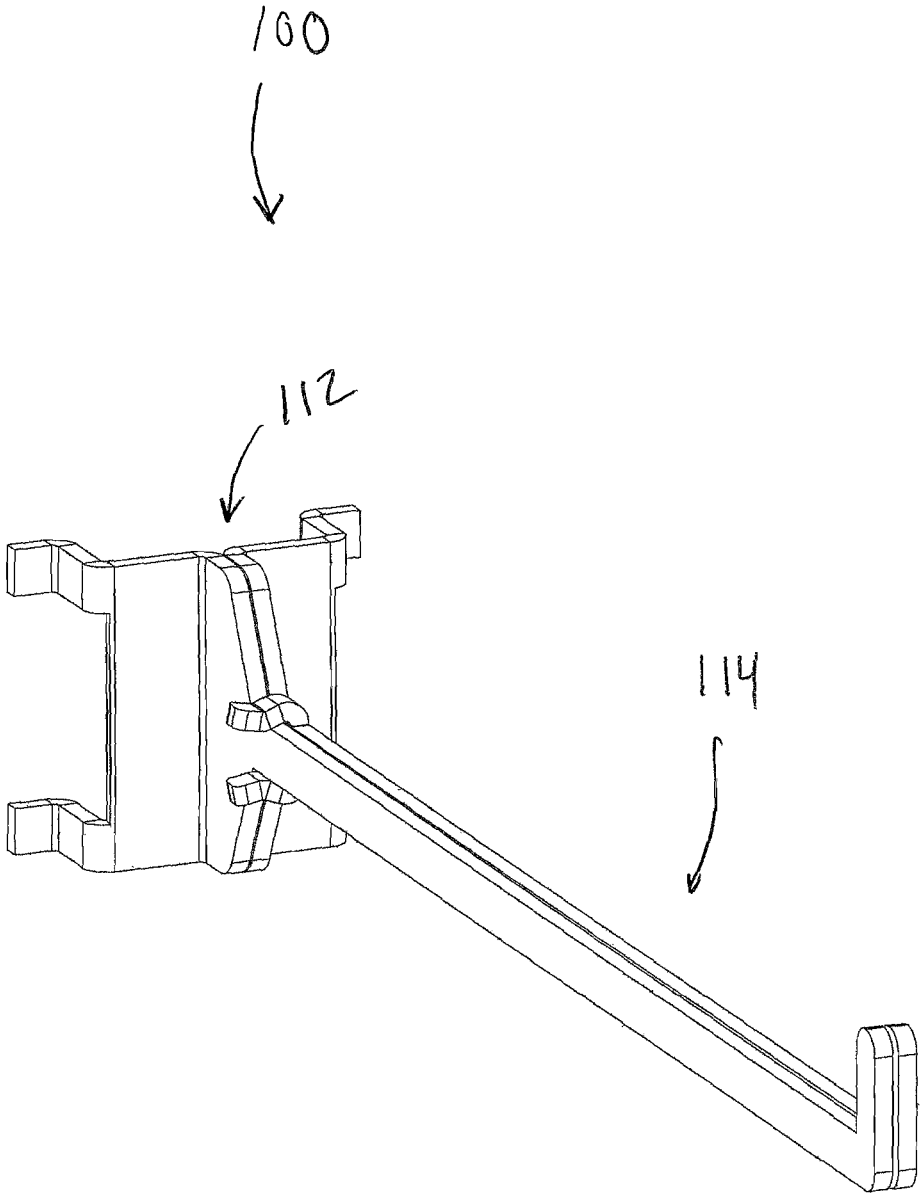
FIG. 14 is a left, perspective view of the hanger shown in FIG. 13 in accordance with the present disclosure.
Figure 15:
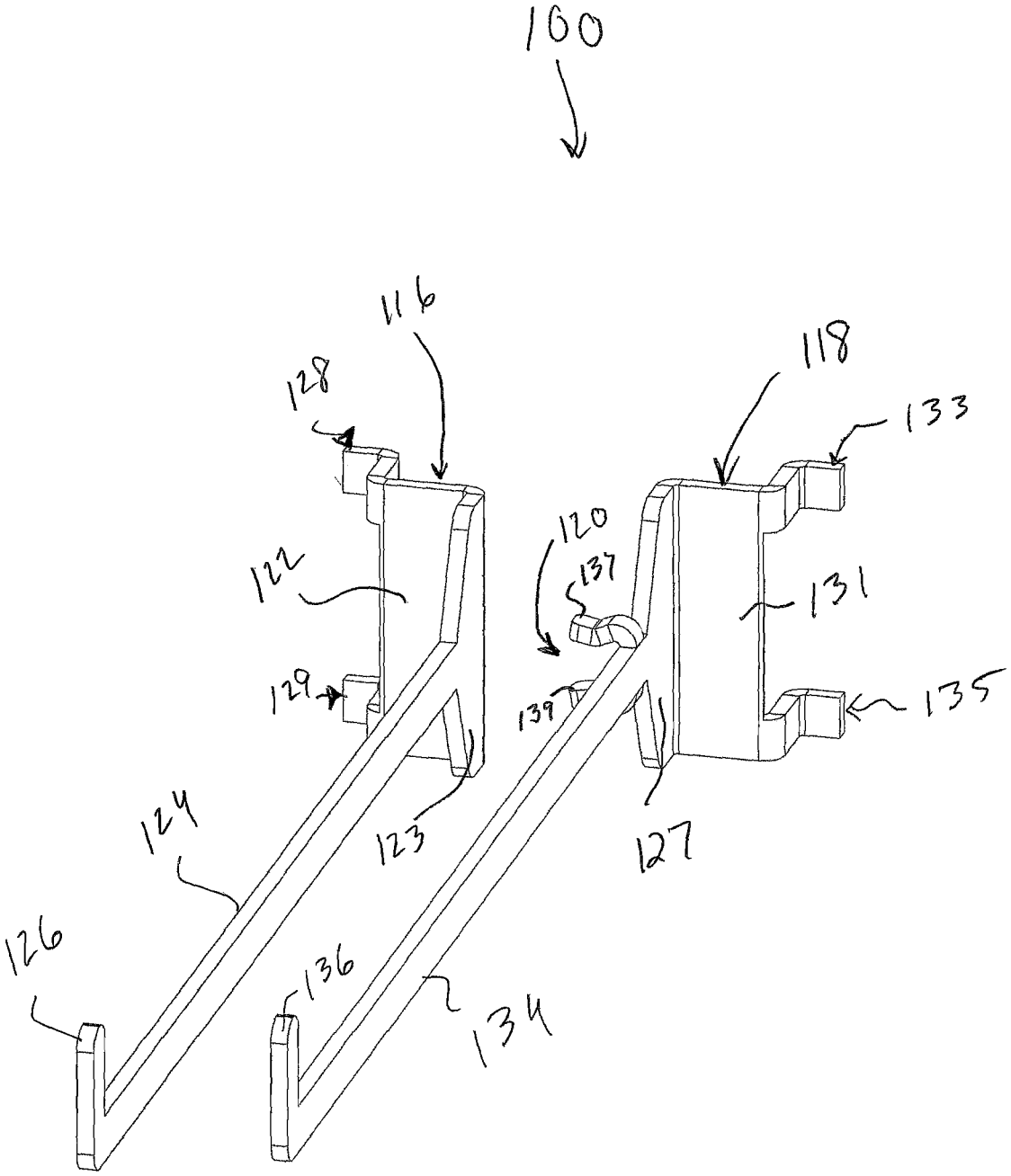
FIG. 15 is a right exploded perspective view of the hanger shown in FIG. 13.
Figure 16:
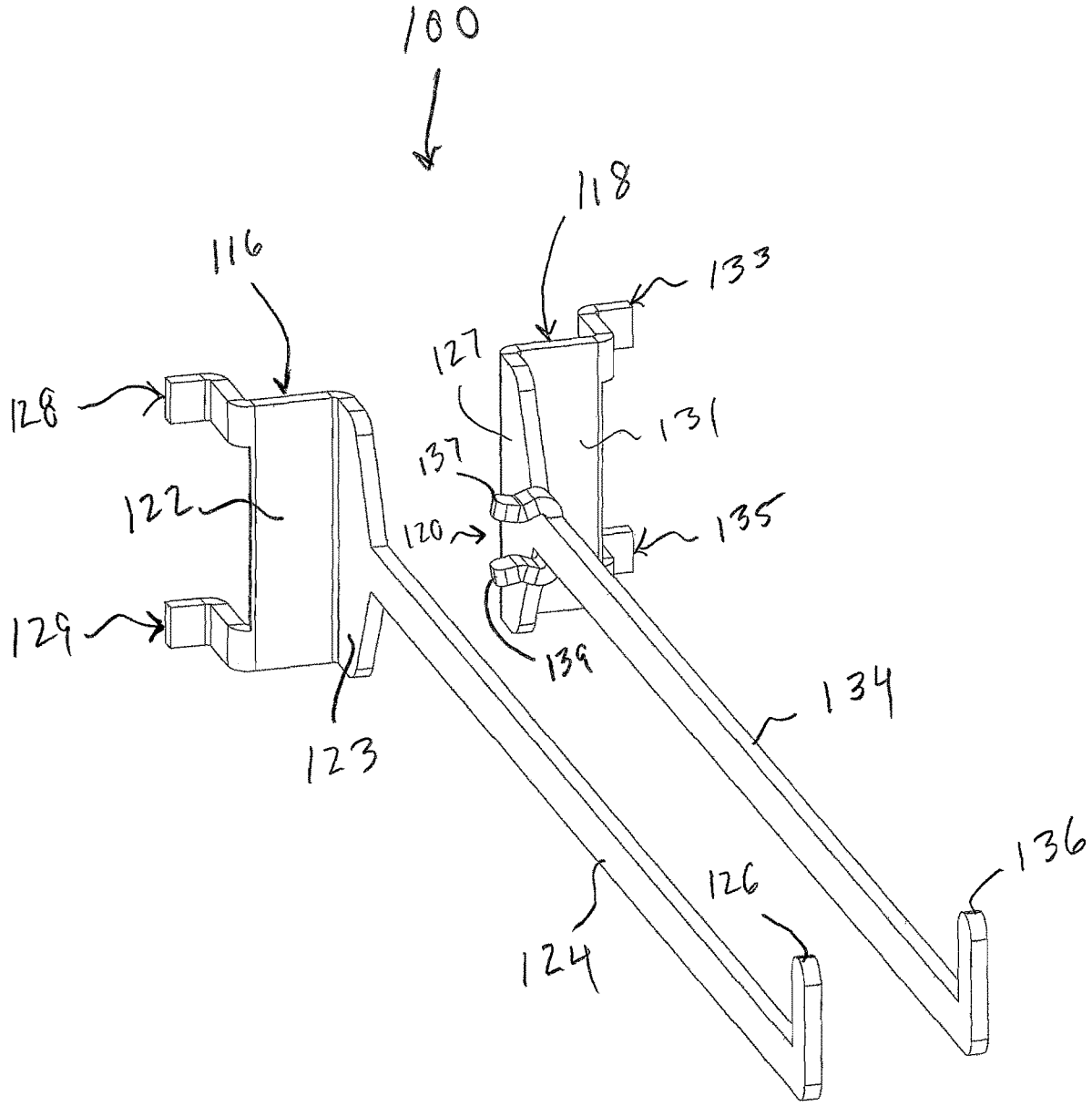
FIG. 16 is a left exploded perspective view of the hanger shown in FIG. 13.
Figure 17:
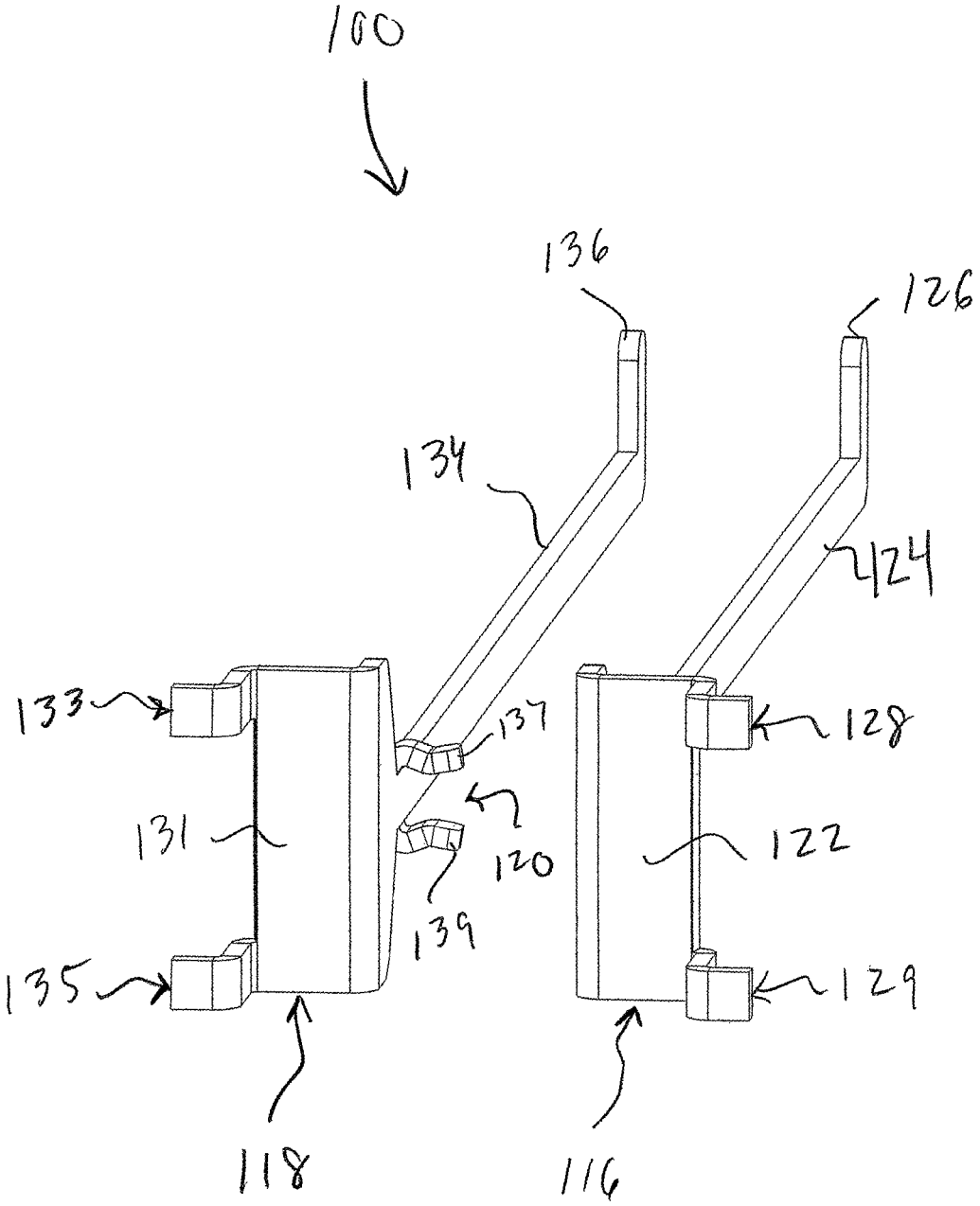
FIG. 17 is a rear exploded perspective view of the hanger shown in FIG. 13.
Figure 18:
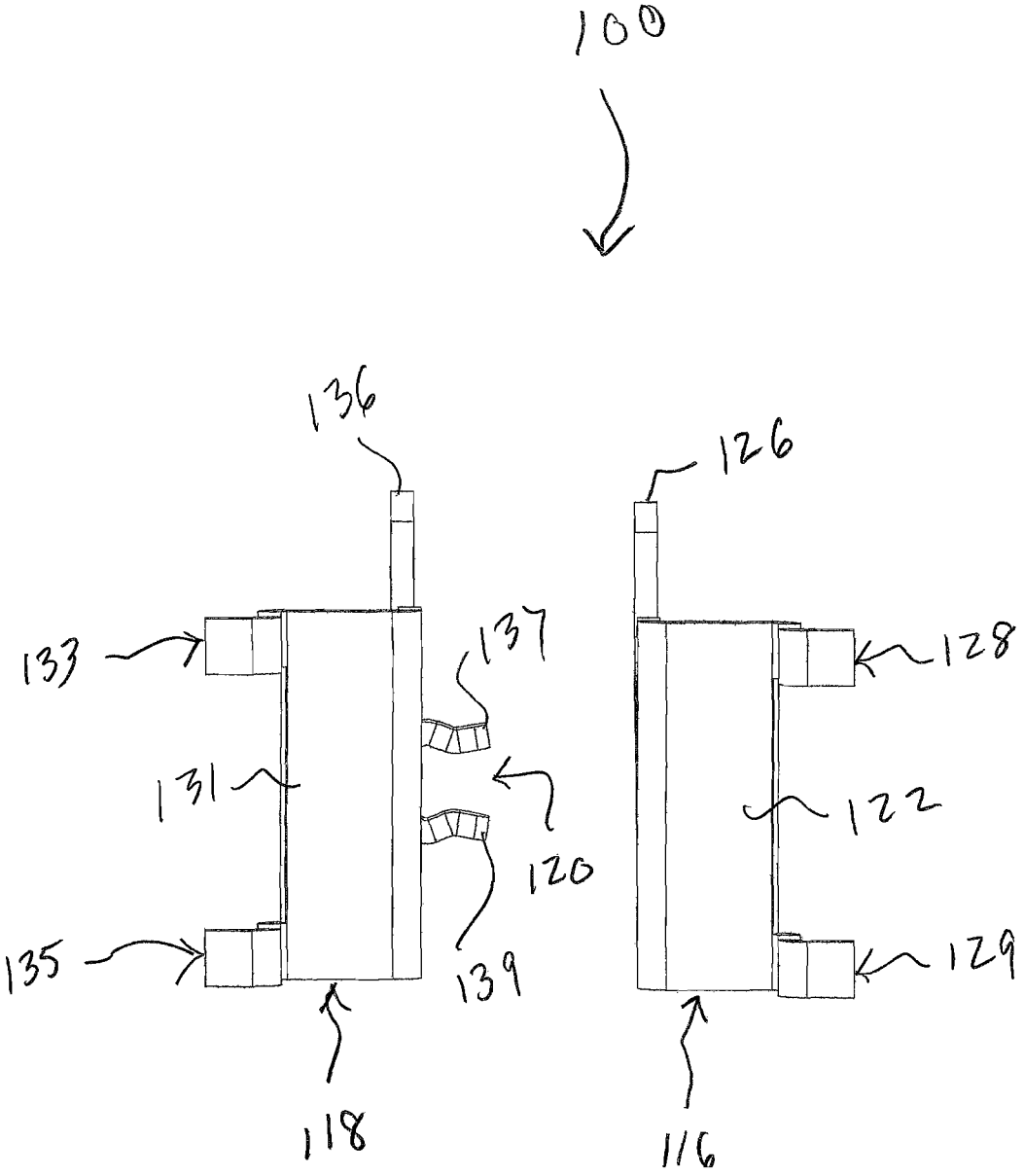
FIG. 18 is a rear exploded plan view of the hanger shown in FIG. 13.

FIG. 12 illustrates hanger 10 coupled to slatwall 50 with an item of merchandise 62 disposed thereon. Typically, items of merchandise can be packaged in or mounted on cardboard, plastic, or other material capable of supporting the weight of the merchandise. The packaging materials may include a hole, slot, or opening 64, generally near the top of the packaging, to receive the first and second hanger legs 24, 34. In this way, the merchandise hangs down from the first and second hanger legs 24, 34 and is clearly displayed and easily removed by customers. Additionally, by placing the item on the first and second hanger legs 24, 34, the hanger 10 is prevented from being moved into an open position and removed from the slatwall 50.

Figure 50A:
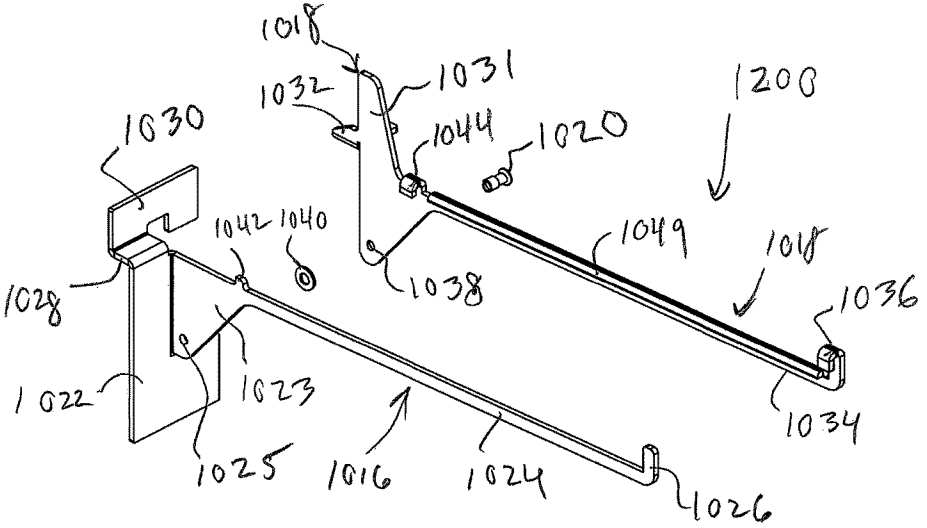
FIGS. 50A and 50B illustrate a hanger in accordance with an eleventh embodiment of the present disclosure.
Figure 50B:
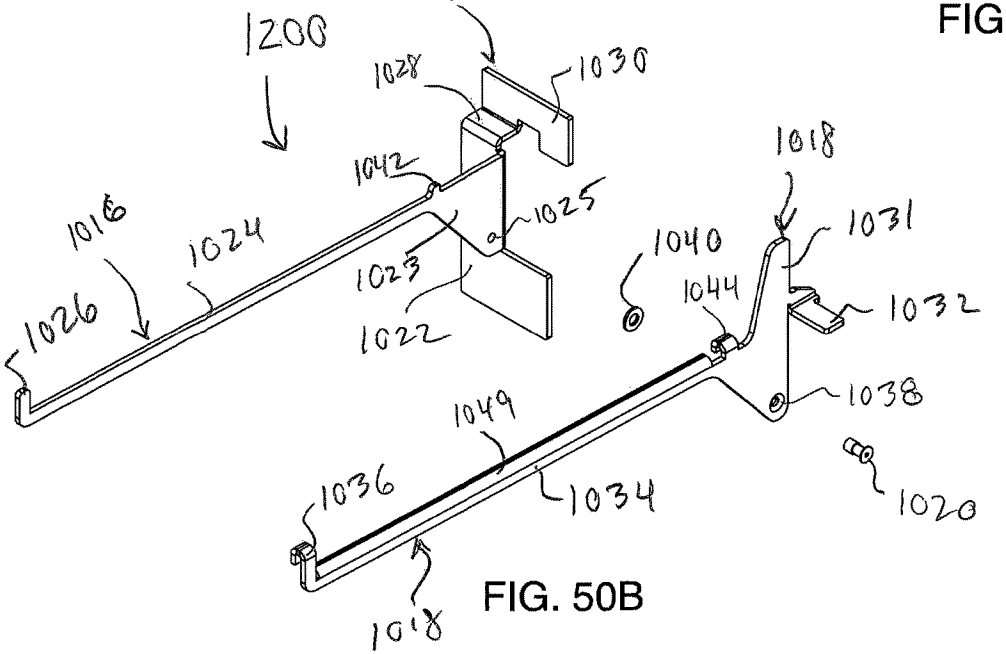
Figure 50D:
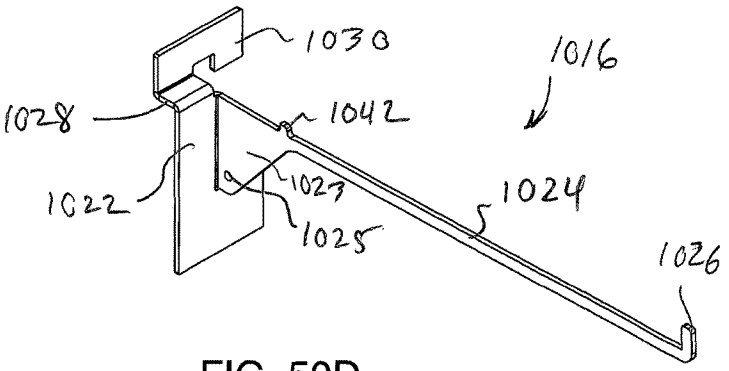
FIGS. 50C-50G illustrate various views of a first hanger member of the hanger shown in FIG. 50A in accordance with the present disclosure.
Figure 50C:
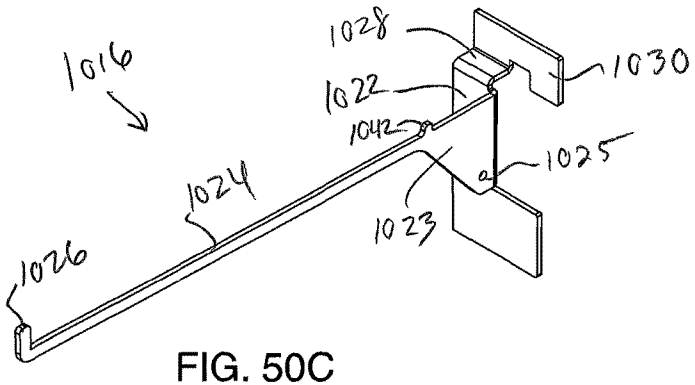
Figure 50E:
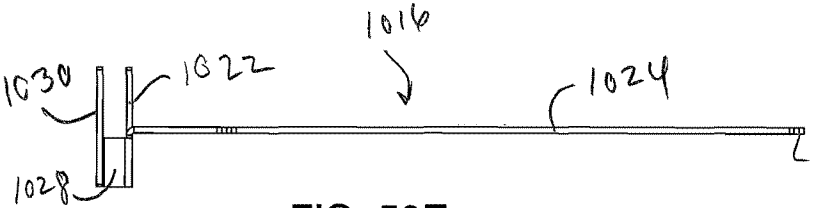
Figure 50F:
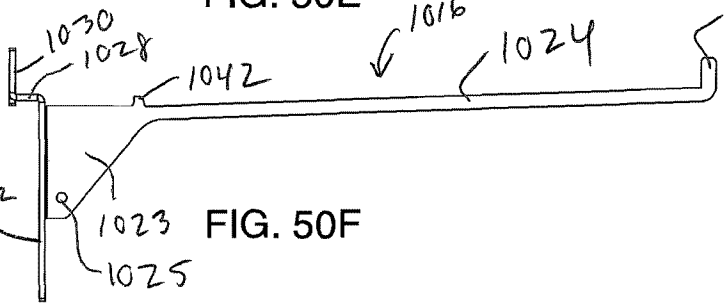
Figure 50G:
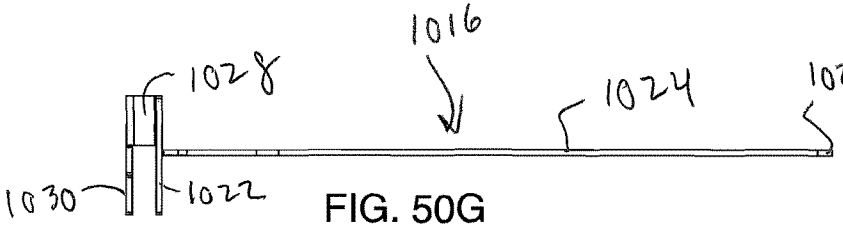
Figure 50H:
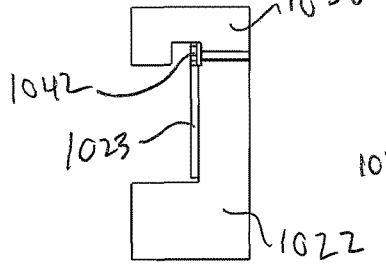
Figure 50I:
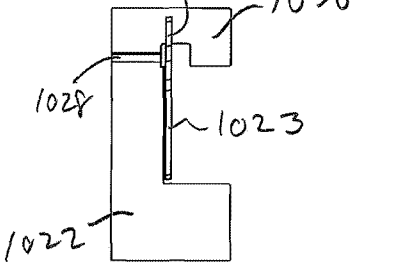
Figure 50K:
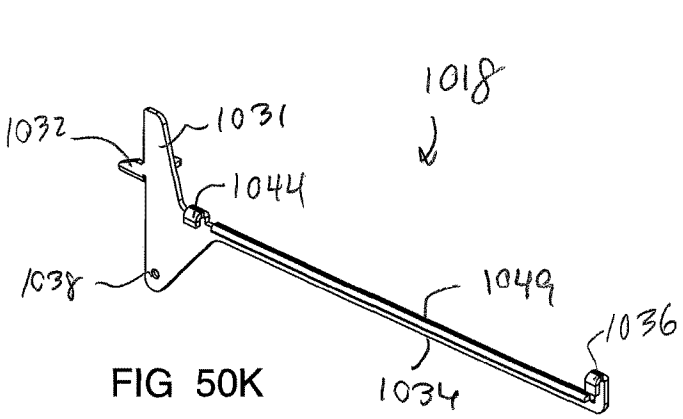
FIGS. 50J-50P illustrate various views of a first hanger member of the hanger shown in FIG. 50A in accordance with the present disclosure.
Figure 50J:
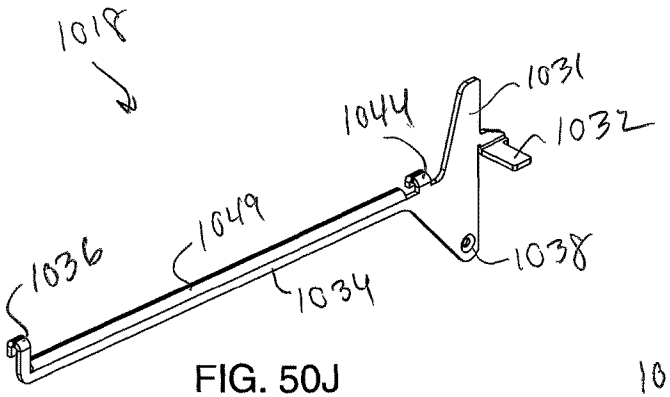
Figure 50L:
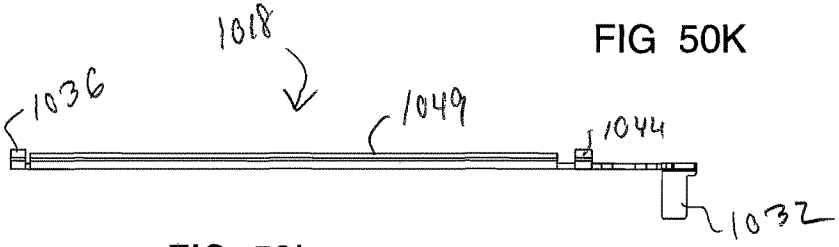
Figure 50P:
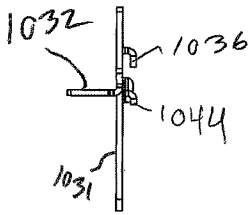
Figure 50M:
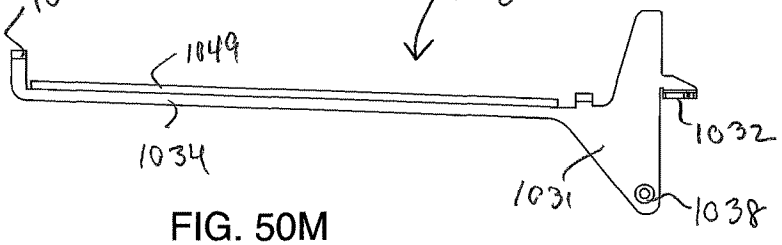
Figure 50N:
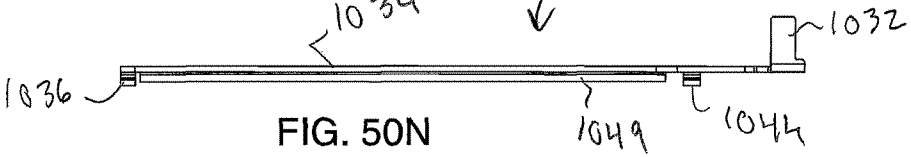

Referring to FIGS. 50A-50N, an alternate version of the hanger shown in FIGS. 1-12 is shown. Hanger 1200 is similar to hanger 10 where like references numerals are used for like components. For the sake of conciseness, similar components will not be described here in details. FIG. 50A illustrates a left perspective, exploded view of hanger 1200 and FIG. 50B illustrates a right perspective, exploded view.

Figure 50O:
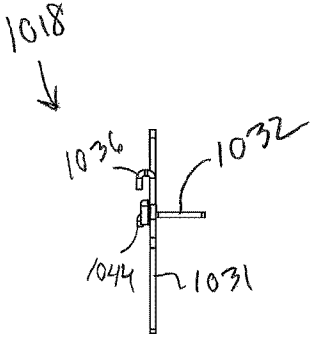

Hanger 1200 includes first hanger member 1016 and second hanger member 1018 which are rotatably coupled to one another via coupling member 1020, e.g., a rivet. FIGS. 50C-50I illustrates various views of the first hanger member 1016, where FIG. 50C is a right perspective view, FIG. 50D is a left perspective view, FIG. 50E is a top view, FIG. 50F is a left side, FIG. 50G is a bottom view, FIG. 50H is a rear view and FIG. 50I is a front view. FIGS. 50J-50N illustrates various views of the second hanger member 1018, where FIG. 50J is a right perspective view, FIG. 50K is a left perspective view, FIG. 50L is a top view, FIG. 50M is a left side, FIG. 50N is a bottom view, FIG. 50O is a front view and FIG. 50P is a rear view.

First hanger member 1016 includes a support member 1022 configured to come into full contact with a slat of a slatwall. A first hanger leg 1024 extends perpendicularly from the support member 1022 via portion 1023. The first hanger leg 1024 includes a first extension member 1026 which extends perpendicularly from the first hanger leg 1024. An offset member 1028 couples the support member 1022 to a retaining member 1030 configured to be disposed in a slot of a slatwall. It is to be appreciated that the support member 1022 is in a parallel relationship with retaining member 1030 offset by the width of member 1028.

The second hanger member 1018 includes a first securing member 1031 and a second securing member 1032. A second hanger leg 1034 extends from the first securing member 1031 and a second extension member 1036 extends perpendicularly from the second hanger leg 1034. The extension member 1036 is configured as a semi-circular extension or catch. Similarly, a second catch 1044 is disposed on the leg 1034 adjacent first securing member 1031. Additionally, a lip 1049 runs lengthwise along leg 1034. The lip 1049 extends in a perpendicular manner from leg 1034. In this manner, first hanger member 1016 is rotatably coupled to second hanger member 1018 having a pivot point where the apertures 1023, 1025 align. In use, the first hanger member 1016 is coupled to a slatwall as described above. The second hanger member 1018 is rotated to be aligned with the first hanger member 1018. First hanger member 1016 includes a detent 1042 that engages with catch 1044. When rotated about pivot point, detent 1042 will engage with catch 1044, extension member 1026 will engage with catch 1036 and leg 1024 comes into contact with lip 1049 thus securing the hanger 1200 to the slatwall.

Referring to FIGS. 13-18, a hanger 100 in accordance with another embodiment of the present disclosure is provided. Hanger 100 includes a retaining portion 112 that retains the hanger 100 to a pegboard and a hanging portion 114 that enable items of merchandise to be placed thereon and be displayed. Hanger 100 includes first hanger member 116 and second hanger member 118 which are coupled to one another via coupling member 120, e.g., a clip.

First hanger member 116 includes a support member 122 configured to come into full contact with the pegboard. A first hanger leg 124 extends perpendicularly from the first support member 122 via portion 123. The first hanger leg 124 includes a first extension member 126 which extends perpendicularly from the first hanger leg 124. First retaining member 128 and second retaining member 129 extend perpendicularly from first support member 122 in a direction opposition of the first hanger leg 124. First and second retaining members 128, 129 form right angle legs that are disposed in apertures of a pegboard during installation, the details of which will be described below.

Second hanger member 118 includes a second support member 131 configured to come into full contact with the pegboard. A second hanger leg 134 extends perpendicularly from the second support member 131 via portion 127. The second hanger leg 134 includes a second extension member 136 which extends perpendicularly from the second hanger leg 124. Third retaining member 133 and fourth retaining member 135 extend perpendicularly from second support member 131 in a direction opposition of the second hanger leg 134. Third and fourth retaining members 133, 135 form right angle legs that are disposed in apertures of a pegboard during installation, the details of which will be described below.

The first hanger member 116 is coupled to the second hanger member 118 via coupling member 120, e.g., a clip, formed on the second hanger leg 134. It is to be appreciated that the coupling member may be on either the first or second hanger leg 124, 134. In one embodiment, coupling member 120 includes first and second clip arms 137, 139 that are configured to grasp (or snap onto) the first hanger leg 124 when the first and second hanger legs 124, 134 are aligned and brought together. When the hanger 10 is installed on a pegboard, the coupling member 120 will secure the first and second hanger members 116, 118 together preventing the hanger 10 from easily being removed or knock-off the pegboard.

Figure 19:
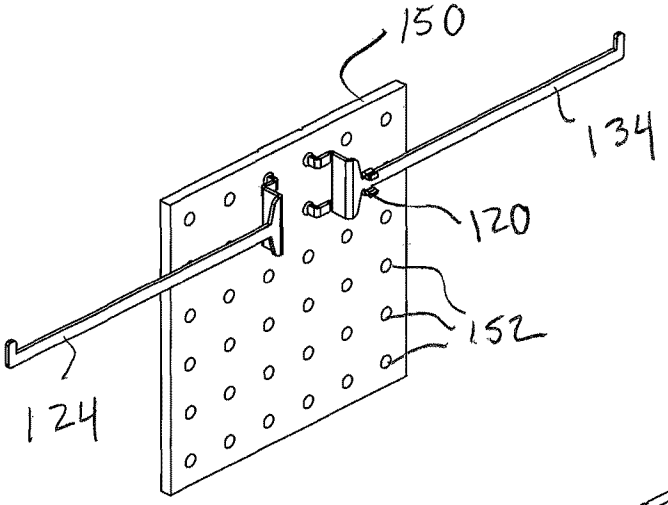
FIG. 19 is a perspective view of the hanger shown in FIG. 13 in the open position being applied to a pegboard in accordance with the present disclosure.
Figure 20:
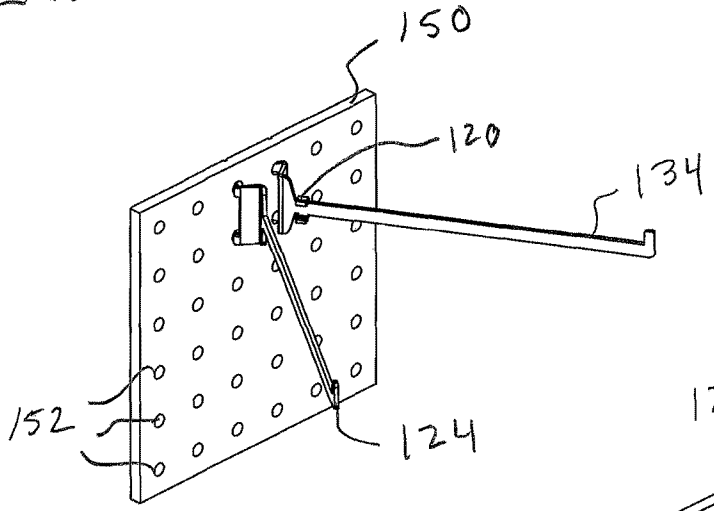
FIG. 20 is another perspective view of the hanger shown in FIG. 13 in the open position being applied to a slatwall in accordance with the present disclosure.

Referring to FIGS. 19 and 20, hanger 100 is illustrated in an open position to be mounted or installed on a pegboard 150. Pegboard 150 includes a number of apertures 152. Adjacent apertures are spaced apart a given distance to form a number of uniform, horizontal rows of aperture 152. First and second retaining members 128, 129 of first hanger member 116 are disposed in vertically adjacent apertures 152 of pegboard 150 while third and fourth retaining members 133, 135 of second hanger member 118 are disposed in horizontally adjacent apertures 152 relative to the apertures 152 employed by the first hanger member 116, as is best shown in FIG. 20. First hanger member 116 is then horizontally brought into contact with second hanger member 118.

Figure 21:
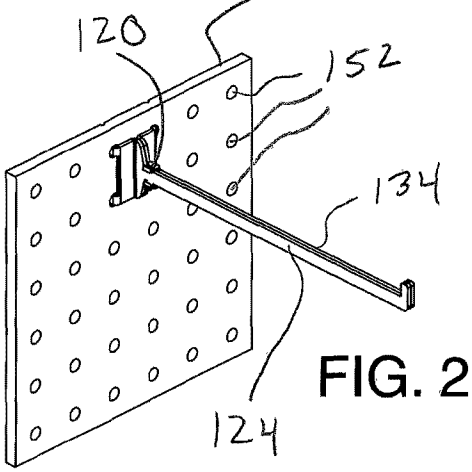
FIG. 21 is a left perspective view of the hanger shown in FIG. 13 mounted to a pegboard in accordance with the present disclosure.

FIG. 21 illustrates the hanger 100 coupled to the pegboard 150 in a closed position. In the closed position, the first hanger leg 124 is in contact with second hanger leg 134 and the first and second hanger legs 124, 134 are secured via coupling member 120. In this manner, hanger 100 is securely disposed on the pegboard 150.

Figure 22:
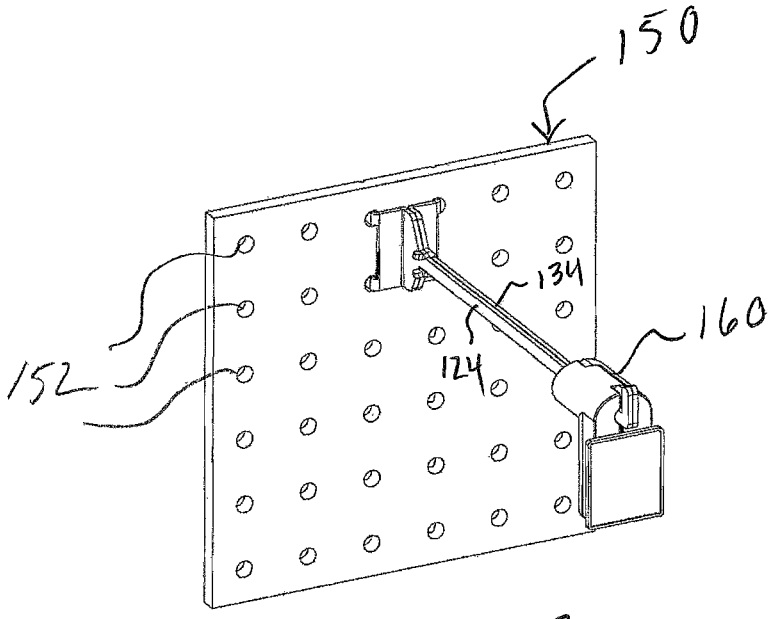
FIG. 22 is a left perspective view of the hanger of FIG. 13 mounted to a pegboard with a locking device mounted thereon.

FIG. 22 illustrates hanger 100 coupling to pegboard 150 with a locking device 160 disposed thereon. Exemplary locking devices are shown and described in commonly-owned U.S. Pat. Nos. 10,156,008 and D899,218, the contents of which are incorporated by reference. By providing a locking device disposed over first hanger leg 124 and second hanger leg 134, second hanger member 118 is prevented from being removed from first hanger member 116, thus preventing removal of the hanger 110 from the pegboard 150.

Figure 23:
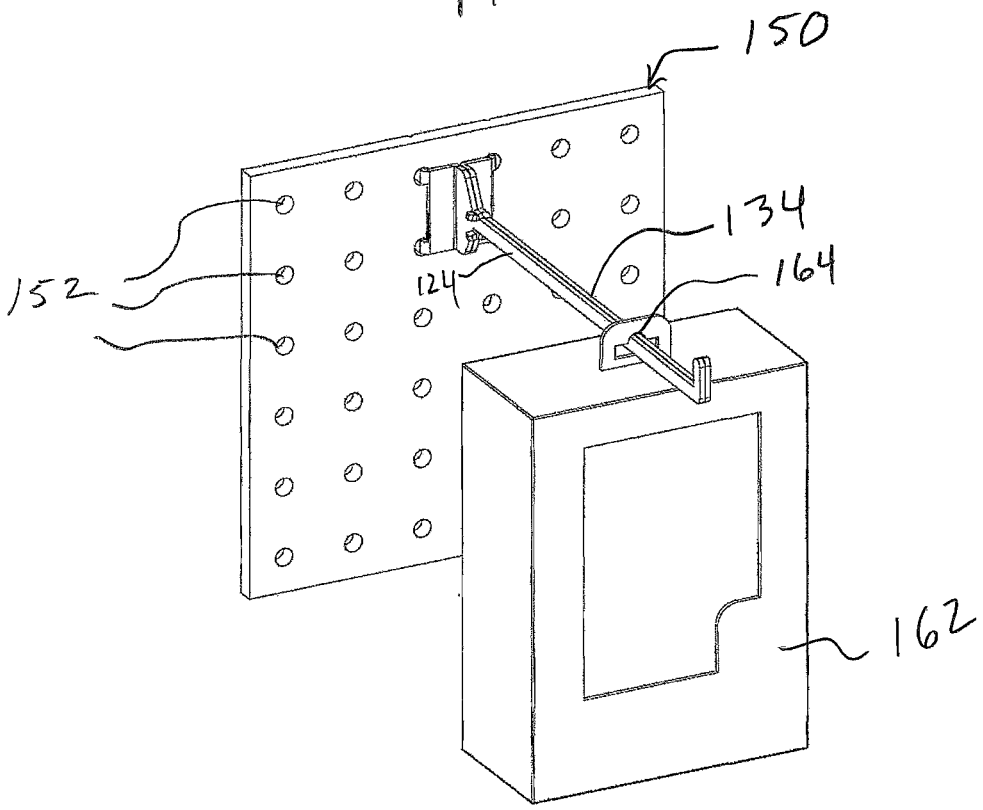
FIG. 23 is a left perspective view of the hanger shown in FIG. 13 mounted to a pegboard with an merchandise item disposed thereon.

FIG. 23 illustrates hanger 100 coupled to pegboard 150 with an item of merchandise 162 disposed thereon. Typically, items of merchandise can be packaged in or mounted on cardboard, plastic, or other material capable of supporting the weight of the merchandise. The packaging materials may include a hole, slot, or opening 164, generally near the top of the packaging, to receive the first and second hanger legs 124, 134. In this way, the merchandise hangs down from the first and second hanger legs 124, 134 and is clearly displayed and easily removed by customers. By providing a item of merchandise 162 disposed over first hanger leg 124 and second hanger leg 134, second hanger member 118 is prevented from being removed from first hanger member 116, thus preventing removal of the hanger 110 from the pegboard 150.

Referring to FIGS. 24A-28, a hanger 200 in accordance with a third embodiment of the present disclosure is provided. Hanger 200 includes a retaining portion 212 that retains the hanger 200 to a slatgrid/slatwall and a hanging portion 214 that enable items of merchandise to be placed thereon and be displayed. Hanger 100 includes first hanger member 216 and second hanger member 218 which are coupled to one another, as will be described below.

First hanger member 216 includes a support member 222 configured to come into contact with the slatgrid/slatwall. A first hanger leg 224 extends perpendicularly from the first support member 222 via portion 223. The first hanger leg 224 includes a first extension member 226 which extends perpendicularly from the first hanger leg 224. First retaining member 228 and second retaining member 229 are offset from first support member 222 by portion 223. First and second retaining members 228, 229 are offset but substantially parallel to first support member 222.

Second hanger member 218 includes a support member 231 configured to come into contact with the slatgrid/slatwall. A second hanger leg 234 extends perpendicularly from the second support member 231 via portion 227. The second hanger leg 234 includes a second extension member 236 which extends perpendicularly from the second hanger leg 234. Third retaining member 233 and fourth retaining member 235 are offset from second support member 231 by portion 227. Third and fourth retaining members 233, 235 are offset but substantially parallel to first support member 231.

Figure 28:
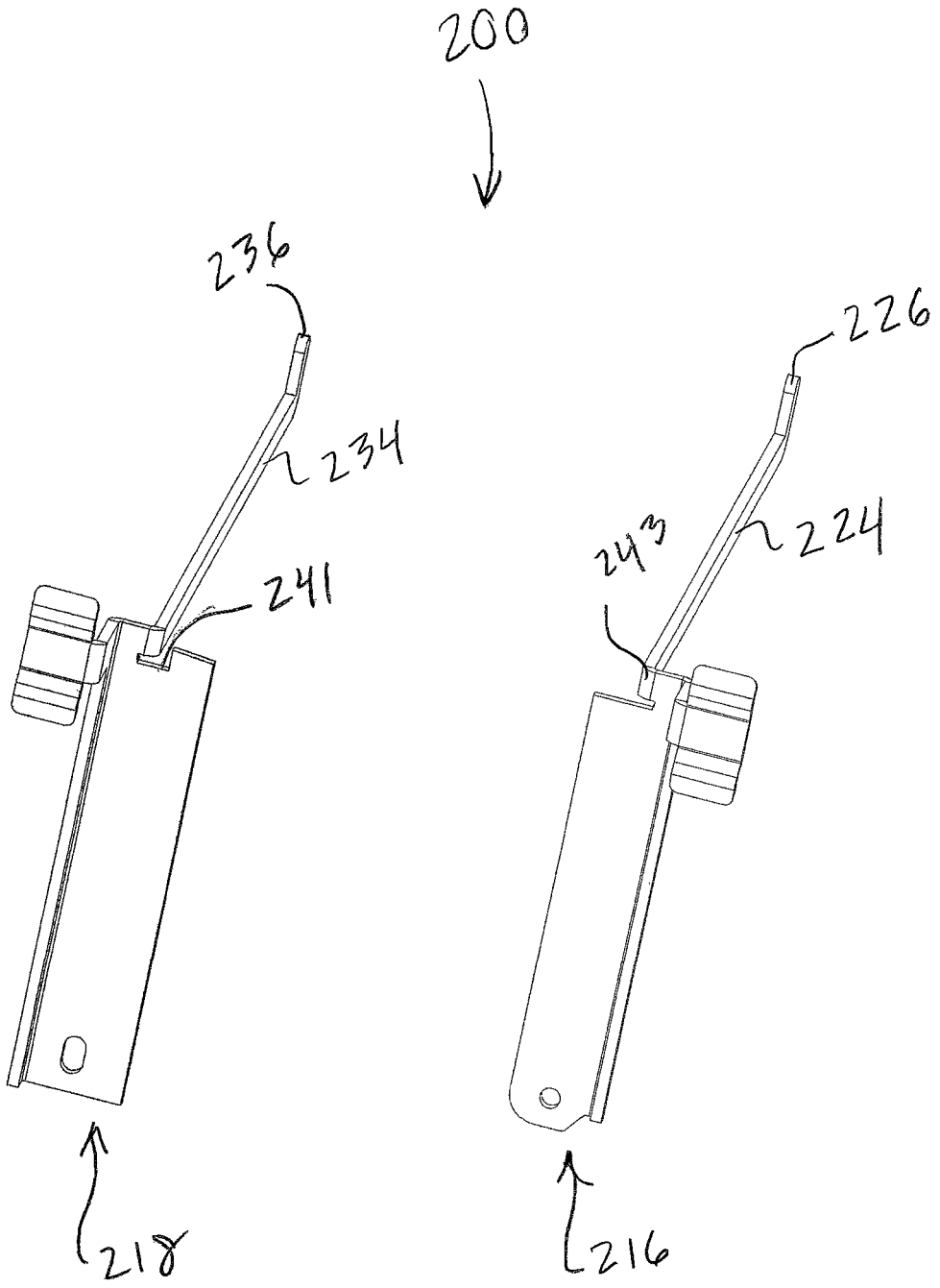
FIG. 28 is a rear exploded perspective view of the hanger shown in FIG. 24A.
Figure 29:
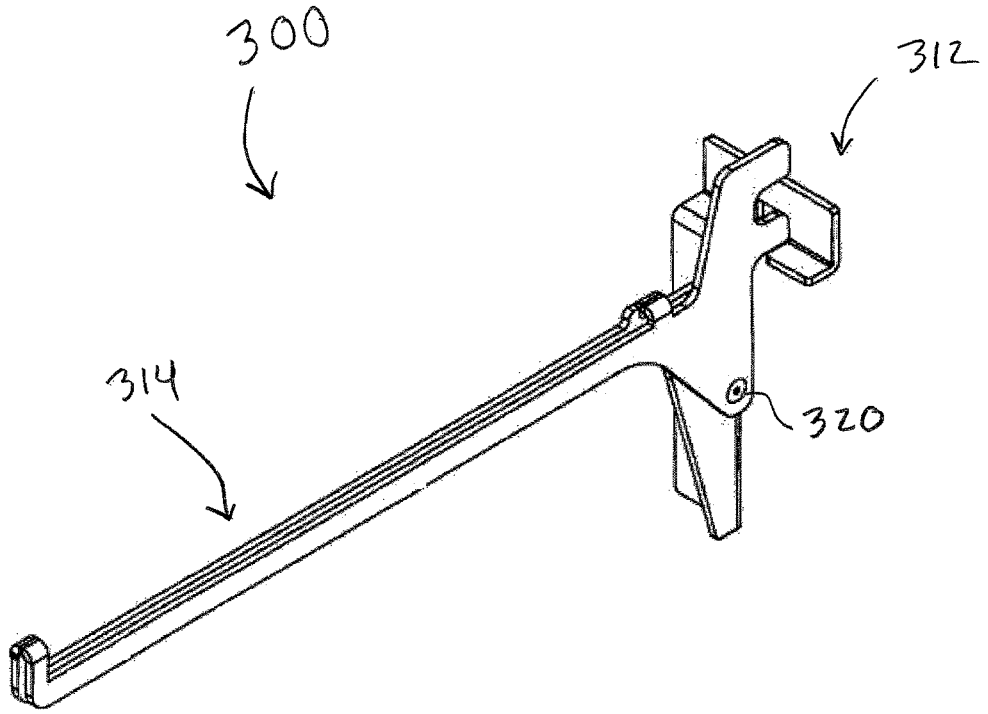
FIG. 29 is a right, perspective view of a slatgrid hanger according to a fourth embodiment of the present disclosure.
Figure 30:
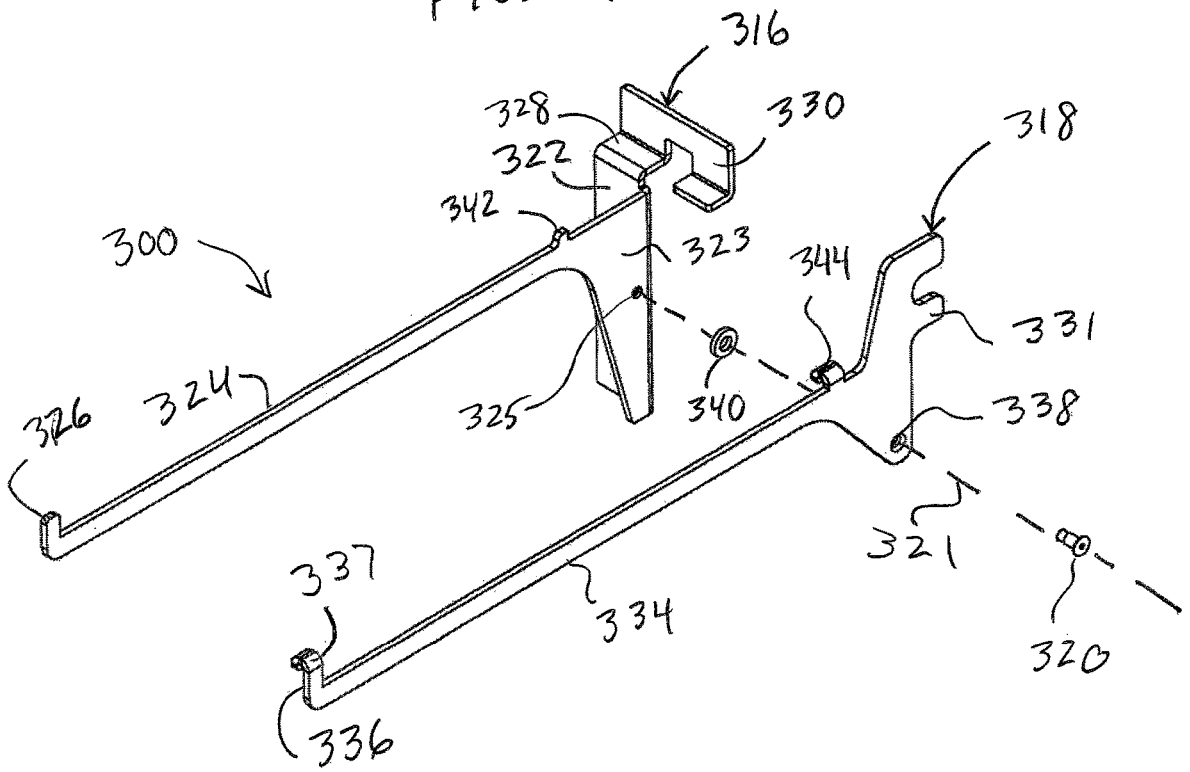
FIG. 30 is a right exploded perspective view of the hanger shown in FIG. 29.
Figure 31:
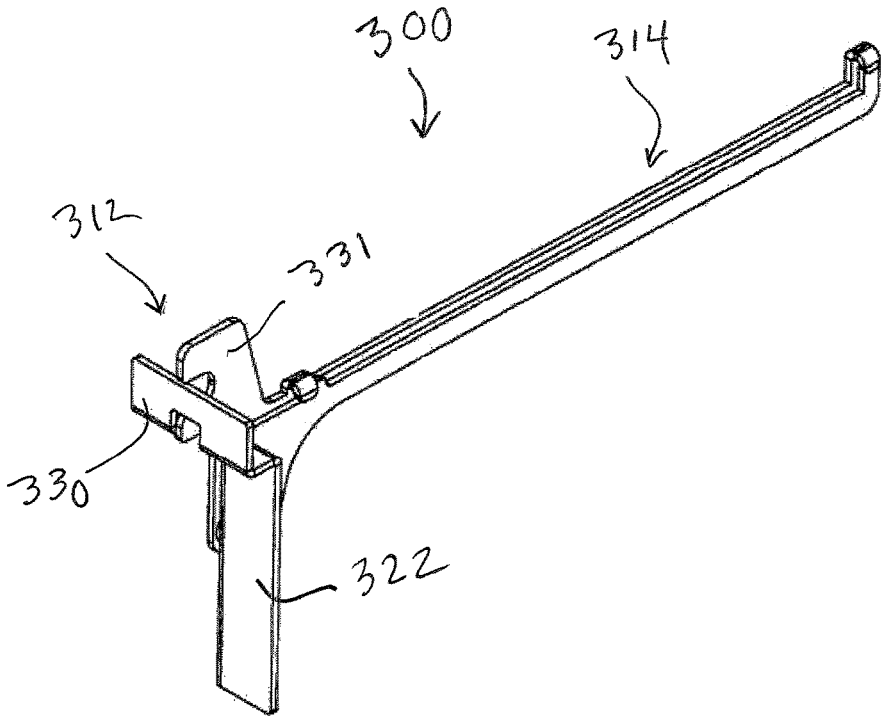
FIG. 31 is a rear, left perspective view of the hanger shown in FIG. 29.
Figure 32:
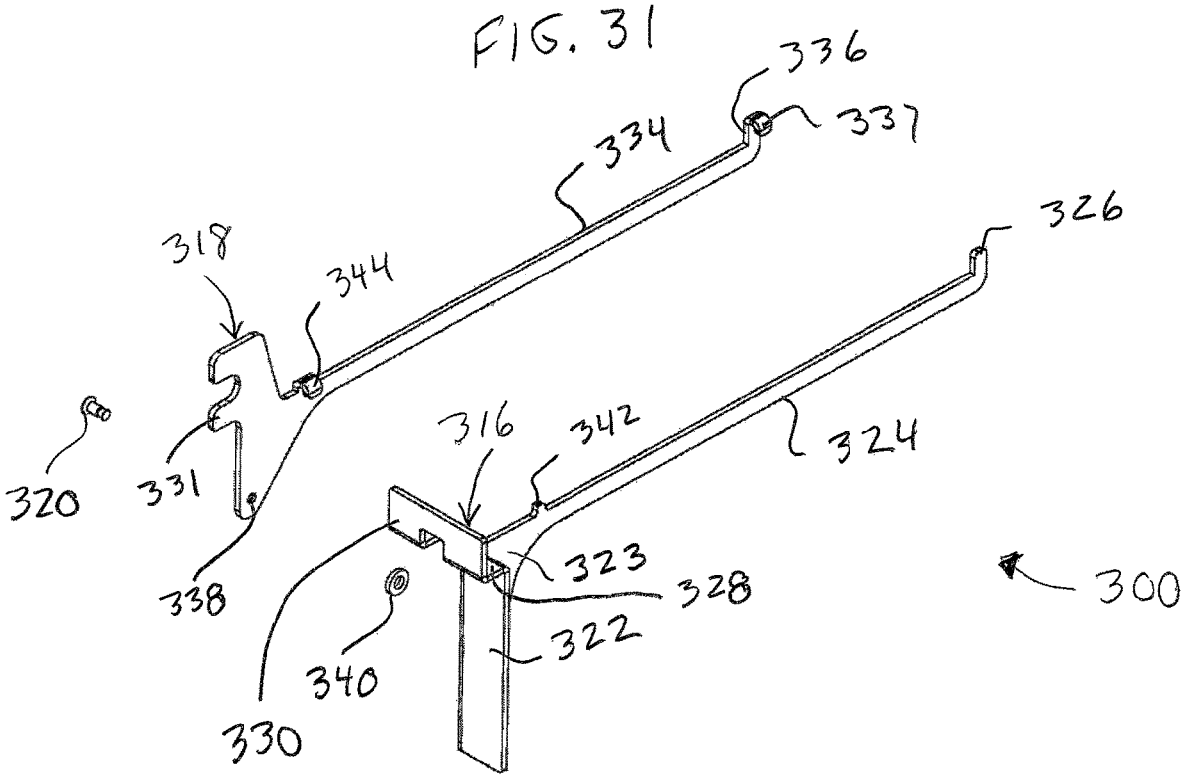
FIG. 32 is a rear, left exploded view of the hanger shown in FIG. 29.

Referring to FIG. 28, second hanger member 218 includes a slot 241 configured to receive a portion 243 of first hanger leg 224. When installing hanger 200 to a slatgrid, first hanger member 216 is coupled to second hanger member 218 by positioning first support member 222 directly behind second support member 231 and disposing portion 243 of first hanger leg 224 in slot 241 of second hanger member 218. First, second, third and fourth retaining members 228, 229, 233, 235 are then disposed between two wire rails of a slatgrid or a slot on a slatwall configuration and the first support member 222 is brought into contact with the slatgrid. It is to be appreciated that, in one embodiment, first, second, third and fourth retaining members 228, 229, 233, 235 are curved and configured to substantially mate with the wire rails of the slatgrid. Additionally, first support member 222 includes aperture 225 and second support member 231 includes aperture 238.

Figure 24A:
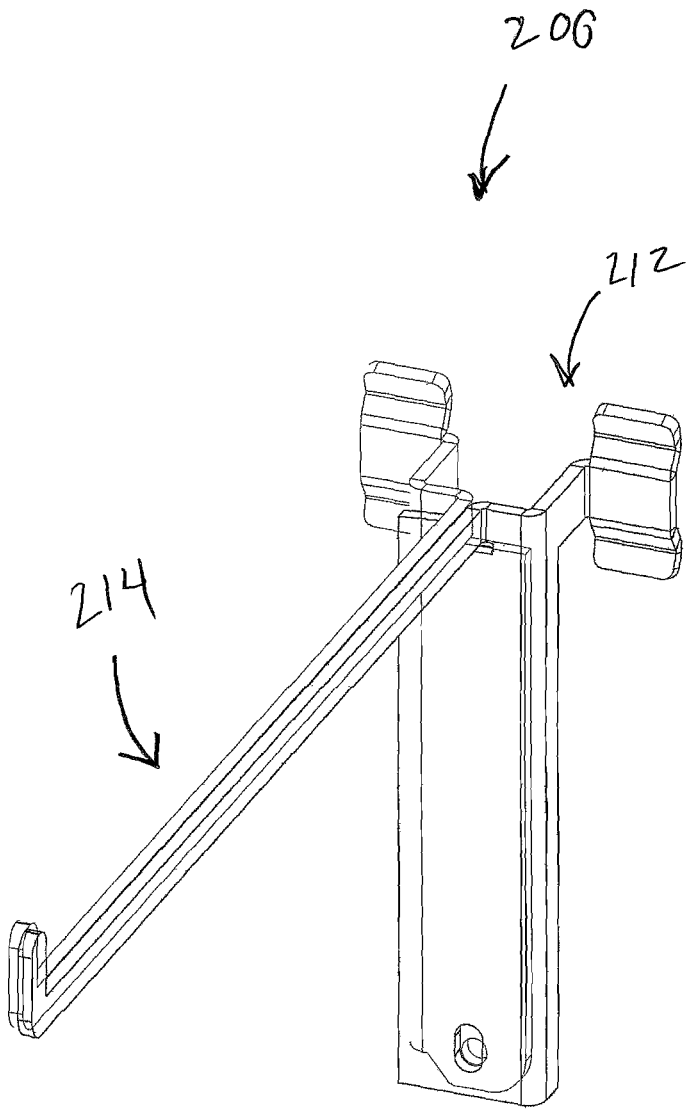
FIG. 24A is a right, perspective view of a slatgrid hanger according to a third embodiment of the present disclosure.
Figure 24B:
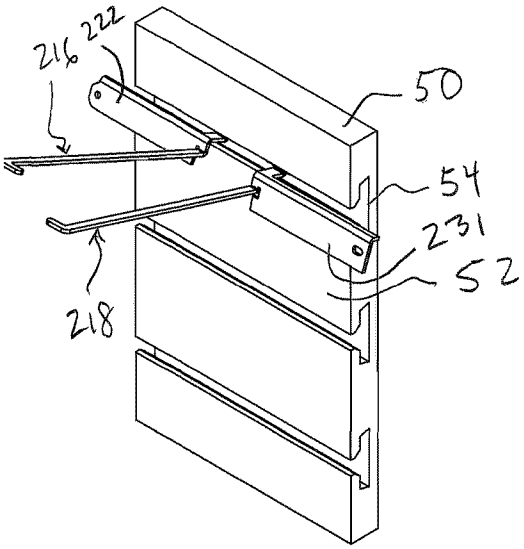
FIGS. 24B-G illustrate a method for securing the slatgrid hanger shown in FIG. 24A to a slatwall in accordance with the present disclosure.
Figure 24C:
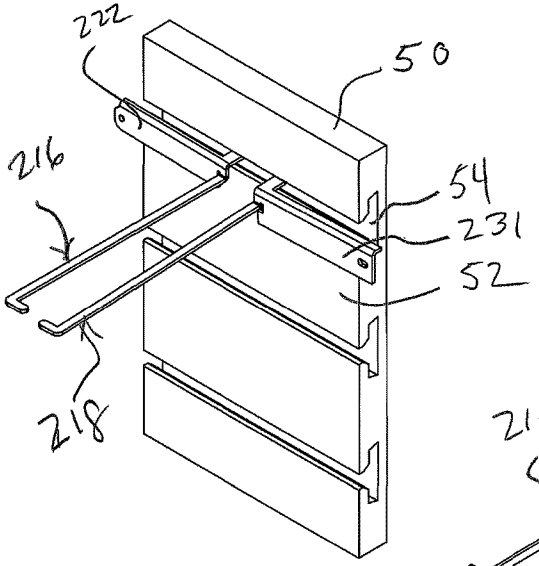
Figure 24D:
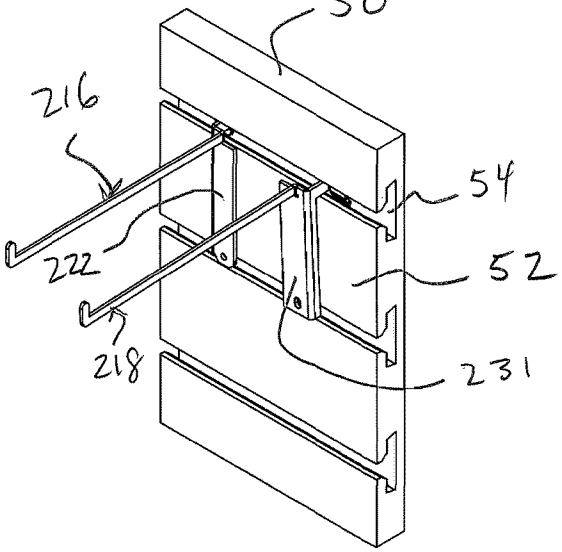
Figure 24E:
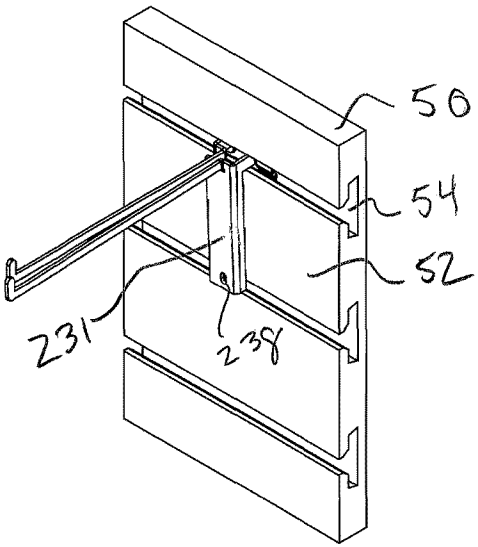
Figure 24F:
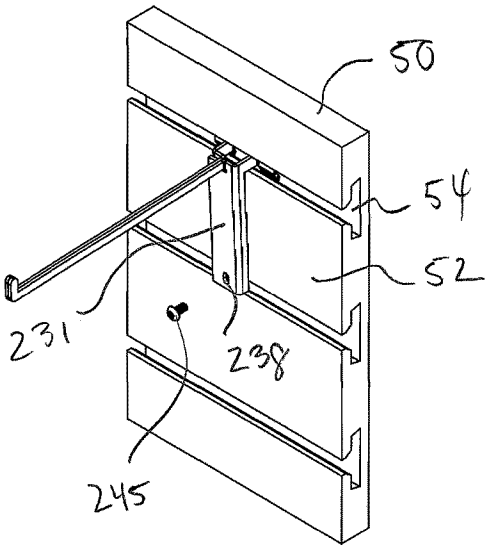
Figure 24G:
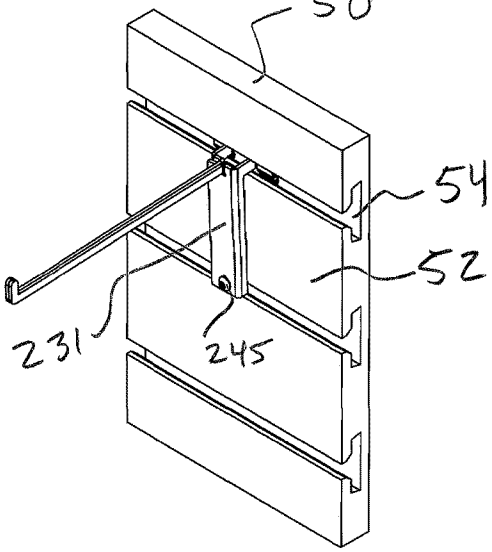

Referring to FIG. 24B, the hanger 200 may be coupled to a slatwall 50 by coupling each hanger member 216, 218 to the slatwall. The support members 222, 231 are aligned in parallel with a slot 54. The respective retaining members 228, 229, 233, 235 are then disposed in a slot 54. As shown in FIG. 24C, the first and second hanger members 216, 218 are brought together and then rotated so the support members 222, 231 are perpendicular to the slot 54, as shown in FIG. 24D. The first and second hangers members 216, 218 are brought in close contact such that support member 231 overlays support member 222, as shown in FIG. 24E. It is to be appreciated that in the position shown in FIG. 24E, apertures 225 and 238 align. Hanger 200 may then be secured to the slatgrid be disposing a fastener 245 through apertures 225 and 238, where the fastener may be coupled to a portion of the slatgrid, as shown in FIGS. 24F and 24G.

Figures 24H, 24I, 24J:
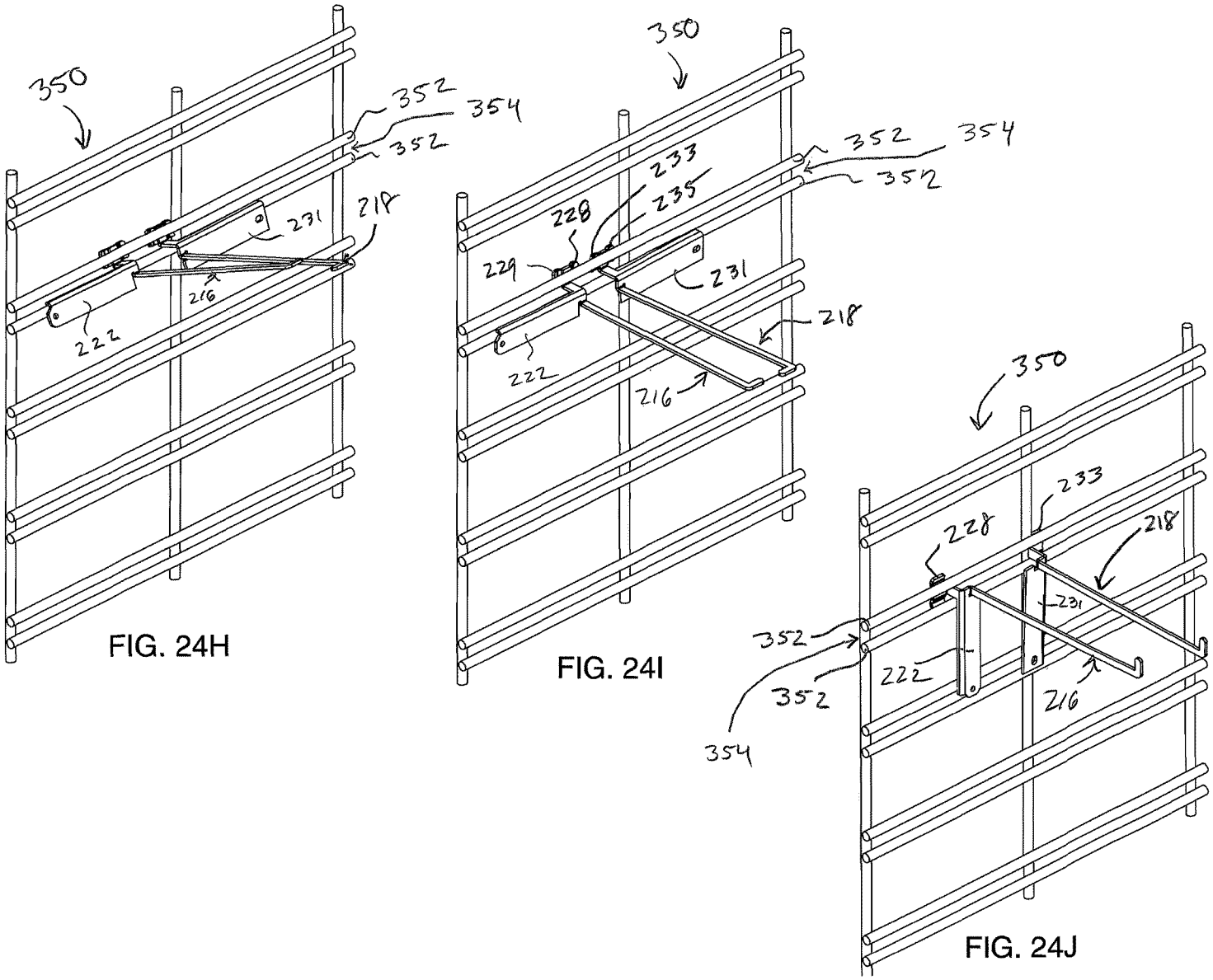
FIGS. 24H-M illustrate a method for securing the slatgrid hanger shown in FIG. 24A to a slatgrid in accordance with the present disclosure
Figures 24K, 24L, 24M:
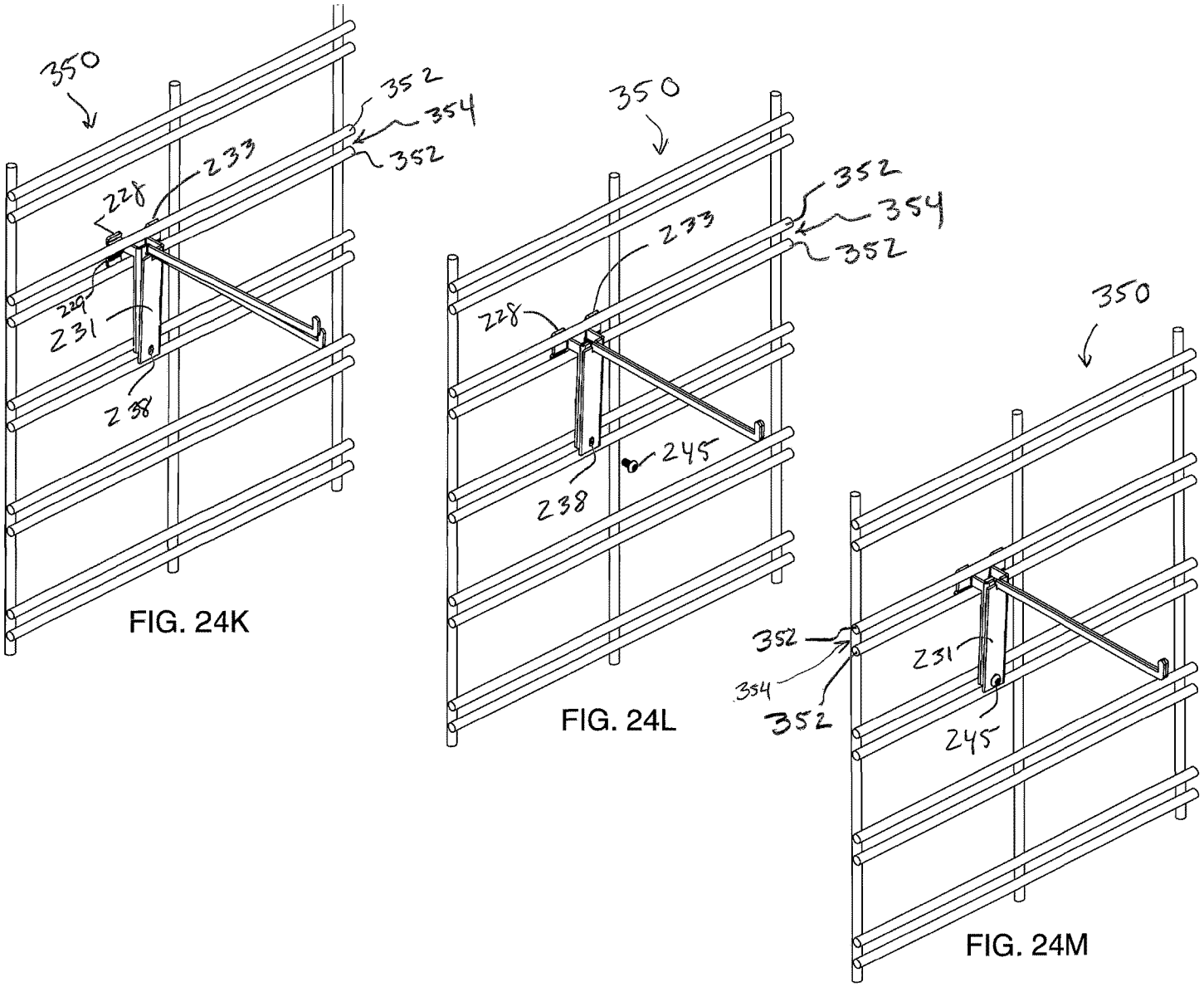
Figure 25:
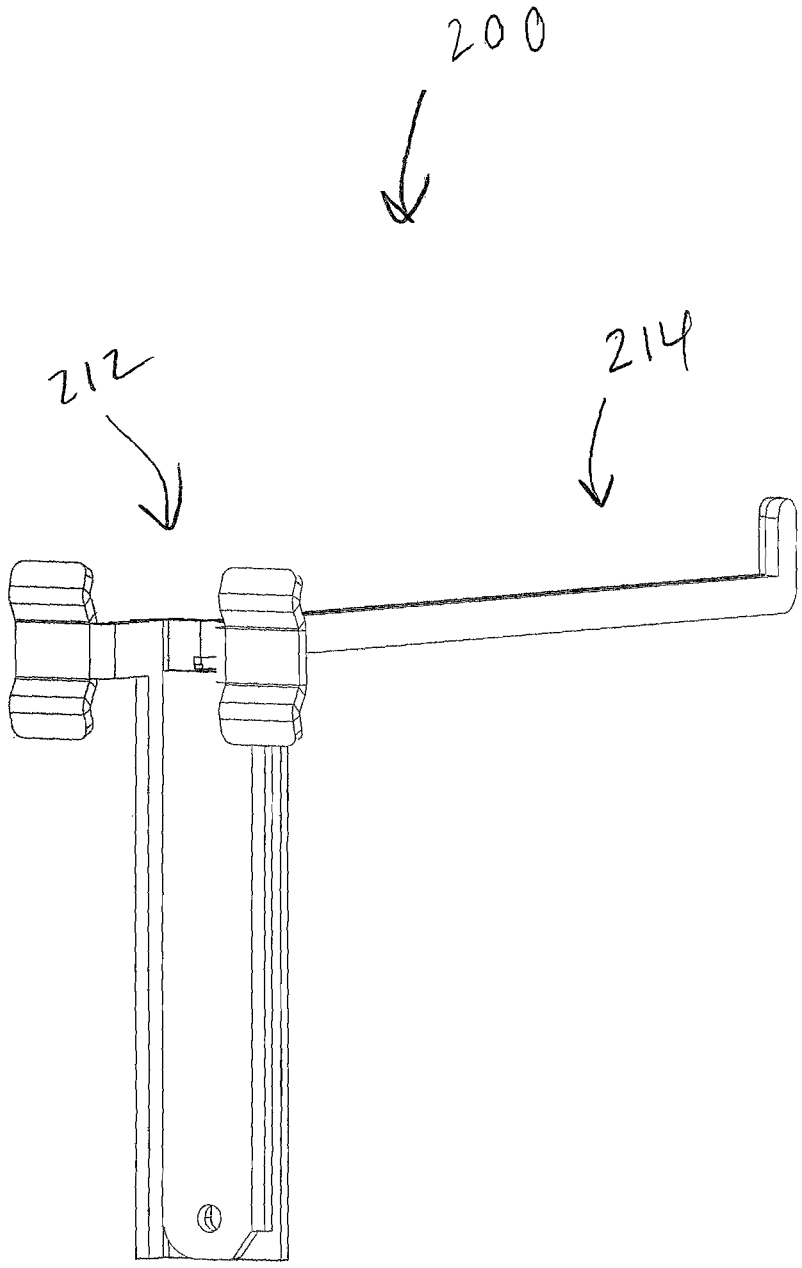
FIG. 25 is a rear perspective view of the hanger shown in FIG. 24A in accordance with the present disclosure.
Figure 26:
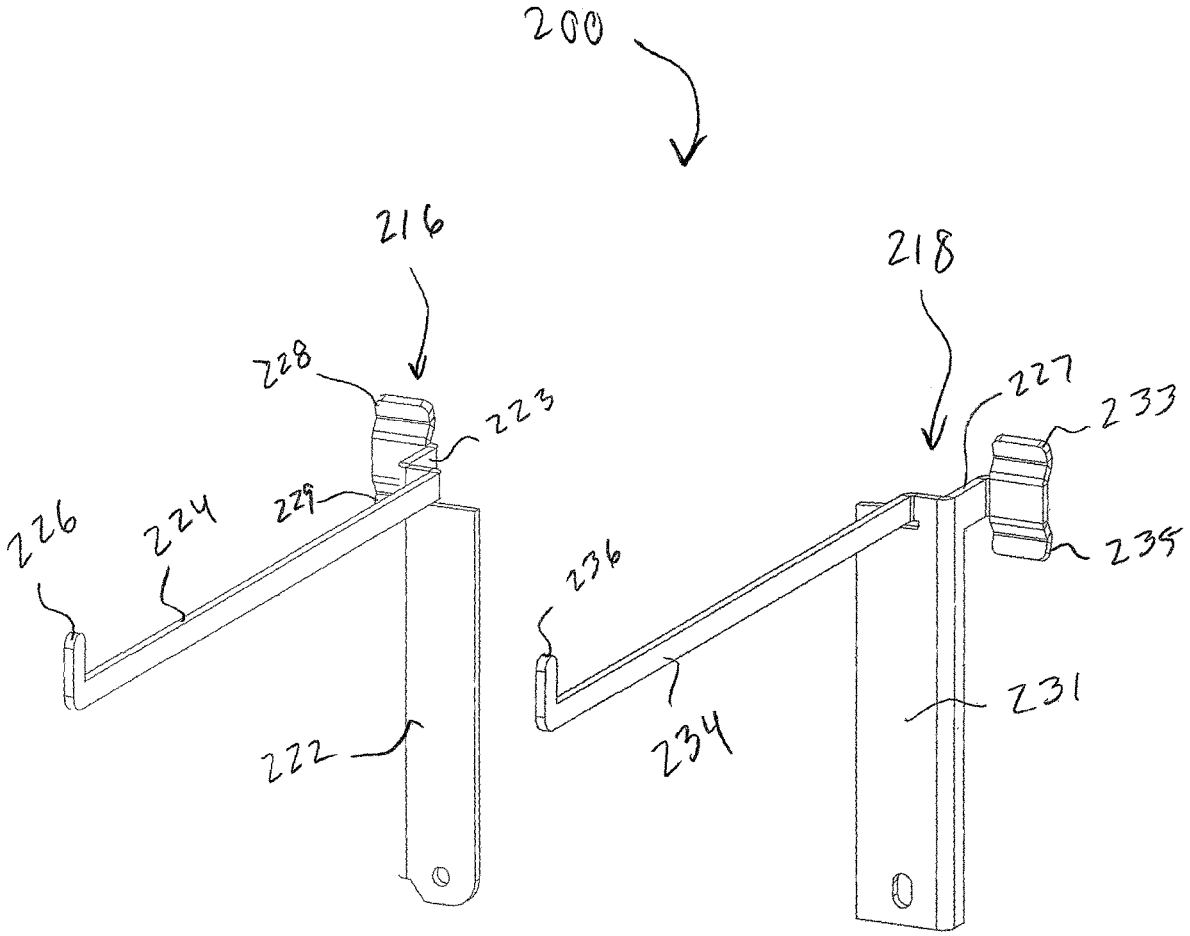
FIG. 26 is a right exploded perspective view of the hanger shown in FIG. 24A.

Referring to FIG. 24H, the hanger 200 may be coupled to a slatgrid 350 by coupling each hanger member 216, 218 to the slatgrid. The support members 222, 231 are aligned in parallel with a slot 354. The respective retaining members 228, 229, 233, 235 are then disposed in a slot 354. As shown in FIG. 24I, the first and second hanger members 216, 218 are brought together and then rotated so the support members 222, 231 are perpendicular to the slot 354, as shown in FIG. 24J. The first and second hangers members 216, 218 are brought in close contact such that support member 231 overlays support member 222, as shown in FIG. 24K. It is to be appreciated that in the position shown in FIG. 24K, apertures 225 and 238 align. Hanger 200 may then be secured to the slatgrid be disposing a fastener 245 through apertures 225 and 238, where the fastener may be coupled to a portion of the slatgrid, as shown in FIGS. 24L and 24M.

Referring to FIGS. 29-33, a hanger 300 in accordance with an embodiment of the present disclosure is provided. Hanger 300 includes a retaining portion 312 that retains the hanger 300 in a slot of a slatgrid and a hanging portion 314 that enable items of merchandise to be placed thereon and be displayed. Hanger 300 includes first hanger member 316 and second hanger member 318 which are rotatably coupled to one another via coupling member 320, e.g., a rivet.

First hanger member 316 includes a support member 322 configured to come into full contact with a rod-like member of a slatgrid. A first hanger leg 324 extends perpendicularly from the support member 322 via portion 323. The first hanger leg 324 includes a first extension member 326 which extends perpendicularly from the first hanger leg 324. An offset member 328 couples the support member 322 to a retaining member 330 configured to be disposed in between adjacent rod-like members of a slatgrid, the details of which will be described below. It is to be appreciated that the support member 322 is in a parallel relationship with retaining member 330 offset by the width of member 328.

The second hanger member 318 includes a first securing member 331. A second hanger leg 334 extends from the first securing member 331 and a second extension member 336 extends perpendicularly from the second hanger leg 334. The first securing member 331, second hanger leg 334 and second extension member 336 are substantially in the same parallel plane.

The first hanger member 316 is rotatably coupled to the second hanger member 318 via coupling member 320. The first hanger member 316 includes an aperture 325 disposed in portion 323 and second hanger member 318 includes aperture 338 disposed in first securing member 331. To assemble hanger 300, first hanger member 316 is brought into contact with second hanger member 318 so that aperture 325 of portion 323 aligns with aperture 338 of first securing member 331. Optionally, a spacer 340 is disposed between portion 323 and first securing member. When apertures 325, 338 are aligned, coupling member 320 is disposed through the apertures 325, 338 (and optionally through spacer 340). In this manner, first hanger member 316 is rotatably coupled to second hanger member 318 having a pivot point 321 (depicted by dashed line 321 in FIG. 30) where the apertures align. To prevent over rotation, first hanger member 316 includes a detent 342 and second hanger member 318 includes a catch 344. When rotated about pivot point 321, detent 342 will come into contact with catch 344 preventing further rotation. Additionally, the second extension member 336 includes a catch 337 which comes into contact with first extension member 326.

Figure 33:
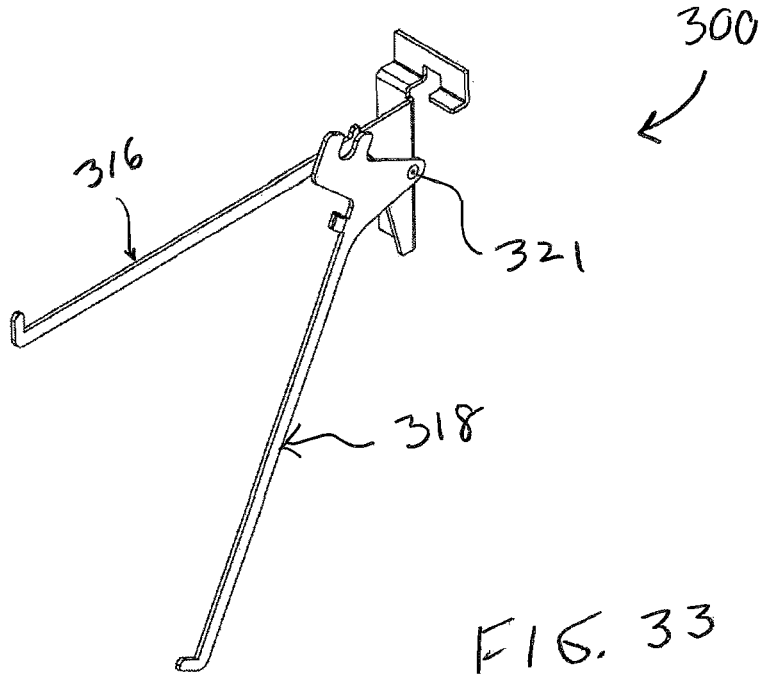
FIG. 33 is a view of the hanger shown in FIG. 29 in an open position in accordance with the present disclosure.
Figure 34:
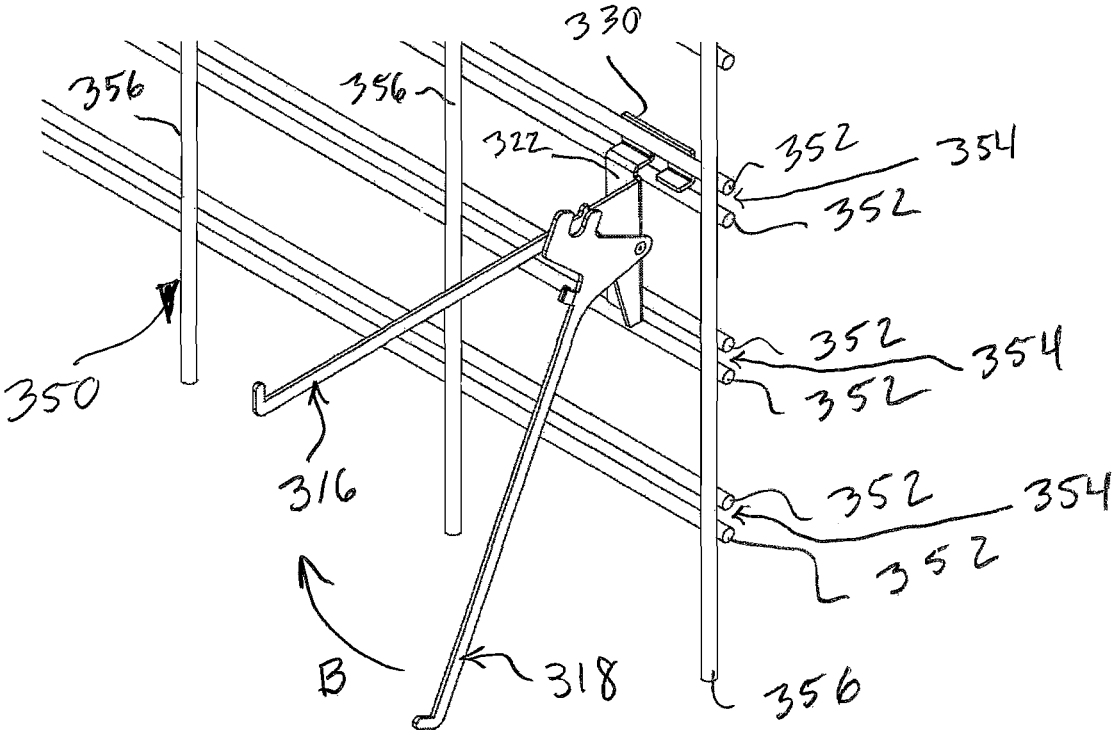
FIG. 34 is a perspective view of the hanger shown in FIG. 29 in the open position being applied to a slatgrid in accordance with the present disclosure.

Referring to FIG. 33, hanger 300 is illustrated in an open position. First hanger member 316 is rotated relative to second hanger member 318 about pivot point 321. FIG. 34 illustrates hanger 300 coupled to slatgrid 350 in an open position. Slatgird 350 includes a number of horizontal rod-like members 352 joined together by vertical rod-like members 356. Adjacent rod-like members 352 are spaced apart a given distance to form a number of uniform, horizontal slots 354. Retaining member 330 is disposed in an appropriate slot 354 of slatgrid 350 and first hanger member 316 is rotated toward slatgrid 350 until support member 322 comes into contact with rod-like members 352. Second hanger member 318 is then rotated about pivot point 221, in the direction of arrow B shown in FIG. 34, until the first hanger leg 324 is aligned with second hanger leg 334.

Figure 35:
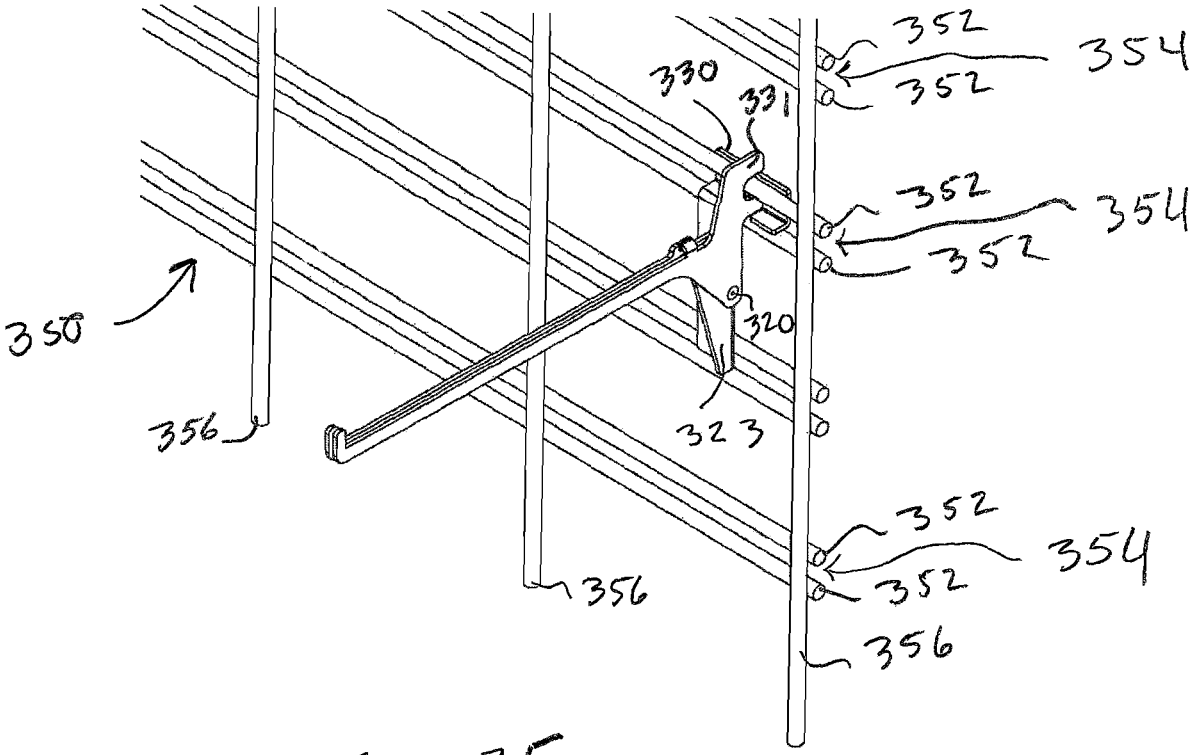
FIG. 35 is a left perspective view of the hanger shown in FIG. 29 mounted to a slatgrid in accordance with the present disclosure.
Figure 36:
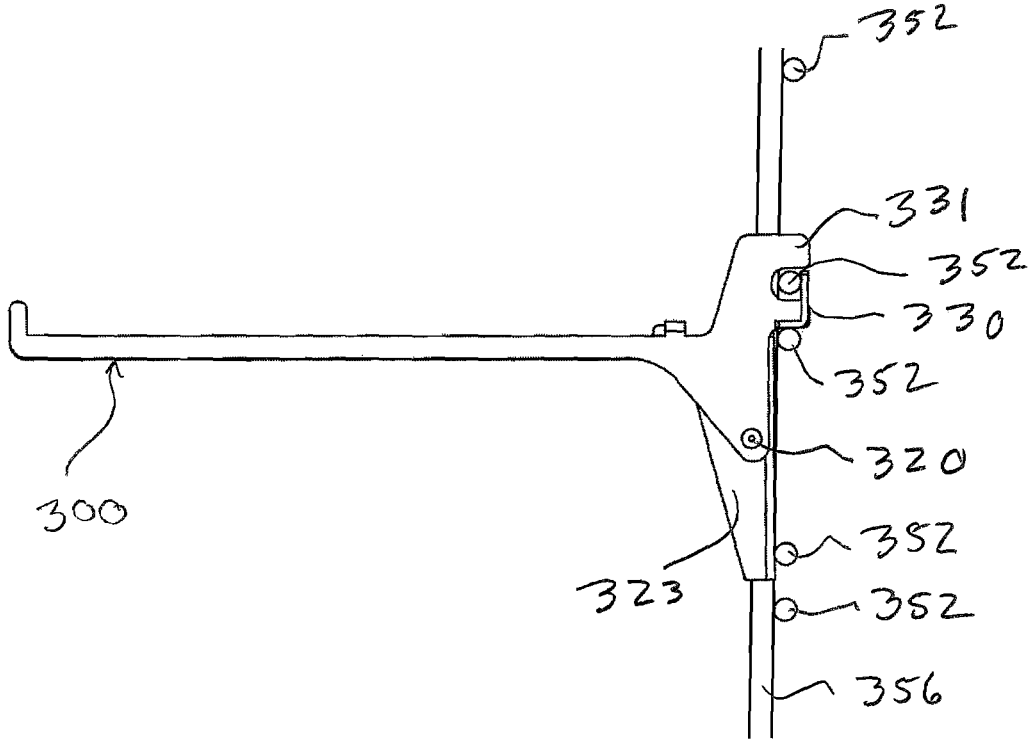
FIG. 36 is a side of the hanger shown in FIG. 29 in a closed position applied to a slatwall.

FIGS. 35 and 36 illustrate the hanger 300 coupled to the slatgrid 350 in a closed position. In the closed position, the retaining member 330 comes into contact with the rod-like member 352 above the slot 354 where the retaining member 330 is disposed. Additionally, first securing member 331 includes a semi-circular recess that comes into contact with the same rod-like member 352 of slot 354. In this manner, hanger 300 is securely disposed in slot 54.

Referring to FIGS. 37A-37F, a hanger 400 in accordance with a fifth embodiment of the present disclosure is provided. Hanger 400 is configured to be coupled to a generally rectangular bar or rail 450. Hanger 400 includes a retaining portion 412 that retains the hanger 400 on a rail or bar 450 and a hanging portion 214 that enable items of merchandise to be placed thereon and be displayed. Hanger 400 includes first hanger member 416 and second hanger member 418 which are rotatably coupled to one another via coupling member 420, e.g., a rivet. Optionally, a spacer 440 is provided between the first and second member 416, 418 with the coupling member 420 disposed therein.

First hanger member 416 includes a support member 422 configured to come into full contact with the rail or bar 450. A first hanger leg 424 extends perpendicularly from the support member 422. The first hanger leg 424 includes a first extension member 426 which extends perpendicularly from the first hanger leg 424. An offset member 428 couples the support member 422 to a retaining member 430 configured to be disposed against a rear surface of the rail or bar 450.

The second hanger member 418 includes a first securing member 431. A second hanger leg 434 extends from the first securing member 431 and a second extension member 436 extends perpendicularly from the second hanger leg 434. The first hanger member 416 is rotatably coupled to the second hanger member 418 via coupling member 420.

Figure 37B:
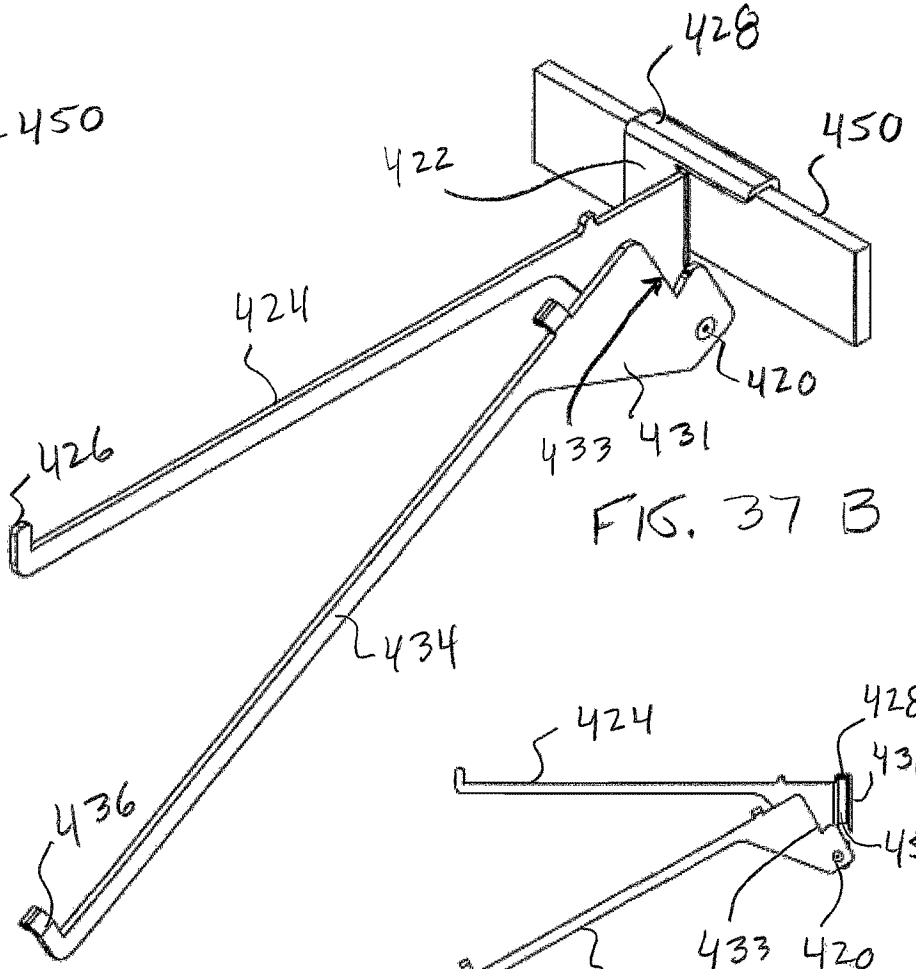
FIGS. 37A-37D illustrate a hanger in accordance with a fifth embodiment of the present disclosure.
Figure 37C:
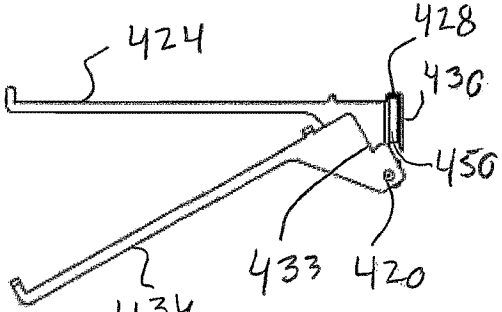
Figure 37D:
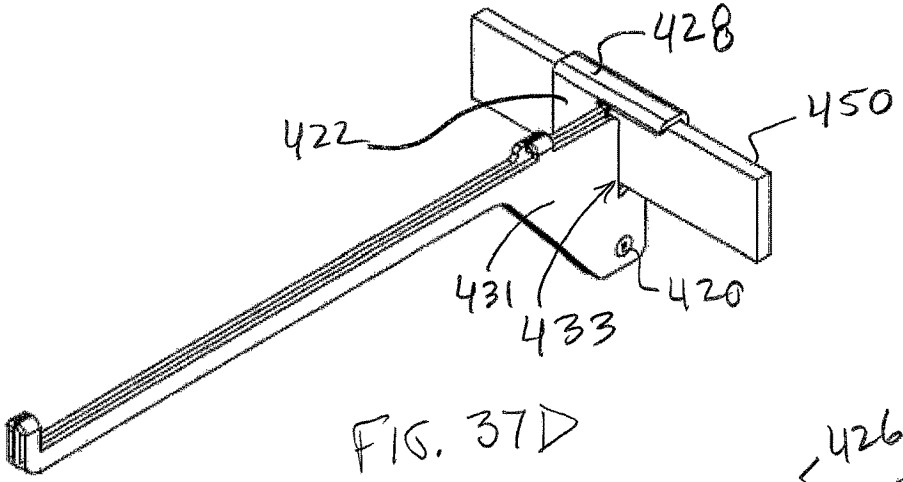
Figure 37A:
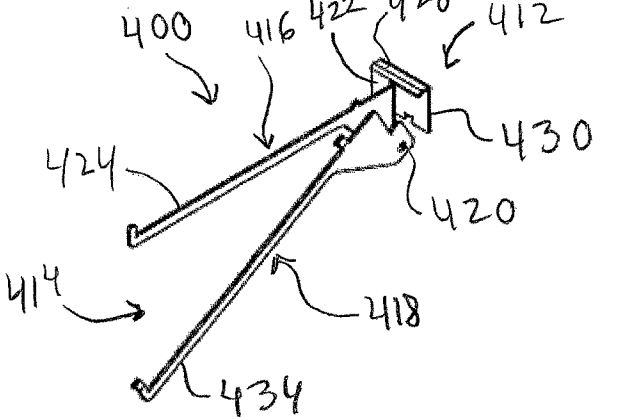
Figure 37E:
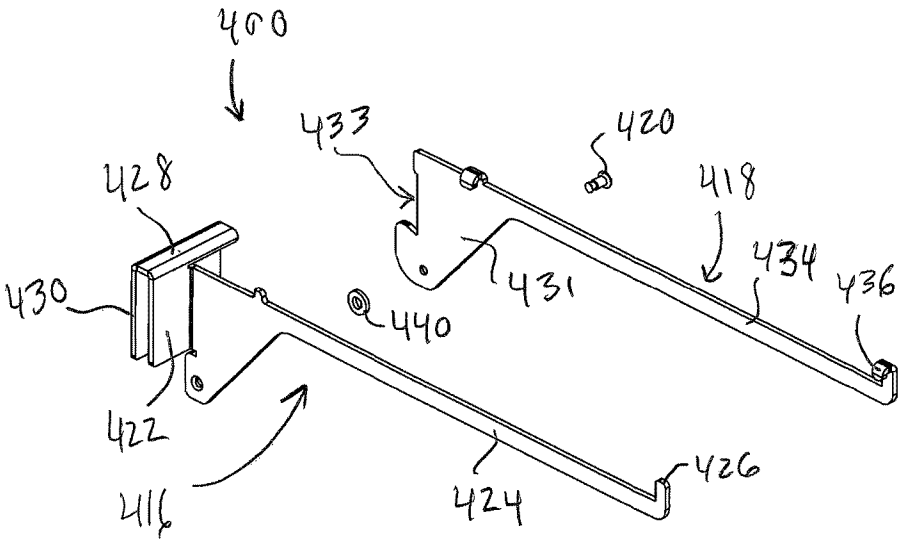
FIG. 37E is a left exploded perspective view of the hanger shown in FIG. 37D.
Figure 37F:
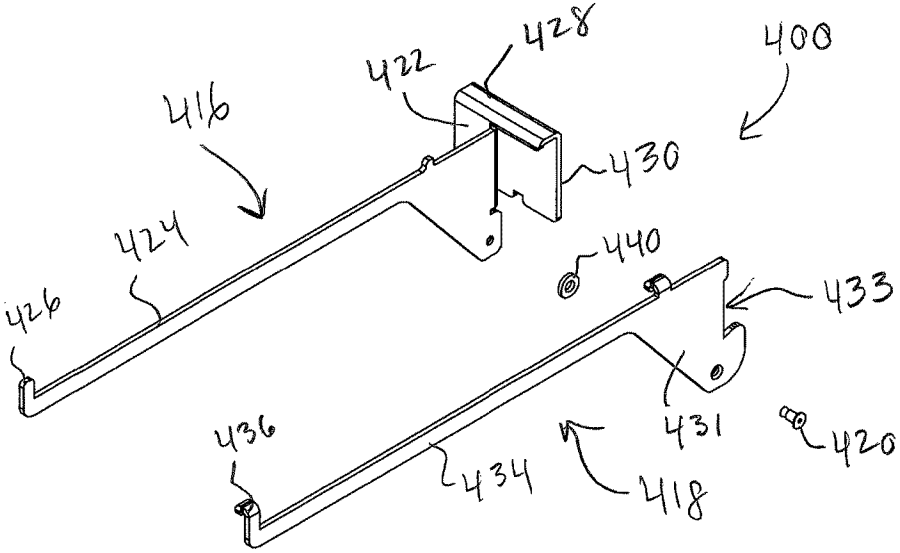
FIG. 37F is a right exploded perspective view of the hanger shown in FIG. 37D.

In use, the support member 422, offset member 428 and retaining member 430 are disposed over the rail or bar 450, as shown in FIGS. 37B-C. The second hanger member 418 is then rotated to align with the first hanger member 416. When the first and second hanger members 416, 418 are aligned, the right angle cut out portion 433 comes into contact with a lower portion of rail or bar 450 securing the hanger 400 in place, that is, the rail or bar 450 is secured between the retaining member 430 and the right angle cut out portion 433, as shown in FIG. 37D.

Figure 38B:
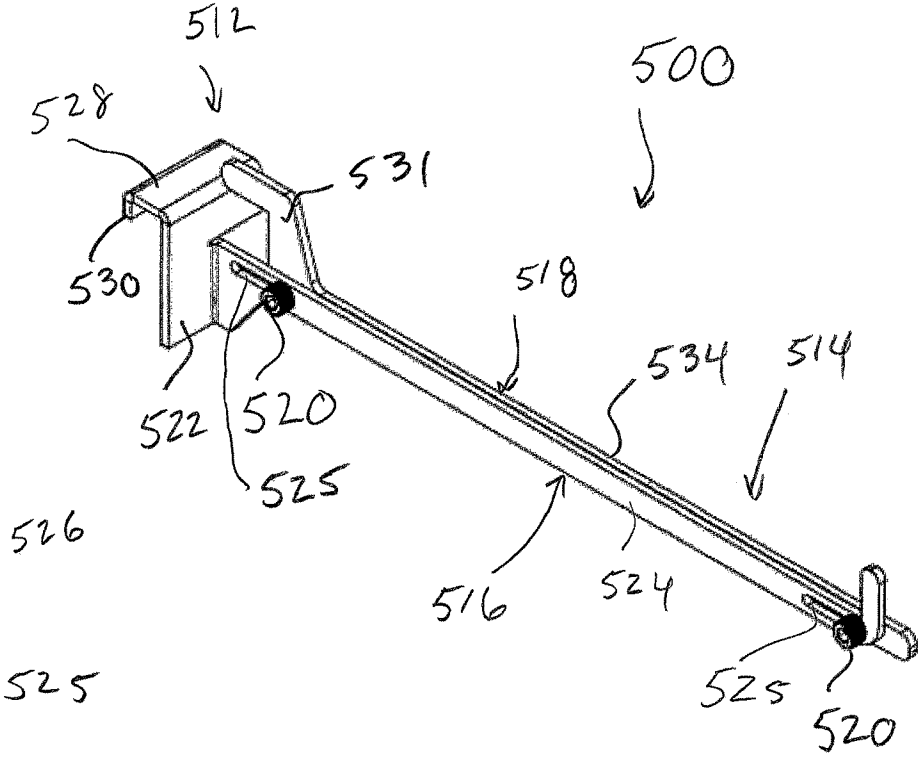
FIGS. 38A and 38B illustrate a hanger in accordance with a sixth embodiment of the present disclosure.
Figure 38A:
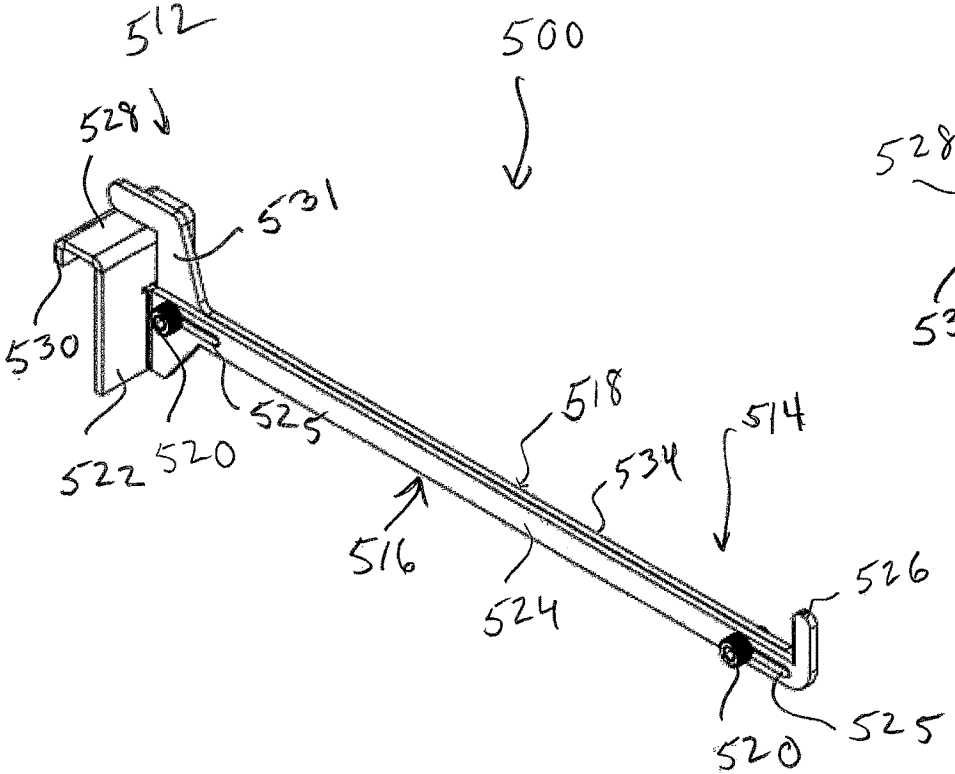
Figure 38C:
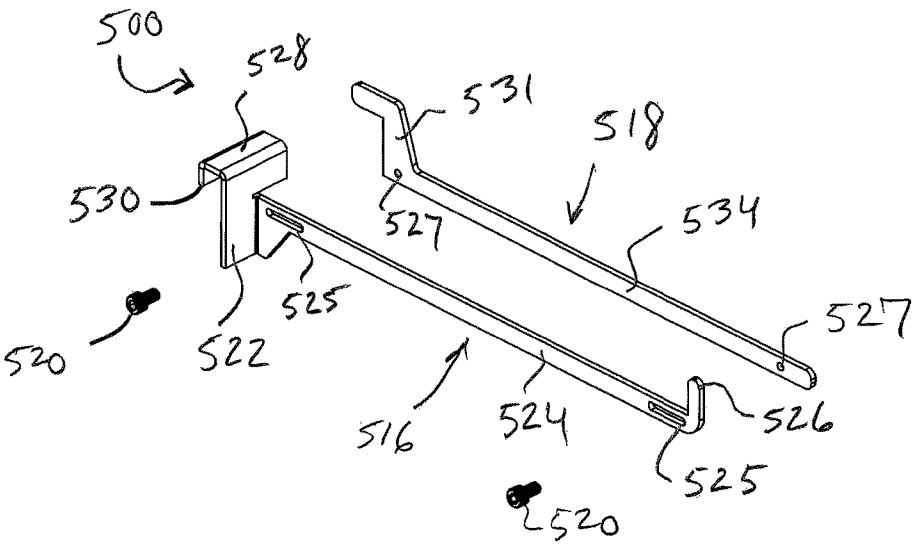
FIG. 38C is a left exploded perspective view of the hanger shown in FIG. 38A.
Figure 38D:
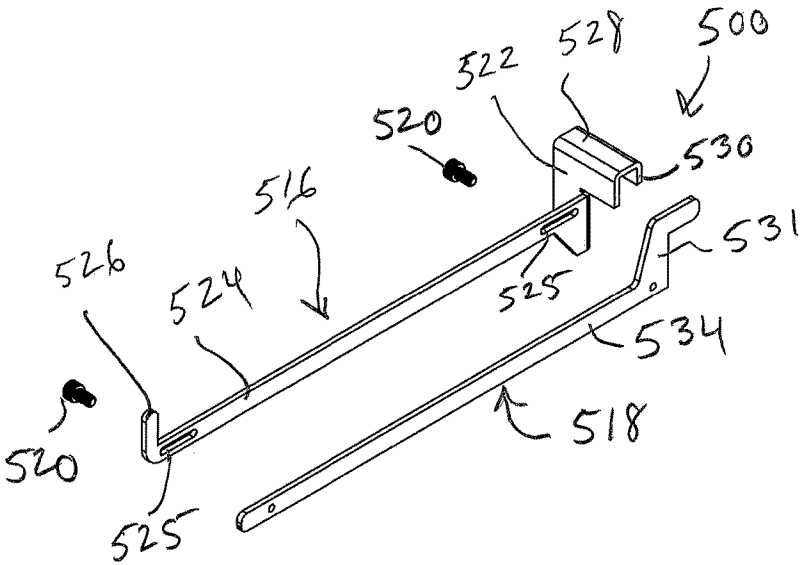
FIG. 38D is a right exploded perspective view of the hanger shown in FIG. 38A.

Referring to FIGS. 38A and 38B, a hanger 500 in accordance with a sixth embodiment of the present disclosure is provided. FIG. 38C is a left exploded perspective view of the hanger 500 and FIG. 38D is a right exploded perspective view of the hanger 500. Hanger 500 includes a retaining portion 512 that retains the hanger 500 in a slot of a slatwall and a hanging portion 514 that enable items of merchandise to be placed thereon and be displayed. Hanger 500 includes first hanger member 516 and second hanger member 518 which are slidingly coupled to one another via coupling members 520, e.g., a rivet, screw, etc.

First hanger member 516 includes a support member 522 configured to come into full contact with a slat of a slatwall. A first hanger leg 524 extends perpendicularly from the support member 522. The first hanger leg 524 includes a first extension member 526 which extends perpendicularly from the first hanger leg 524. An offset member 528 couples the support member 522 to a retaining member 530 configured to be disposed in a slot of a slatwall, where the offset member 528 comes to rest on an edge of a lower slat of the slot. The second hanger member 518 includes a first securing member 531. A second hanger leg 534 extends from the first securing member 531.

The first hanger member 516 is slidingly coupled to the second hanger member 518 via coupling members 520. The first hanger member 516 includes slots 525 disposed in first hanger leg 524 and second hanger member 318 includes apertures 527 in the second hanger leg 534.

Figure 38F:
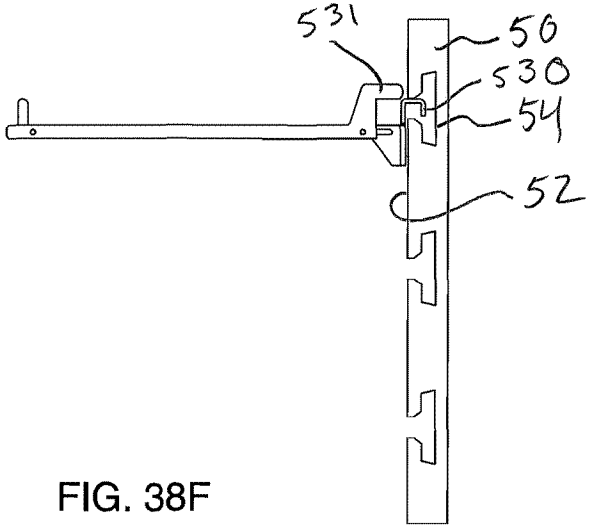
FIGS. 38E-38I illustrate a method for securing the slatgrid hanger shown in FIG. 38A to a slatwall in accordance with the present disclosure.
Figure 38E:
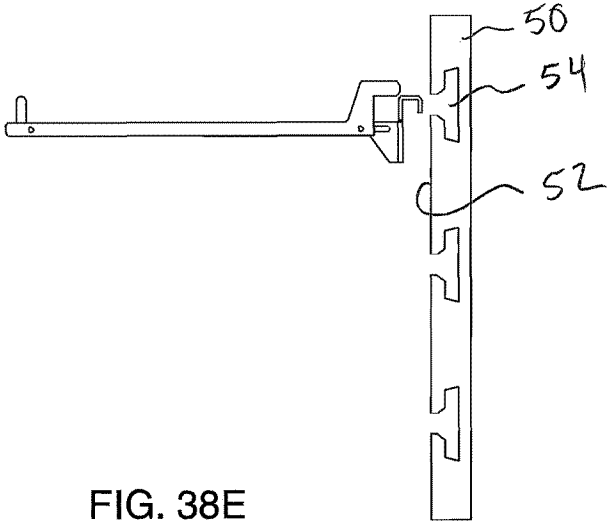
Figure 38I:
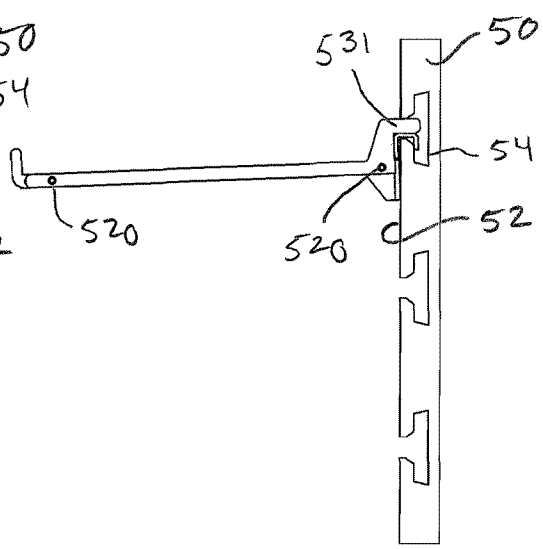
Figure 38H:
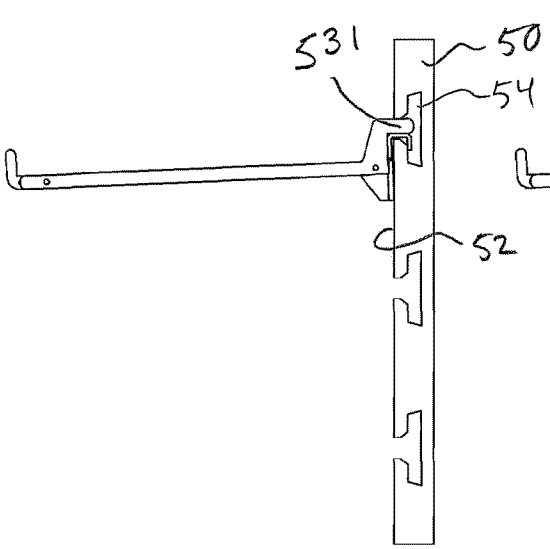
Figure 38G:
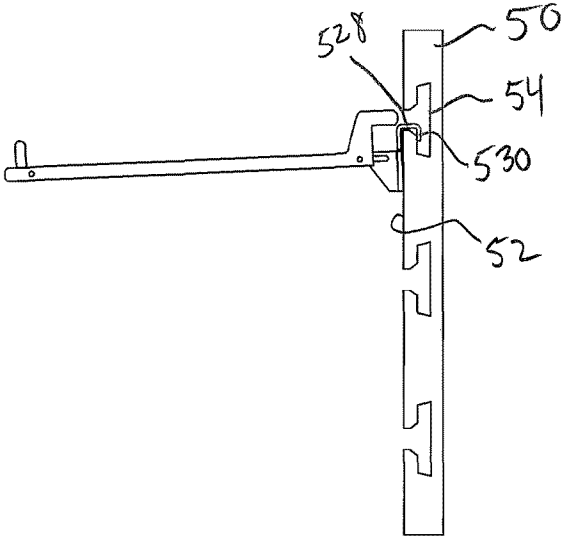

To assemble hanger 500, first hanger member 516 is brought into contact with second hanger member 518 so that slots 525 of the first hanger leg 524 aligns with apertures 527 of second hanger leg 534. When slots 525 and apertures 527 are aligned, coupling members 520 (e.g., a screw, rivet, pin, etc.) are disposed through the slots 525 to apertures 527 and first hanger leg 524 is in a parallel relationship to second hanger leg 534, as shown in FIG. 38E. In this manner, first hanger member 516 is slidingly coupled to second hanger member 518. In use, the retaining member 530 is disposed in a slot of a slatwall, as shown in FIG. 38F, such that offset member 528 comes to rest on an upper edge of a lower slat, as shown in FIG. 38G. Second hanger member 518 is then slid toward the slatwall and the retaining member 531 of the second hanger member 518 enters the slot, shown in FIG. 38H. The coupling member 520 may then be secured, e.g., by tightening, to secure the hanger 500 to the slatwall, as shown in FIG. 38I.

Figure 39B:
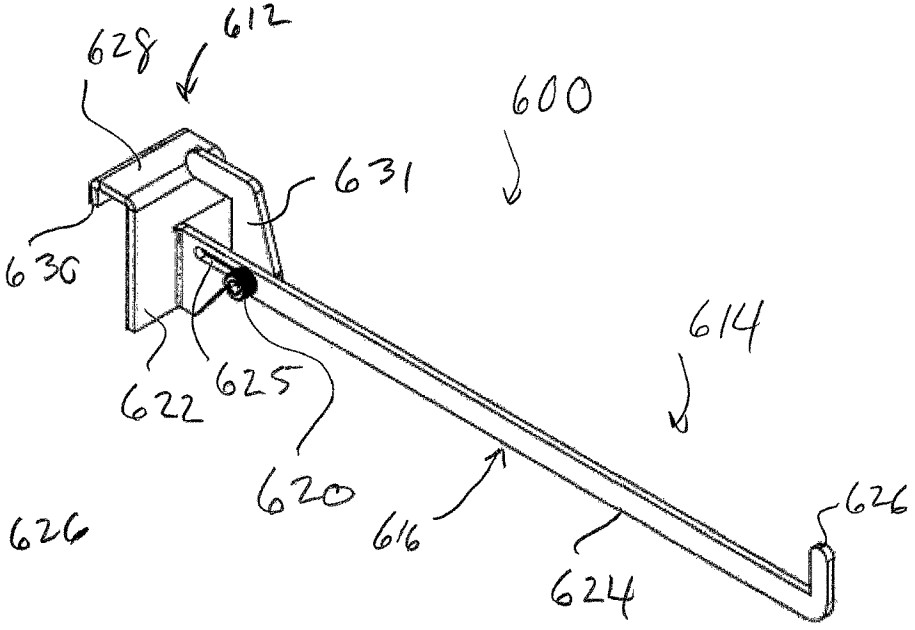
FIGS. 39A and 39B illustrate a hanger in accordance with a seventh embodiment of the present disclosure.
Figure 39A:
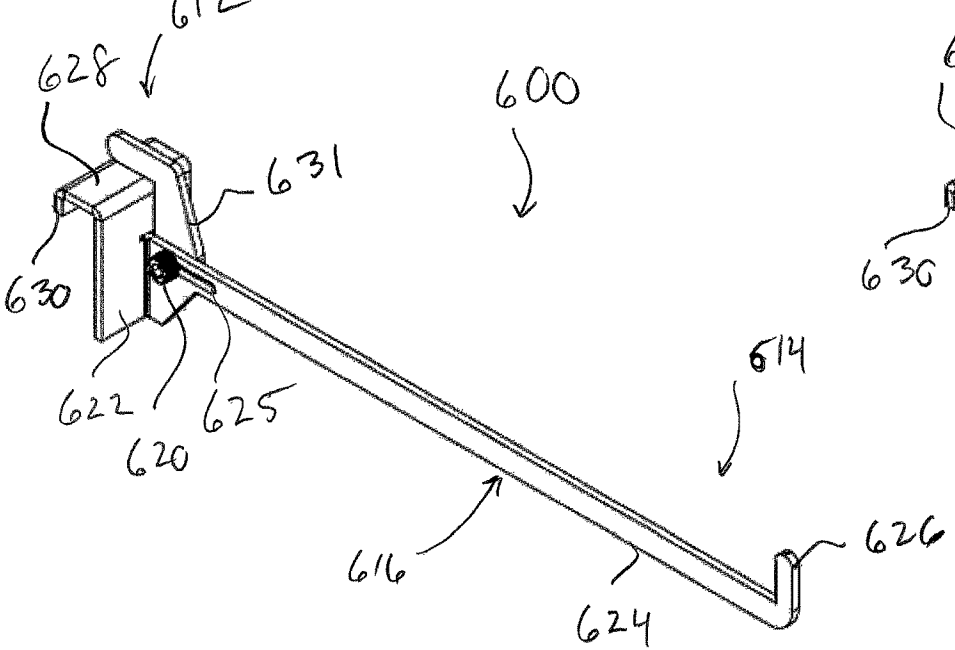
Figure 39C:
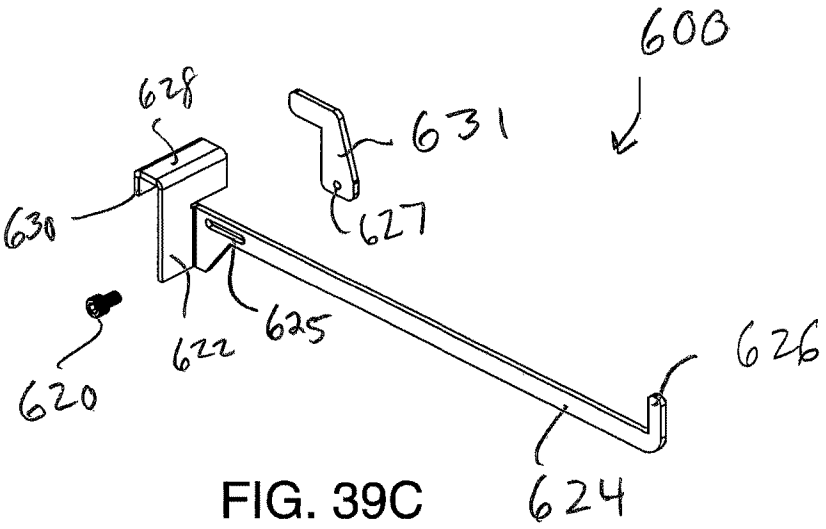
FIG. 39C is a left exploded perspective view of the hanger shown in FIG. 39A.
Figure 39D:
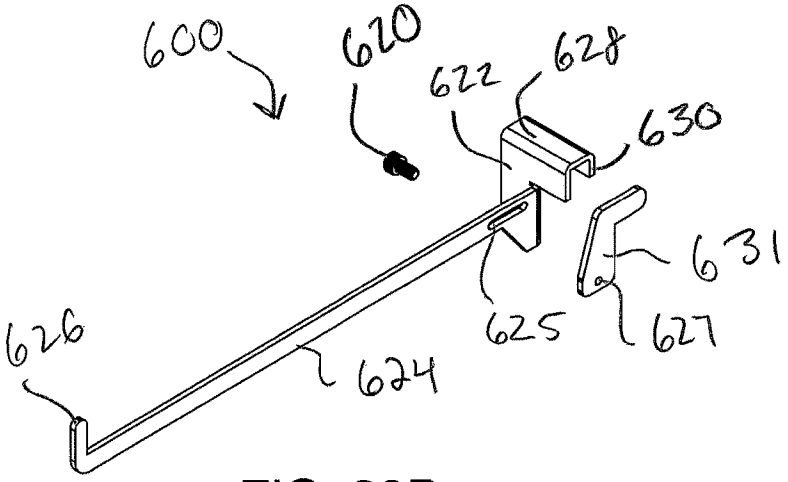
FIG. 39D is a right exploded perspective view of the hanger shown in FIG. 39A.

Referring to FIGS. 39A and 39B, a hanger 600 in accordance with a seventh embodiment of the present disclosure is provided. FIG. 39C is a left exploded perspective view of the hanger 600 and FIG. 39D is a right exploded perspective view of the hanger 600. Hanger 600 is configured in a similar manner to hanger 500. Hanger 600 includes a retaining portion 612 that retains the hanger 600 in a slot of a slatwall and a hanging portion 614 that enable items of merchandise to be placed thereon and be displayed. Hanger 600 includes first hanger member 616 and a securing member 631 which are slidingly coupled to one another via a coupling member 620, e.g., a rivet, screw, etc.

First hanger member 616 includes a support member 622 configured to come into full contact with a slat of a slatwall. A first hanger leg 624 extends perpendicularly from the support member 622. The first hanger leg 624 includes a first extension member 626 which extends perpendicularly from the first hanger leg 624. An offset member 628 couples the support member 622 to a retaining member 630 configured to be disposed in a slot of a slatwall, where the offset member 628 comes to rest on an upper edge of a lower slat.

Figure 39F:
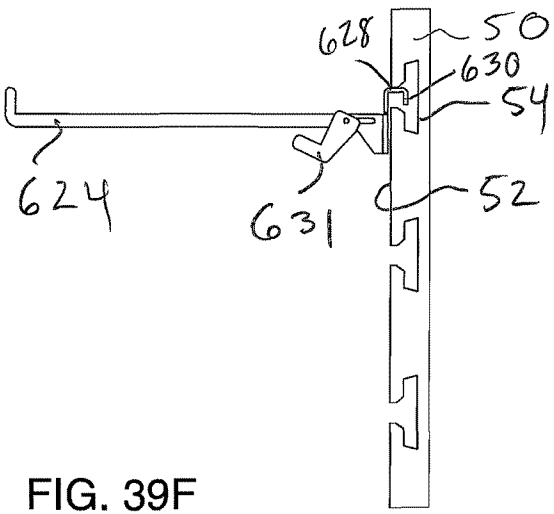
FIGS. 39E-39I illustrate a method for securing the slatgrid hanger shown in FIG. 39A to a slatwall in accordance with the present disclosure.
Figure 39E:
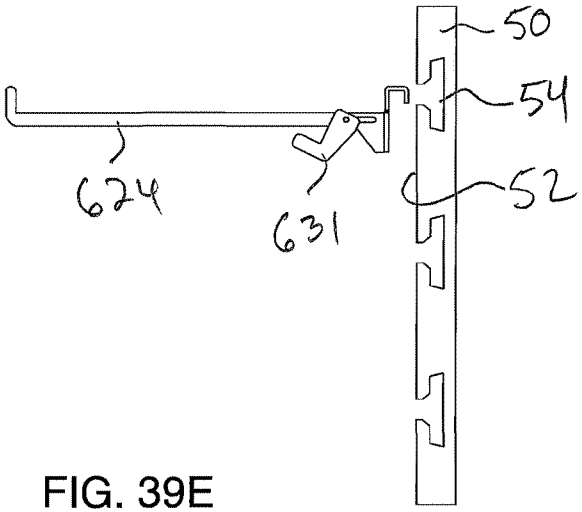
Figure 39I:
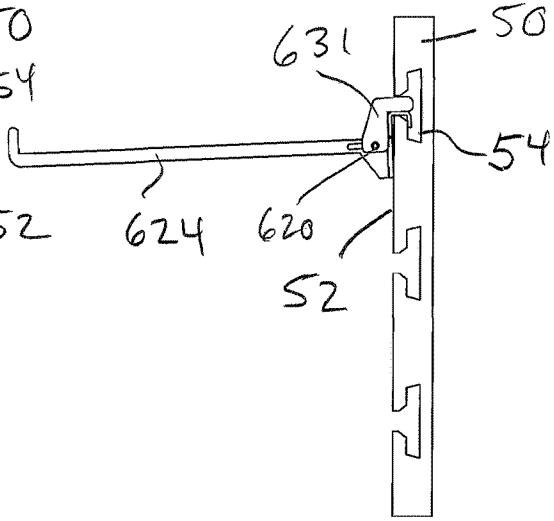
Figure 39H:
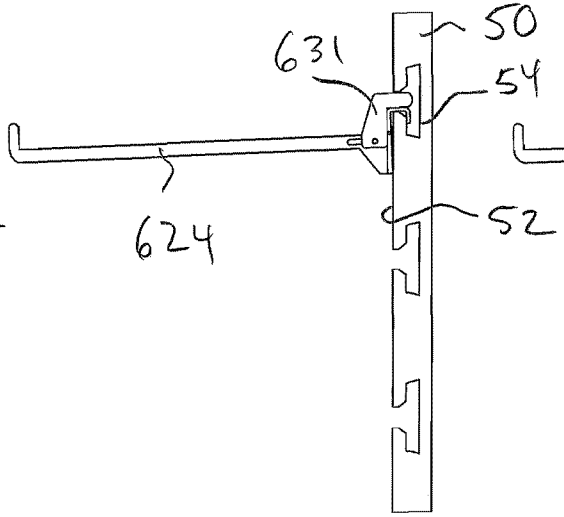
Figure 39G:
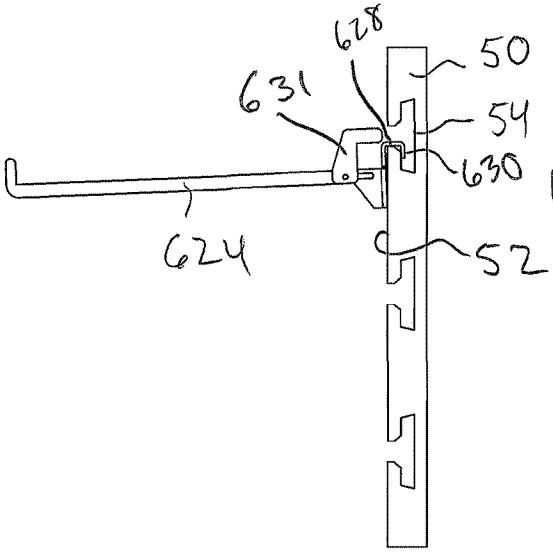

The first hanger member 616 is slidingly coupled to the securing member 631 via coupling member 620. The first hanger member 616 includes slot 625 disposed in first hanger leg 624 and securing member 631 includes an aperture 627. To assemble hanger 600, first hanger member 616 is brought into contact with securing member 631 so that slot 625 of the first hanger leg 624 aligns with aperture 627 of securing member 631, as shown in FIG. 39E. When slot 625 and aperture 627 are aligned, coupling member 620 (e.g., a screw, rivet, pin, etc.) is disposed through the slot 625 to aperture 627. In this manner, first hanger member 516 is slidingly coupled to securing member 631. In use, the retaining member 630 is disposed in a slot of a slatwall, as shown in FIG. 39F, such that offset member 628 comes to rest on an edge of a lower slat, as shown in FIG. 39G. The securing member 631 is then slid or rotated toward the slatwall and the retaining member 631 enters the slot, as shown in FIG. 39H. The coupling member 625 may then be secured, e.g., by tightening, to secure the hanger 600 to the slatwall, as shown in FIG. 39I. It is to be appreciate that hanger 600 is configured in a similar manner to hanger 500; however, hanger 600 does not include a second hanger leg.

Figure 40B:
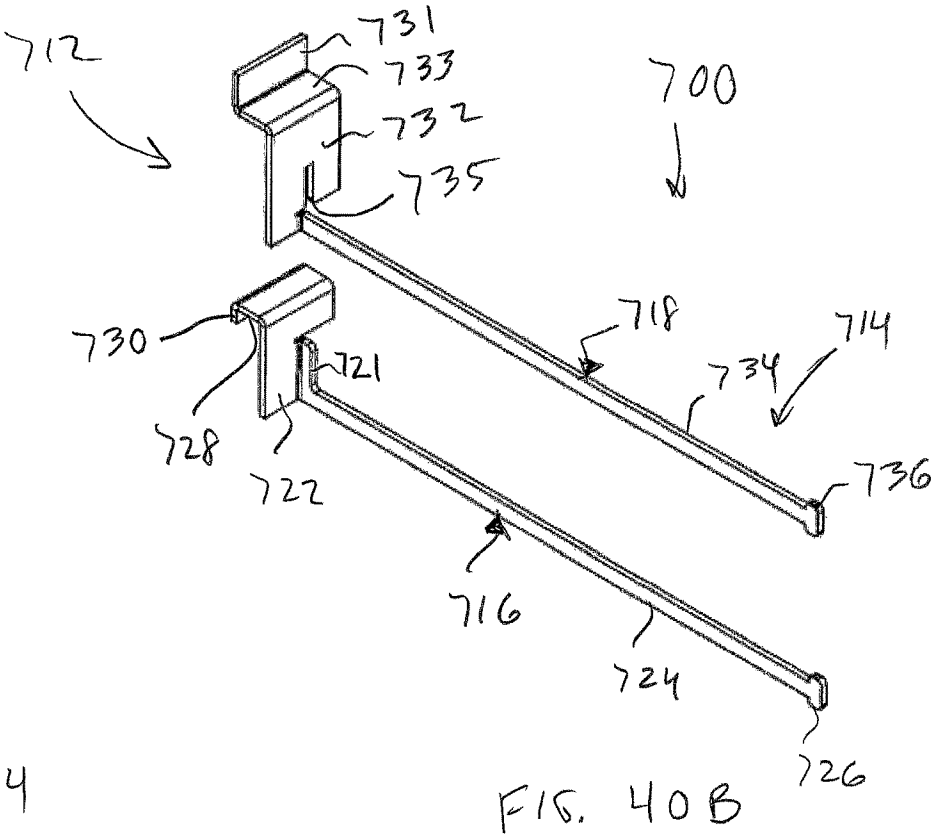
FIG. 40B is a left exploded perspective view of the hanger shown in FIG. 40A.
Figure 40A:
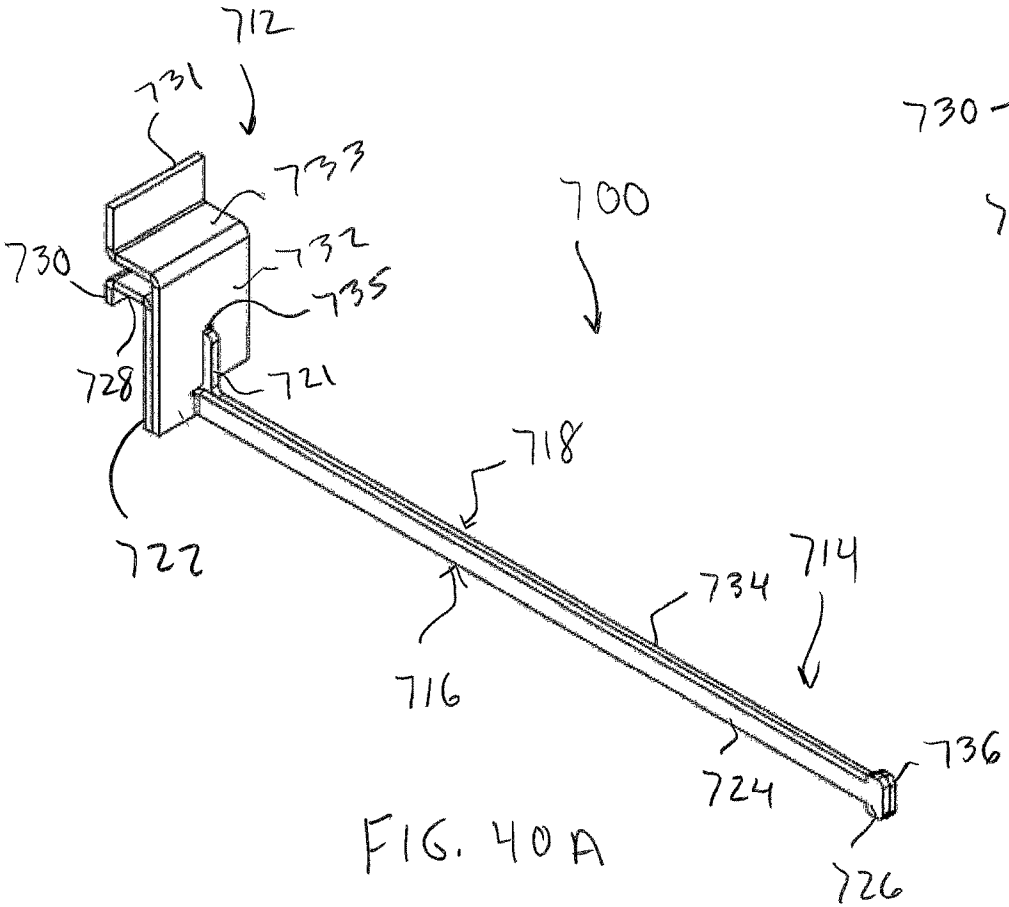
FIG. 40A illustrates a hanger in accordance with an eighth embodiment of the present disclosure.
Figure 40C:
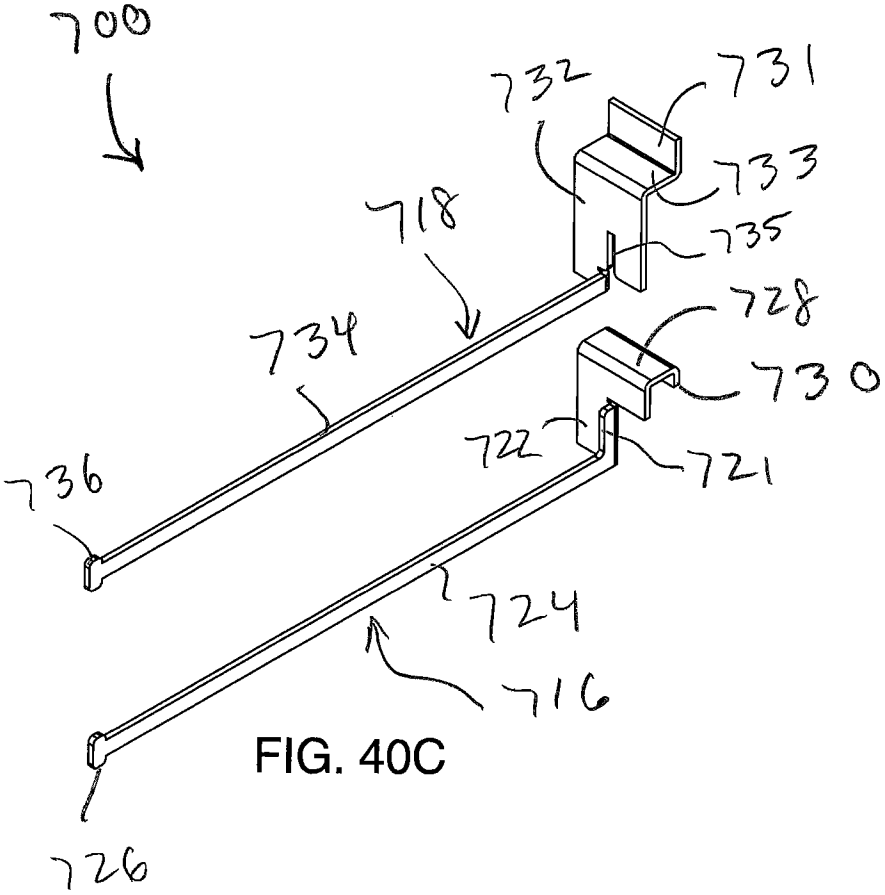
FIG. 40C is a right exploded perspective view of the hanger shown in FIG. 40A.

Referring to FIG. 40A, a hanger 700 in accordance with an eighth embodiment of the present disclosure is provided, where FIG. 40B is a left exploded perspective view of the hanger 700 and FIG. 40C is a right exploded perspective view of the hanger 700. Hanger 700 includes a retaining portion 712 that retains the hanger 700 in a slot of a slatwall and a hanging portion 714 that enable items of merchandise to be placed thereon and be displayed. Hanger 700 includes first hanger member 716 and a second hanger member 718 which are slidingly coupled to one another.

Figure 40D:
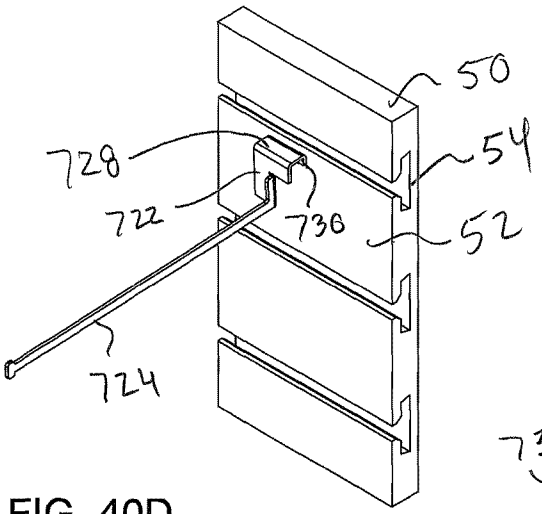
FIGS. 40D-40F illustrate a method for securing the slatgrid hanger shown in FIG. 40A to a slatwall in accordance with the present disclosure.
Figure 40E:
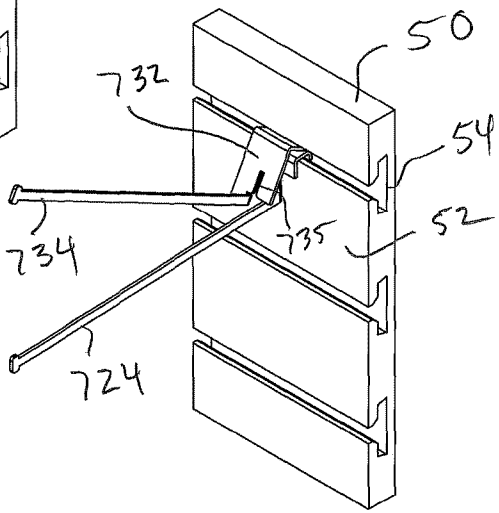

First hanger member 716 includes a support member 722 configured to come into full contact with a slat of a slatwall. A first hanger leg 724 extends perpendicularly from the support member 722. The first hanger leg 724 includes projection 721 and a first extension member 726 which extends perpendicularly from an end of the first hanger leg 724. An offset member 728 couples the support member 722 to a retaining member 730 configured to be disposed in a slot of a slatwall, as shown in FIG. 40D, where the offset member 728 comes to rest on an upper edge of a lower slat, as shown in FIG. 40E.

Figure 40F:
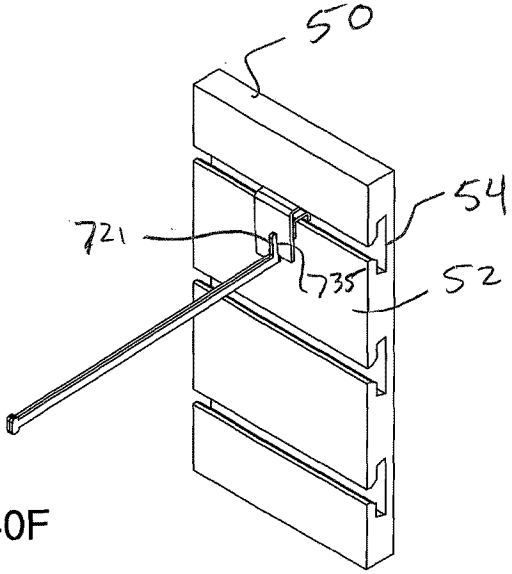

Second hanger member 716 includes a support member 732 having a slot 735, an offset member 733 and a securing member 731 configured to be disposed in a slot of a slatwall. A second hanger leg 734 extends perpendicularly from the support member 732. The second hanger leg 734 includes a second extension member 736 which extends perpendicularly from an end of the second hanger leg 734. The offset member 733 couples the support member 732 to a retaining member 731 configured to be disposed in a slot of a slatwall. In use, the retaining member 730 is disposed in a slot of a slatwall such that offset member 728 comes to rest on an upper edge of a lower slat. The securing member 731 is then disposed in the same slot toward an upper slat, as shown in FIG. 40E. The second hanger leg 734 is then brought into alignment with the first hanger leg 724, where projection 721 enters slot 735, as shown in FIG. 40F. It is to be appreciated that retaining member 730 and securing member 731 are disposed in the same slot of a slatwall but in opposite directions to secure the hanger in the slot.

Figure 41B:
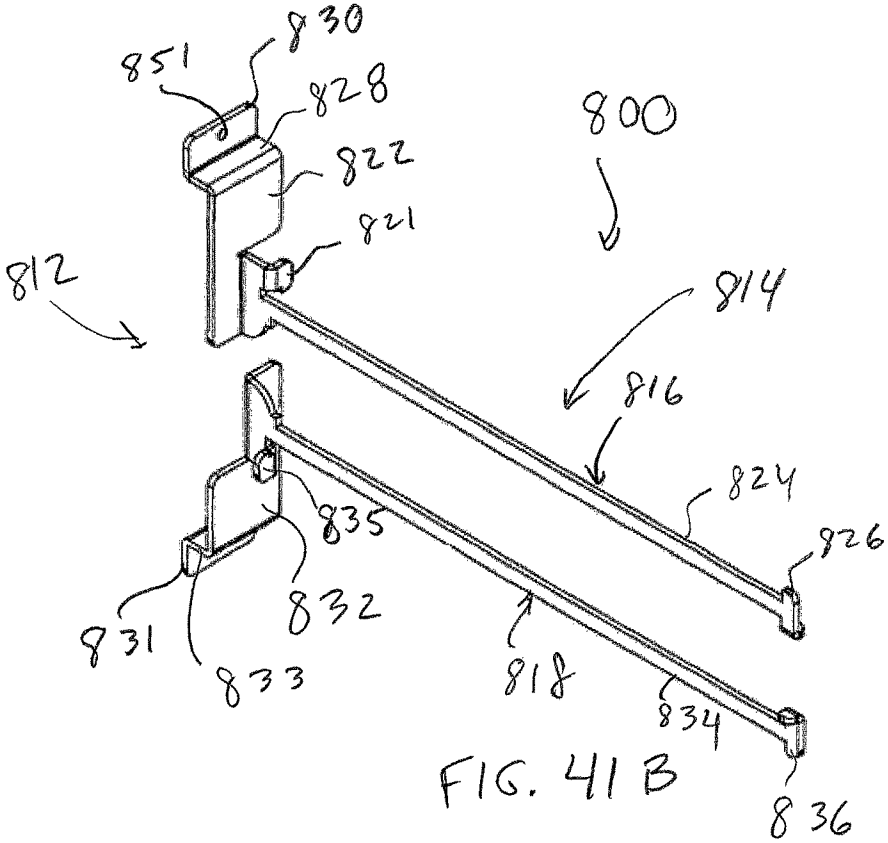
FIGS. 41A and 41B illustrate a hanger in accordance with a ninth embodiment of the present disclosure.
Figure 41A:
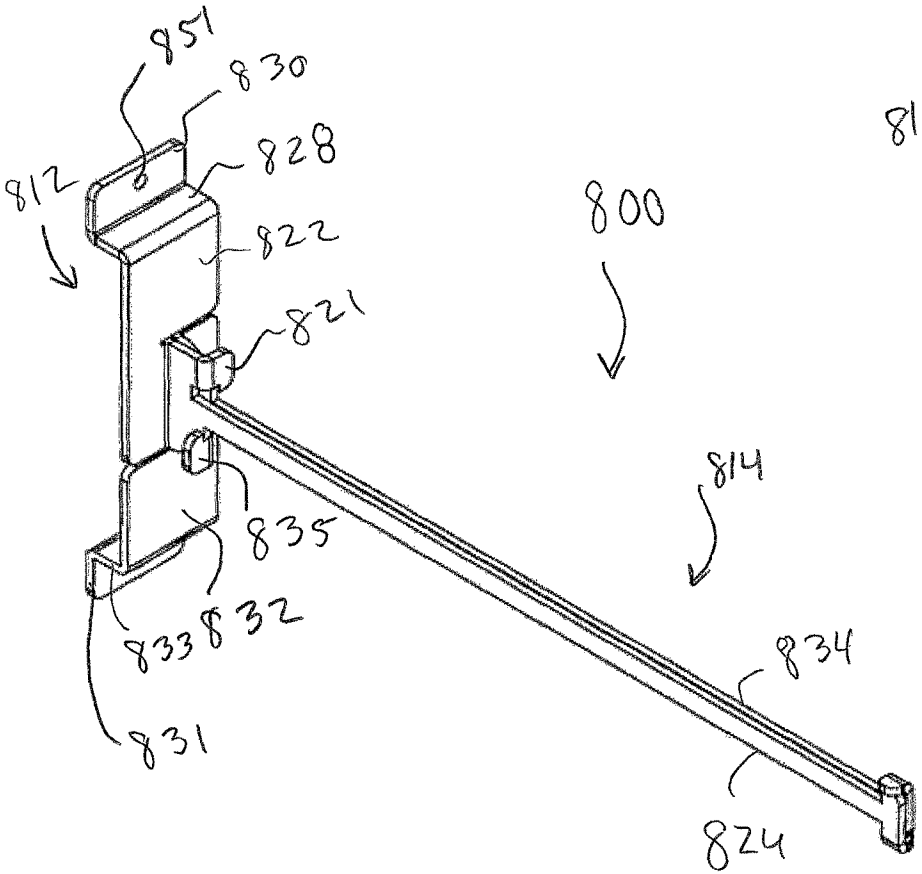

Referring to FIGS. 41A and 41B, a hanger 800 in accordance with a ninth embodiment of the present disclosure is provided. Hanger 800 includes a retaining portion 812 that retains the hanger 800 in a slot of a slatwall and a hanging portion 814 that enable items of merchandise to be placed thereon and be displayed. Hanger 800 includes first hanger member 816 and a second hanger member 818 which are slidingly coupled to one another.

Figure 41D:
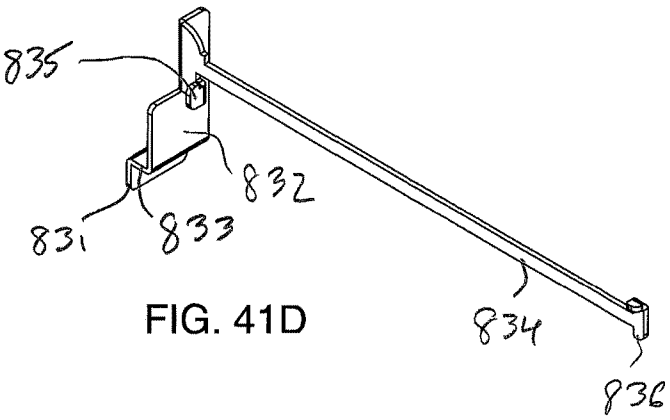
FIGS. 41C-41G illustrate various views of a hanger member of the hanger shown in FIG. 41A in accordance with the present disclosure.
Figure 41C:
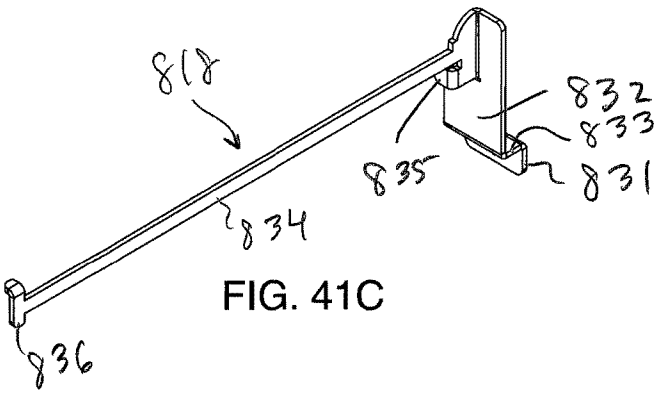
Figure 41E:
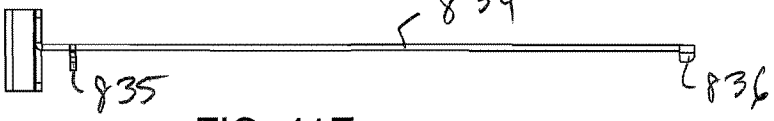
Figure 41F:
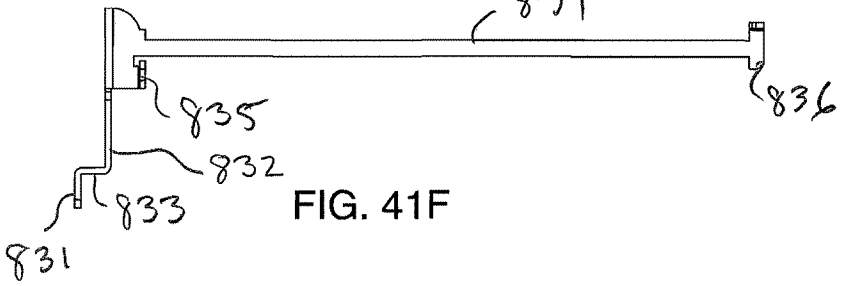
Figure 41G:
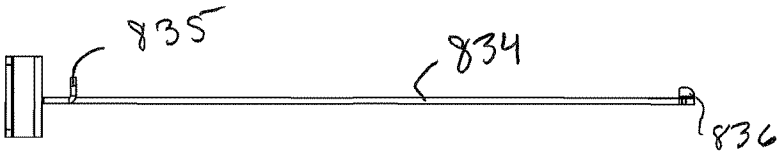
Figure 41I:
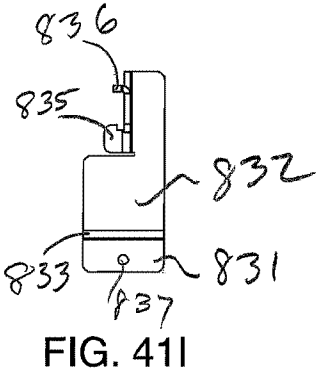
Figure 41H:
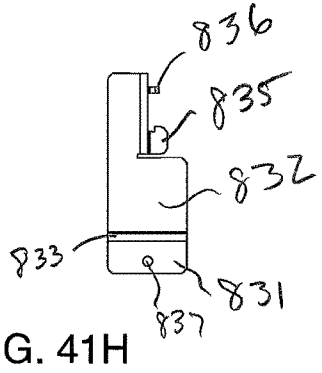

It is to be appreciated that first hanger member 816 and second hanger member 818 are identical. For the sake of simplicity, FIGS. 41C-41I illustrates various views of the second hanger member 818, where FIG. 41C is a right perspective view, FIG. 41D is a left perspective view, FIG. 41E is a top view, FIG. 41F is a left side, FIG. 41G is a bottom view, FIG. 41H is a rear view and FIG. 41I is a front view.

First hanger member 816 includes a support member 822 configured to come into contact with a slat of a slatwall. A first hanger leg 824 extends perpendicularly from the support member 822. The first hanger leg 824 includes a first extension member 826 which extends perpendicularly from an end of the first hanger leg 824. An offset member 828 couples the support member 822 to a retaining member 830 configured to be disposed in a slot of a slatwall. Support member 822 further includes a projection tab 821. Retaining member 830 further includes an aperture 851 for receiving a fastener, e.g., a screw. Similarly, second hanger member 818 includes support member 832, offset member 833, securing member 831, projection tab 835, second hanger leg 834 and second extension member 836.

Figure 41K:
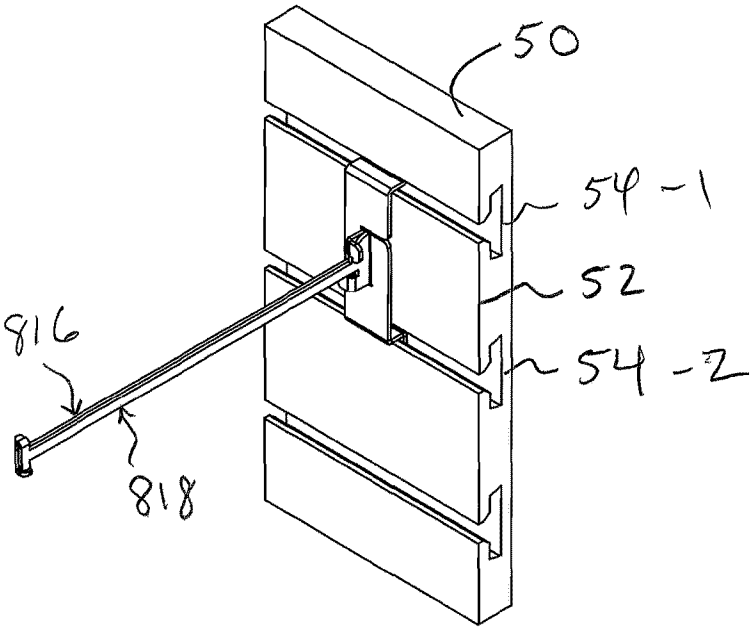
FIGS. 41J-41K illustrate a method for securing the slatgrid hanger shown in FIG. 41A to a slatwall in accordance with the present disclosure.
Figure 41J:
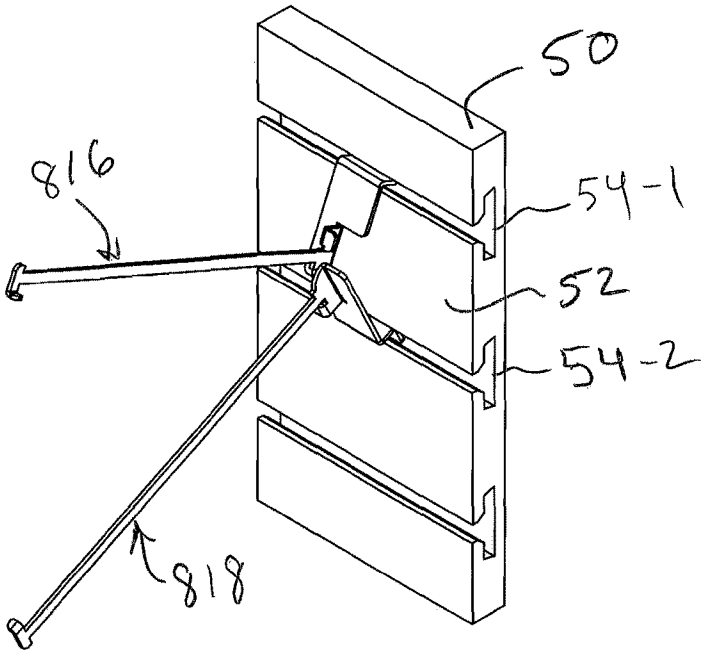

In use, retaining member 831 is disposed in a slot 54-2 below a predetermined slat 52 of a slatwall. Then retaining member 830 is disposed in a slot 54-1 above the predetermined slat 52, as shown in FIG. 41J. The first hanger leg 824 is then brought into alignment with the second hanger leg 834, as shown in FIG. 41K. Hanger 800 may then be secured by disposing a fastener such as a screw into aperture 851 of retaining member 830. It is to be appreciated that retaining member 831 may also include an aperture 837 configured to receive a fastener to secure hanger 800.

Figure 42B:
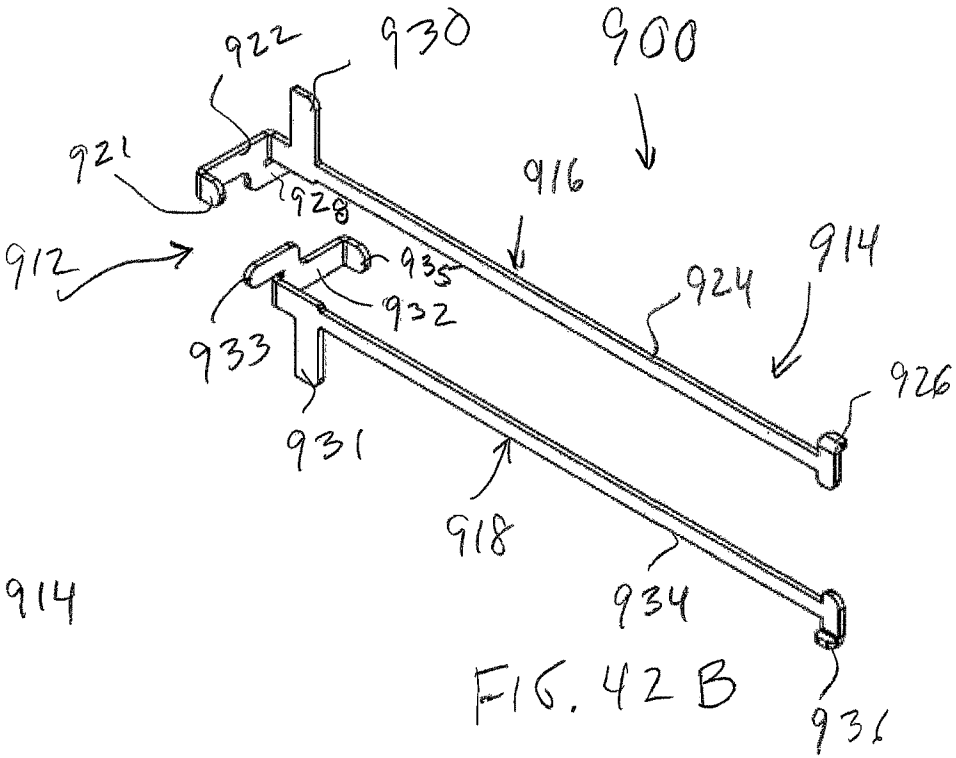
FIGS. 42A and 42B illustrate a hanger in accordance with a tenth embodiment of the present disclosure.
Figure 42A:
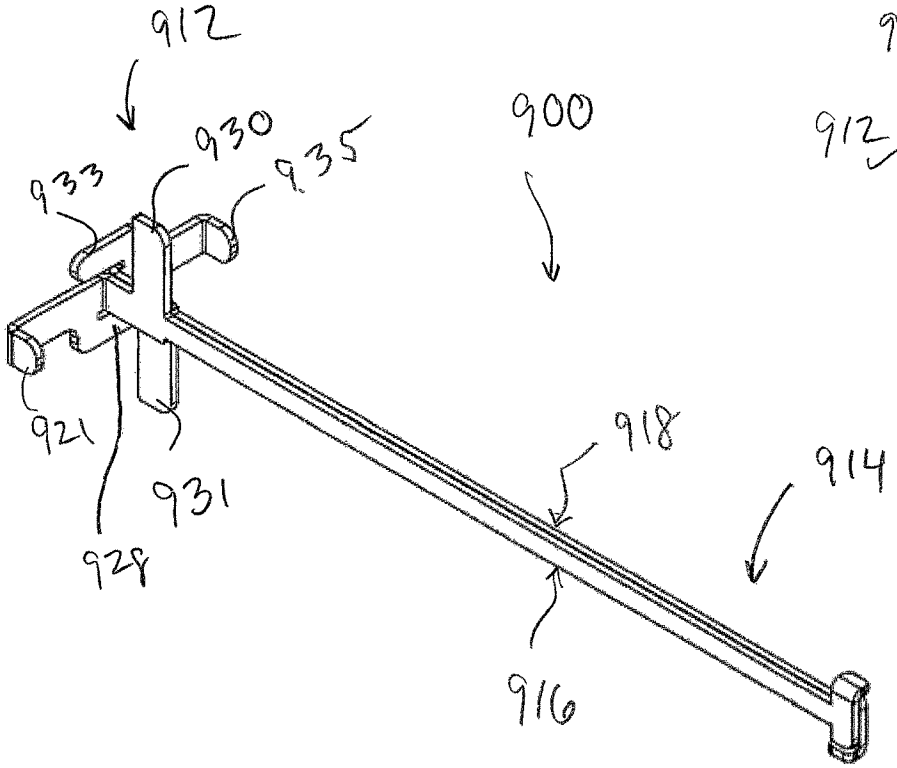

Referring to FIGS. 42A and 42B, a hanger 900 in accordance with a tenth embodiment of the present disclosure is provided. Hanger 900 includes a retaining portion 912 that retains the hanger 900 in a slot of a slatwall and a hanging portion 914 that enable items of merchandise to be placed thereon and be displayed. Hanger 900 includes first hanger member 916 and a second hanger member 918 which are slidingly coupled to one another.

Figure 42D:
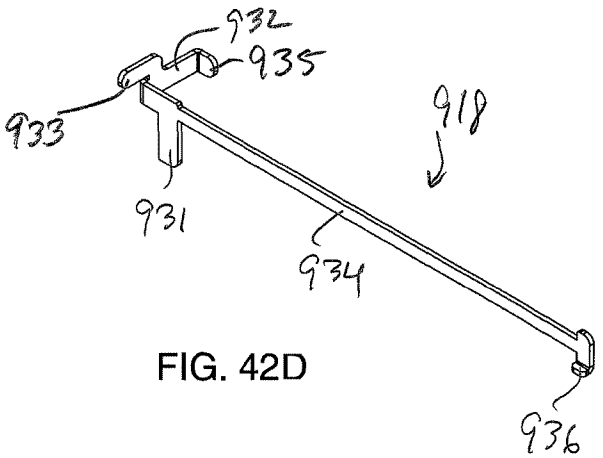
FIGS. 42C-42G illustrate various views of a hanger member of the hanger shown in FIG. 42A in accordance with the present disclosure.
Figure 42C:
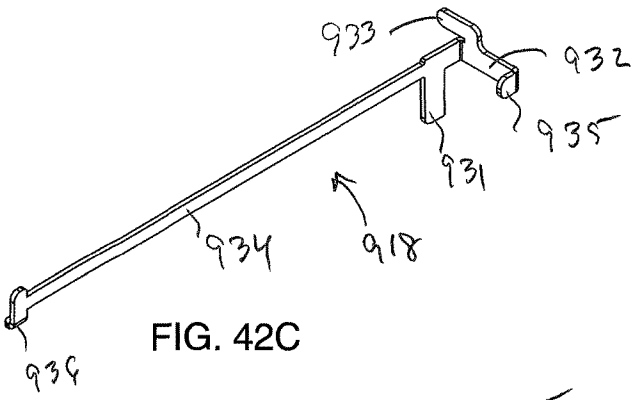
Figure 42E:
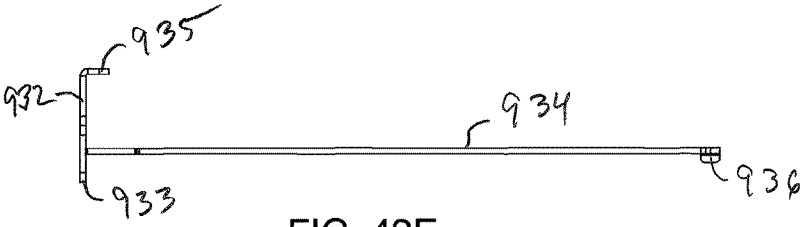
Figure 42I:
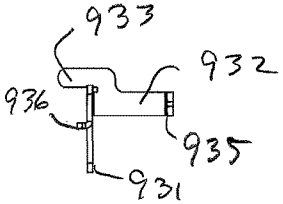
Figure 42F:
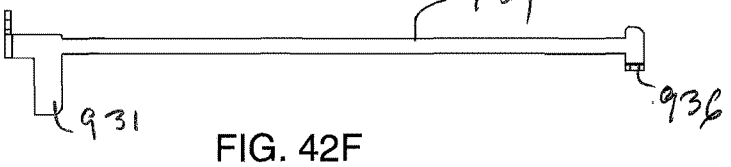
Figure 42G:
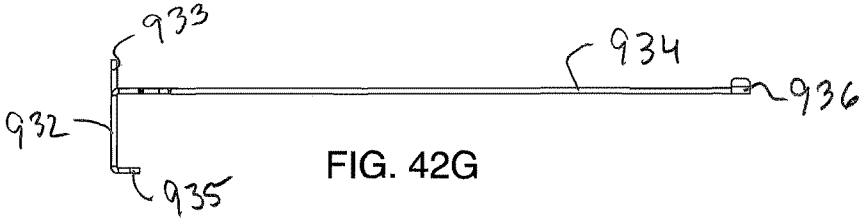
Figure 42H:
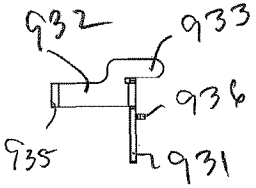
Figure 42J:
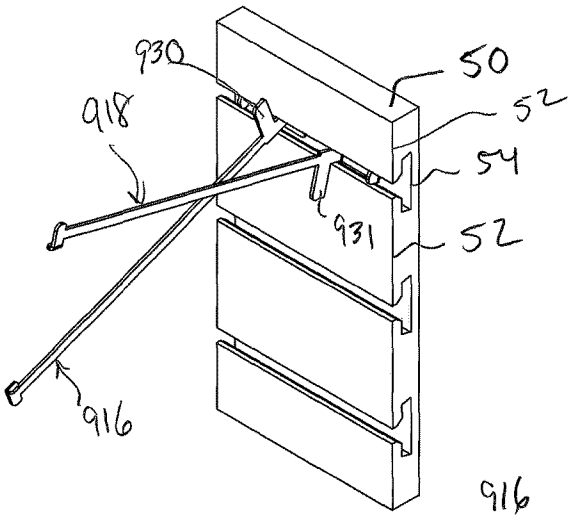
FIGS. 42J-42L illustrate a method for securing the slatgrid hanger shown in FIG. 41A to a slatwall in accordance with the present disclosure.

It is to be appreciated that first hanger member 916 and second hanger member 918 are identical. For the sake of simplicity, FIGS. 42C-42I illustrates various views of the second hanger member 918, where FIG. 42C is a right perspective view, FIG. 42D is a left perspective view, FIG. 42E is a top view, FIG. 42F is a left side, FIG. 42G is a bottom view, FIG. 42H is a rear view and FIG. 42I is a front view.

First hanger member 916 includes a support member 922 where a first hanger leg 924 extends perpendicularly from the support member 922. The first hanger leg 924 includes a first extension member 926 which extends perpendicularly from an end of the first hanger leg 924. A retaining member 930 extends perpendicularly from the first hanger leg 924 and is disposed adjacent the support member 922. Support member 922 further includes a projection tab 921 which extends perpendicularly from the support member 922. A projection member (not shown in FIG. 42B but similar to projection 933) extends in parallel from the support member 928 opposite from the projection tab 921. Similarly, second hanger member 918 includes support member 932, projection tab 935, securing member 931, projection member 933, second hanger leg 934 and second extension member 936.

Figure 42K:
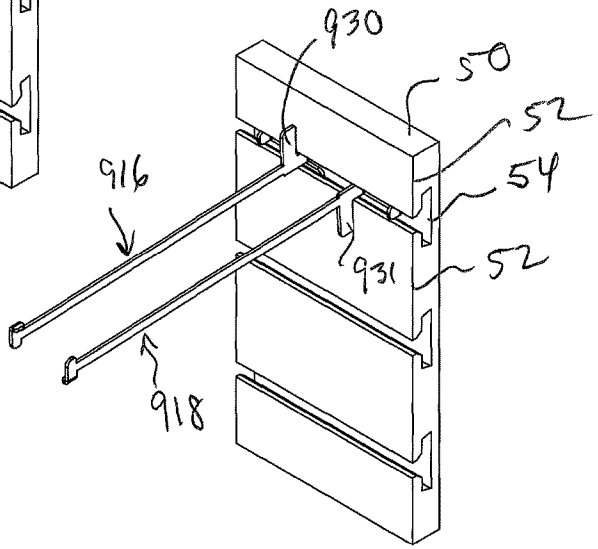
Figure 42L:
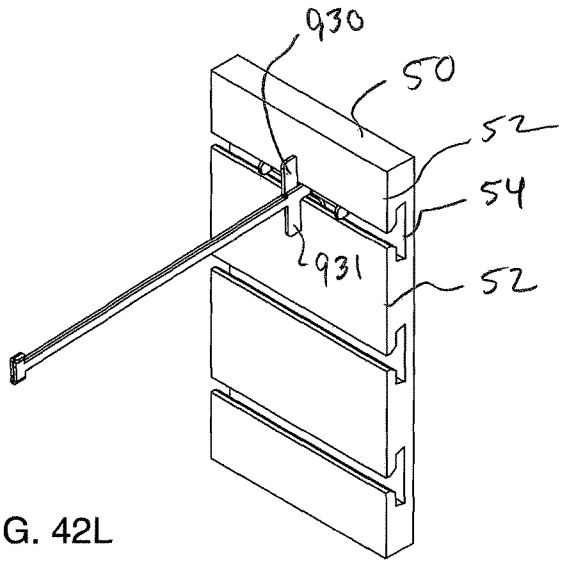

In use, support member 922 of first hanger member 916 is disposed in a slot of a slatwall where the support member 922 comes in contact with an upper edge of the slot 54 and retaining member 930 comes into contact with the slat 52 above the slot. Support member 932 of second hanger member 918 is disposed in the slot of the slatwall where the support member 932 comes in contact with a lower edge of the slot and retaining member 931 comes into contact with the slat below the slot, as shown in 42J. First hanger member 916 and second hanger member 918 are slid into contact with each other in slot, as illustrated in FIG. 42K, where projection member 928 interlocks with support member 932 and projection member 933 interlocks with support member 928, as shown in FIG. 42L. It is to be appreciated that projection tabs 921, 935 stabilize the hanger 900 in the slot, i.e., prevent the hanger 900 from rotating within the slot.

It is to be appreciated that any of the above-described hangers may be secured in place by providing a locking device disposed over the first hanger leg and the second hanger leg, i.e., the second hanger member is prevented from rotating relative to first hanger member, thus preventing removal of the hanger from the various described structures. Locking devices may include, but are not limited to, a lock, a product being disposed on the hanger, a clip, a price ticket, a label plate, etc. Exemplary locks are shown and described in commonly-owned U.S. Pat. Nos. 10,156,008 and D899,218, the contents of which are incorporated by reference.

Additionally, the first hanger member may be prevented from rotating relative to second hanger, thus preventing removal of the hanger from the various described structures, by disposing a magnet on the first hanger member and/or second hanger member. A first magnet(s) may be placed on the first hanger member with a second corresponding magnet (i.e., a magnet with an opposite polarity from the first magnet) placed on the second hanger leg. It is to be appreciated that the first magnet and second corresponding magnet may be positioned on surfaces other the first and second hanger legs as long as the surfaces of the first and second hanger members come into contact (or close proximity) to each other.

In one embodiment, the first and second hanger members may be prevented to be rotated relative to each other by coupling member (e.g., coupling member 20, 320, 430, 520, 620). When the first hanger leg is positioned adjacent to the second hanger leg (for example, as shown in FIG. 10), the coupling member may be configured to lock the first hanger member in place relative to the second hanger member, for example, by a groove on the coupling member and a slot on the hanger members. In a further embodiment, the coupling member may be magnetically actuated, i.e., a magnet is employed to actuate the coupling member so the hanger members may be allowed to rotate relative to each other. In yet another embodiment, the coupling member may be spring-loaded requiring a special tool to enable removal or actuation of the coupling member.

Furthermore, the first and second hanger member may be coupled to each other via other various means such as, but not limited to, security screws, security screws with compression, push fasteners, thumb screws, etc.

Figure 27:
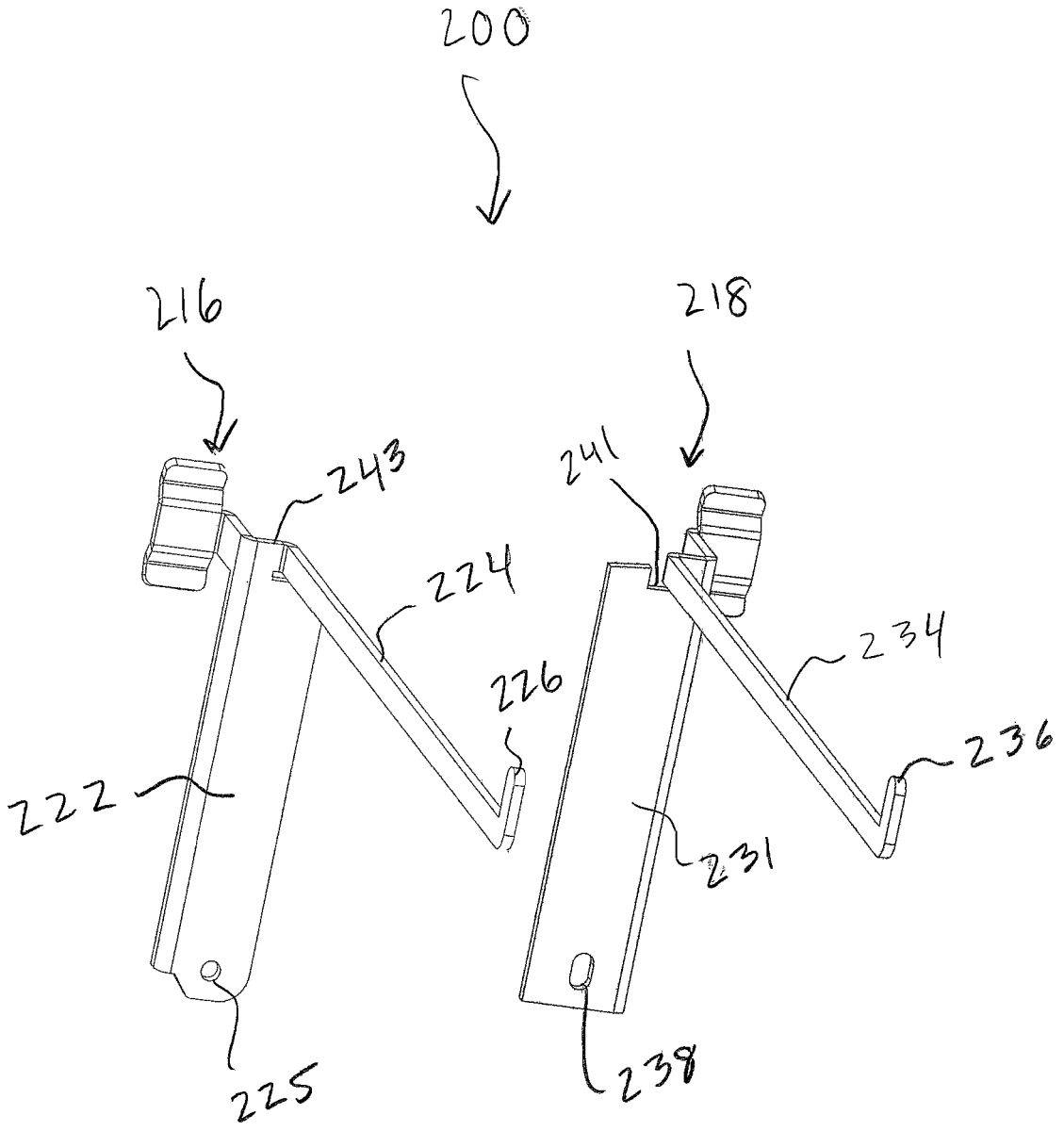
FIG. 27 is a left exploded perspective view of the hanger shown in FIG. 24A.

It is further to be appreciated that an assembled hanger may be secured to the various structures described above (for example, a slatwall, pegboard, slatgrid, etc.) by various means such as, but not limited to, security screws, security screws with compression, push fasteners, thumb screws, etc. In one embodiment, once the hanger is coupled to the structure, a fastener may be disposed through the support member that comes into contact with the structure and the fastener is coupled to the structure. As shown in FIG. 27, first support member 222 includes aperture 225 and second support member 231 includes aperture 238. Hanger 200 may then be secured to the slatgrid by disposing a fastener through apertures 225 and 238, where the fastener may be coupled to a portion of the slatgrid. Although some of the embodiments described above do not show apertures in the support members, the support members of the hangers of the present disclosure may be configured to have such apertures to receive fasteners. As mentioned above, the fasteners may include security screws, security screws with compression, push fasteners, thumb screws, etc. In one embodiment, the fastener may be magnetically actuated, i.e., a magnet is employed to actuate the fastener so the hanger may be removed from the structure. In yet another embodiment, the fastener may be spring-loaded requiring a special tool to enable removal or actuation of the fastener. In yet another embodiment, the fasteners may be quick-release fasteners such as QUICKLOC® and QUICKLOC® SOLID fasteners commercially available from Bollhoff of Germany.

Figure 43B:
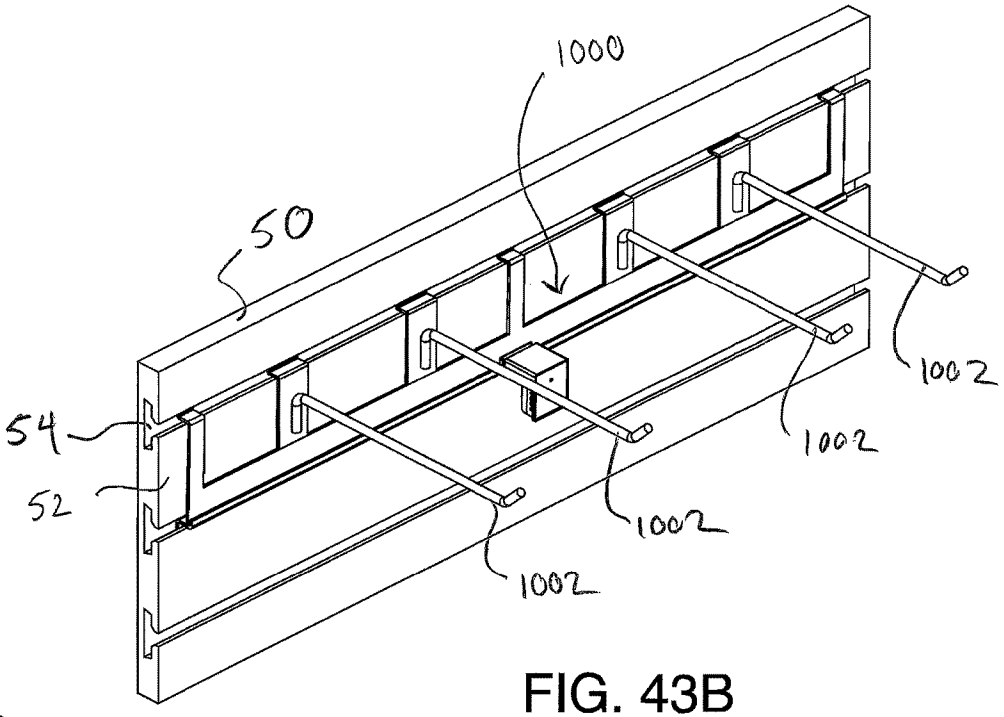
FIG. 43B is a left, perspective view of the hanger capture device shown in FIG. 43A in accordance with the present disclosure.
Figure 43A:
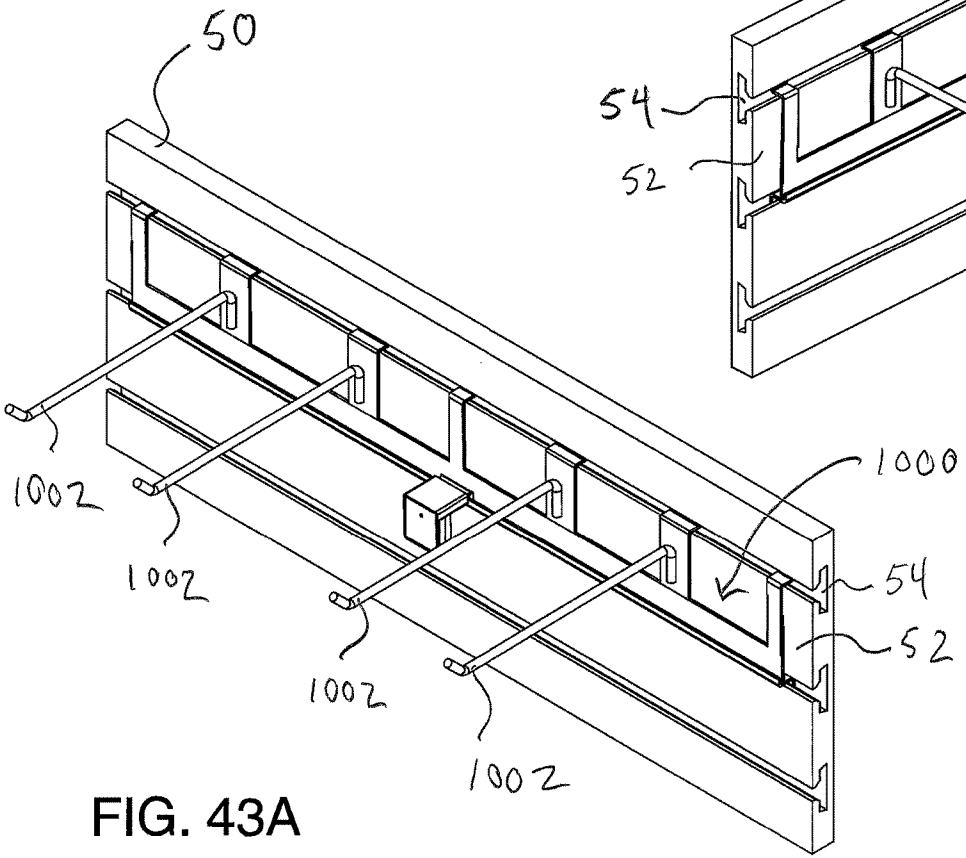
FIG. 43A is a right, perspective view of a hanger capture device on a slatwall according to an embodiment of the present disclosure.

Referring to FIGS. 43A-47D, a hanger capture device 1000 is provided in accordance with an embodiment of the present disclosure. Referring to FIGS. 43A-B, the hanger capture device 1000 is illustrated mounted to a slatwall 50. As described above, the slatwall 50 includes a number of horizontal boards or slats 52. Adjacent slats 52 are spaced apart a given distance to form a number of uniform, horizontal slots 54. The slots 54 are generally a T-shaped cavity, however other shapes are contemplated to be within the scope of the present disclosure. Conventional hangers 1002 may be disposed in the slots 54 of the slatwall. Hanger 1002 includes a hanging portion 1004 for hanging and displaying items for sale and a coupling portion 1006 for coupling the hanger 1002 to the slatwall 50. A side view of hanger 1002 is illustrated in FIG. 44C. The coupling portion 1006 includes a first member 1008, a second member 1010 and a third member 1012. The first, second and third members

1008, 1010, 1012 form a hook-like assembly where third member 1012 is configured to be disposed in a slot 54 and first member 1008 comes into contact with the slat 52 below the slot 53. When the hanger 1002 is coupled to the slatwall 50, a rear surface 1009 of the first member 1008 is in full contact with the slat 52 and the hanging portion 1004 extends perpendicularly from the slatwall 50. As shown in FIGS. 43A-B, when the hanger capture device 1000 is mounted to the slatwall 50, the hangers 1002 are prevented from being removed from the slatwall 50, as will be described in detail below.

Figure 45:
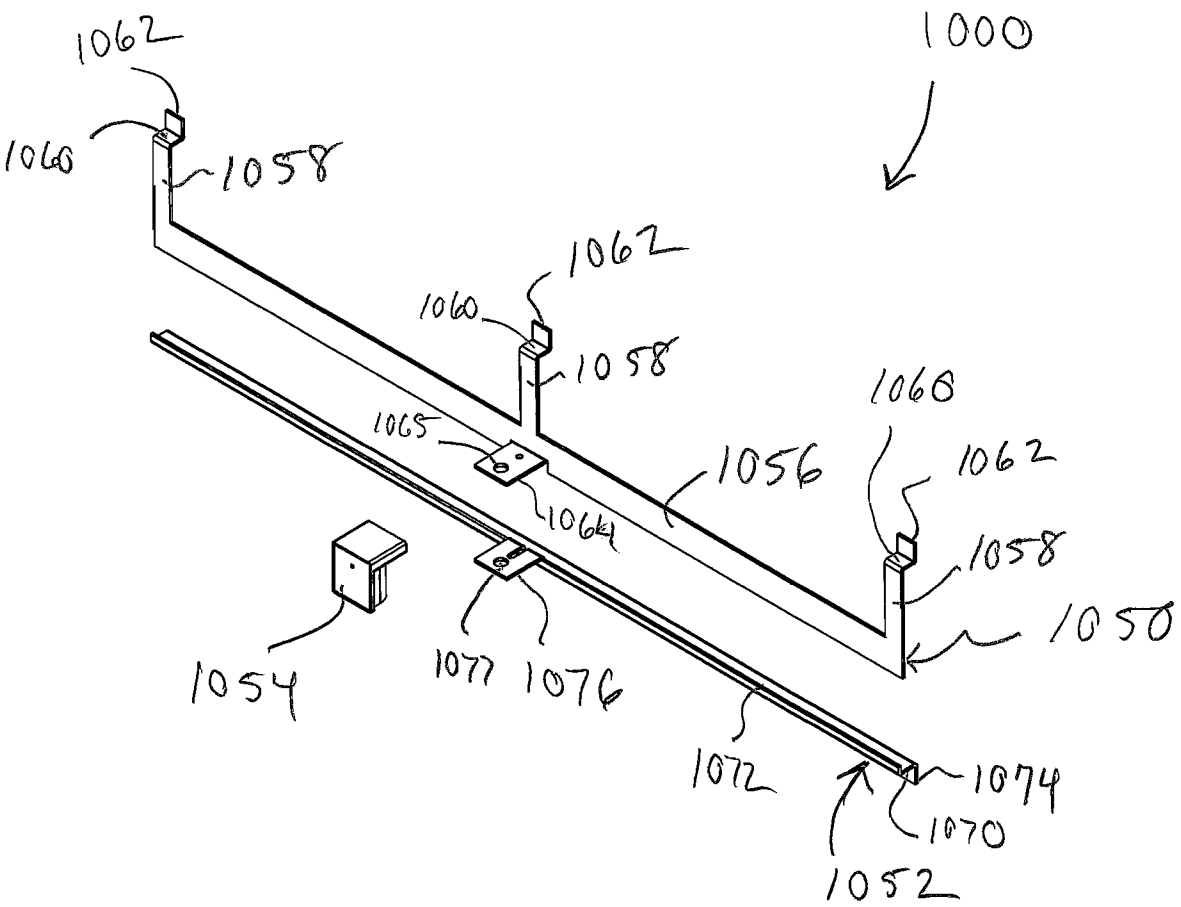
FIG. 45 is a right exploded perspective view of the hanger capture device shown in FIG. 43A.
Figure 46D:
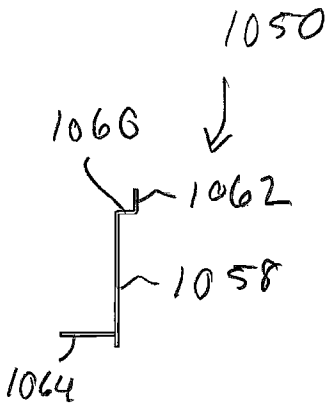
FIG. 46D is a side view of a retaining member of the hanger capture device in accordance with the present disclosure.
Figure 46A:
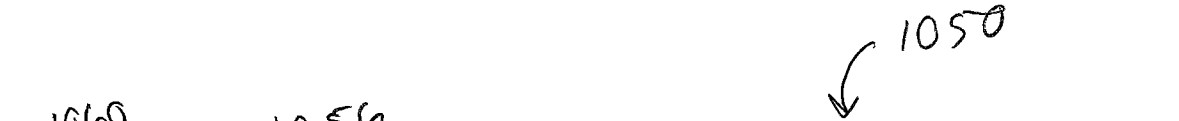
FIG. 46A is a top view of a retaining member of the hanger capture device in accordance with the present disclosure.
Figure 46B:
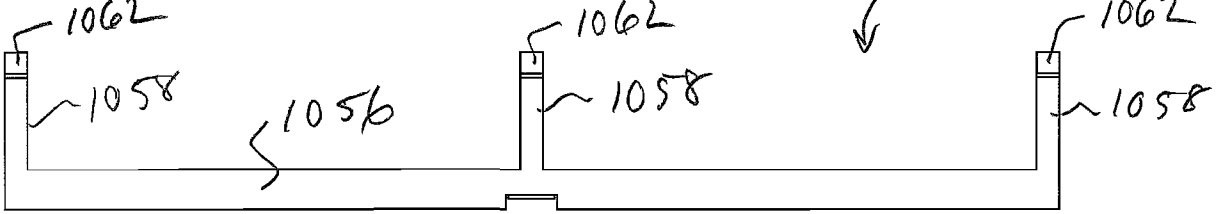
FIG. 46B is a front view of a retaining member of the hanger capture device in accordance with the present disclosure.
Figure 46C:
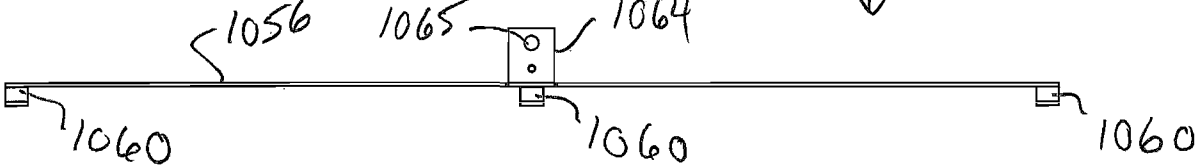
FIG. 46C is a bottom view of a retaining member of the hanger capture device in accordance with the present disclosure.

Referring to FIG. 45, the hanger capture device 1000 includes a retaining member 1050, a securing member 1052 and in certain embodiments, a locking member 1054. Referring to FIGS. 46A-46D, various views of the retaining member 1050 are illustrated. The retaining member 1050 includes an elongated member 1056 and at least two arms 1058. It is to be appreciated that the number of arms 1058 may vary depending on the length of the elongated member 1056. Each arm 1058 includes an offset member 1060 and a tab 1062, as shown in FIG. 46D. The retaining member 1050 further includes a first receiving member 1064 configured to receive the locking member 1054, the receiving member 1064 extends perpendicular from a plane of the elongated member 1056.

Figures 47A, 47B, 47C, 47D:
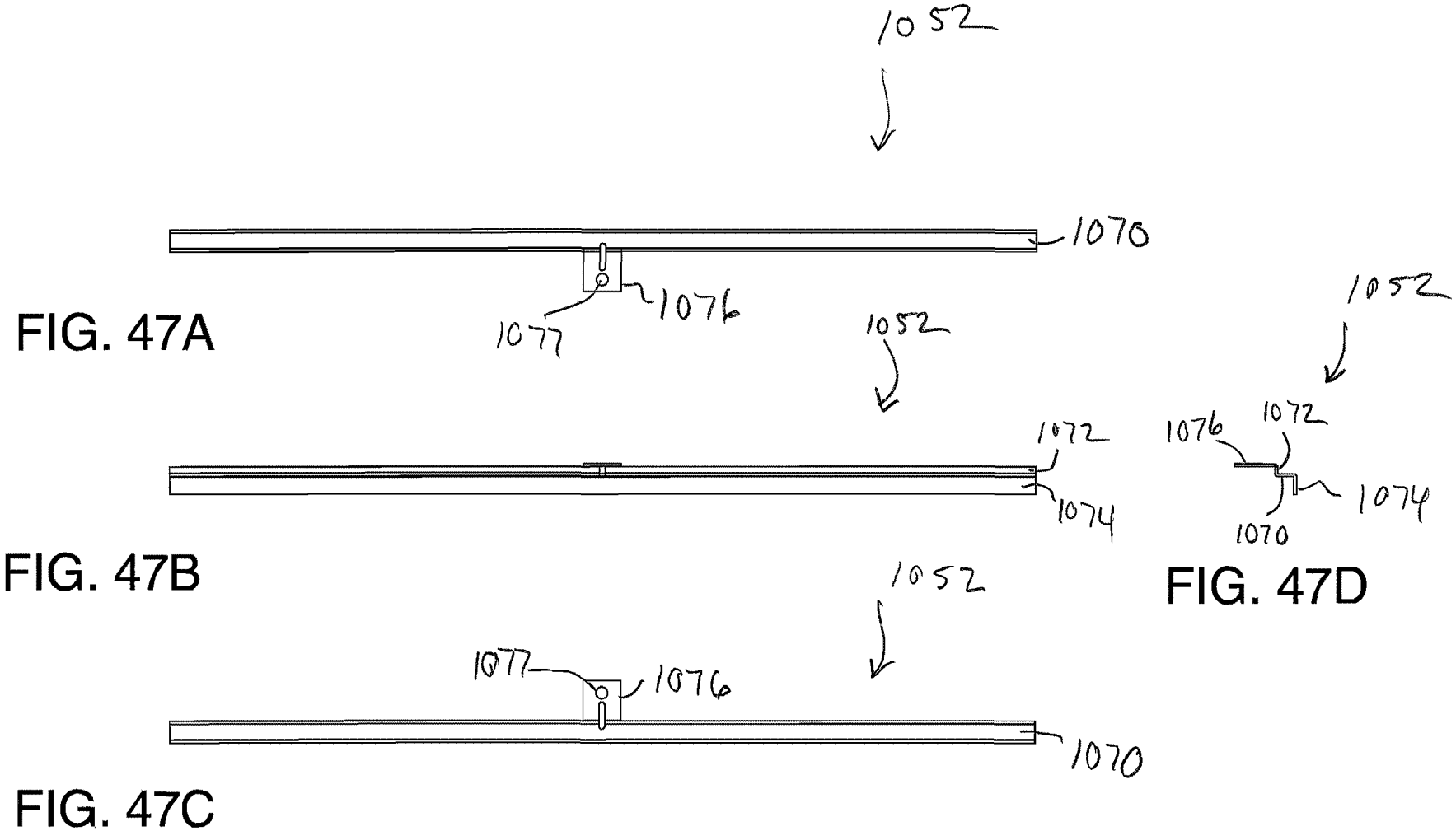
FIG. 47A is a top view of a securing member of the hanger capture device in accordance with the present disclosure.
FIG. 47B is a front view of a securing member of the hanger capture device in accordance with the present disclosure.
FIG. 47C is a bottom view of a securing member of the hanger capture device in accordance with the present disclosure.
FIG. 47D is a side view of a securing member of the hanger capture device in accordance with the present disclosure.

Referring to FIGS. 47A-47D, various views of the securing member 1052 are illustrated. The securing member 1052 includes an elongated member 1070 including a perpendicular lip 1072 along one length of the elongated member 1070 and a perpendicular edge 1074 along an opposite length of the elongated member 1070, as shown in FIG. 47D. The securing member 1052 further includes a second receiving member 1076 configured to receive the locking member 1054, the second receiving member 1076 extends perpendicular from a plane of the lip 1072.

Referring to FIGS. 43A-44B, the mounting and securing of hangers 1002 to a slatwall 50 will now be described. As in FIG. 44A, at least one hanger 1002 is coupled to the slatwall 50. Third member 1012 of hanger 1002 is disposed in slot 54A such that third member 1012 enters a lower portion of the slot 54A. The rear surface 1009 of first member 1008 of hanger 1002 then comes in contact with and rests on slat 52A. This is the normal resting position of hanger 1002. In this state, the hanger 1002 can easily be removed from the slatwall 50 by lifting end 1005 of hanging portion 1004 in the direction of arrow C.

To secure the at least one hanger 1002 to the slatwall 50, the hanger capture device 1000 may be coupled to the slatwall 50. Tabs 1062 of arms 1058 are disposed in an upper portion of the same slot that the hanger 1002 was disposed in, for example, slot 54A. Each of the arms 1058 of retaining member 1050 then makes contact and comes to rest on slat 52A. Edge 1074 of securing member 1052 is then disposed in an adjacent slot 54B below the slot 54A. The securing member 1052 is then rotated such that second receiving member 1076 aligns with first receiving member 1064. A locking member 1054 may then be placed over the aligned first and second receiving members 1064, 1076 to secure the retaining member 1050 and securing member 1052 in place. The lip 1072 will prevent the elongated member 1056 of the retaining member 1050 from being moved away from the slatwall 50. Once secured in place, the elongated member 1056 comes into contact with a lower end of the first member 1008 of hanger 1002. In this manner, the hanger 1002 is prevented from rotating from the slatwall 50 and being removed.

Figure 44A:
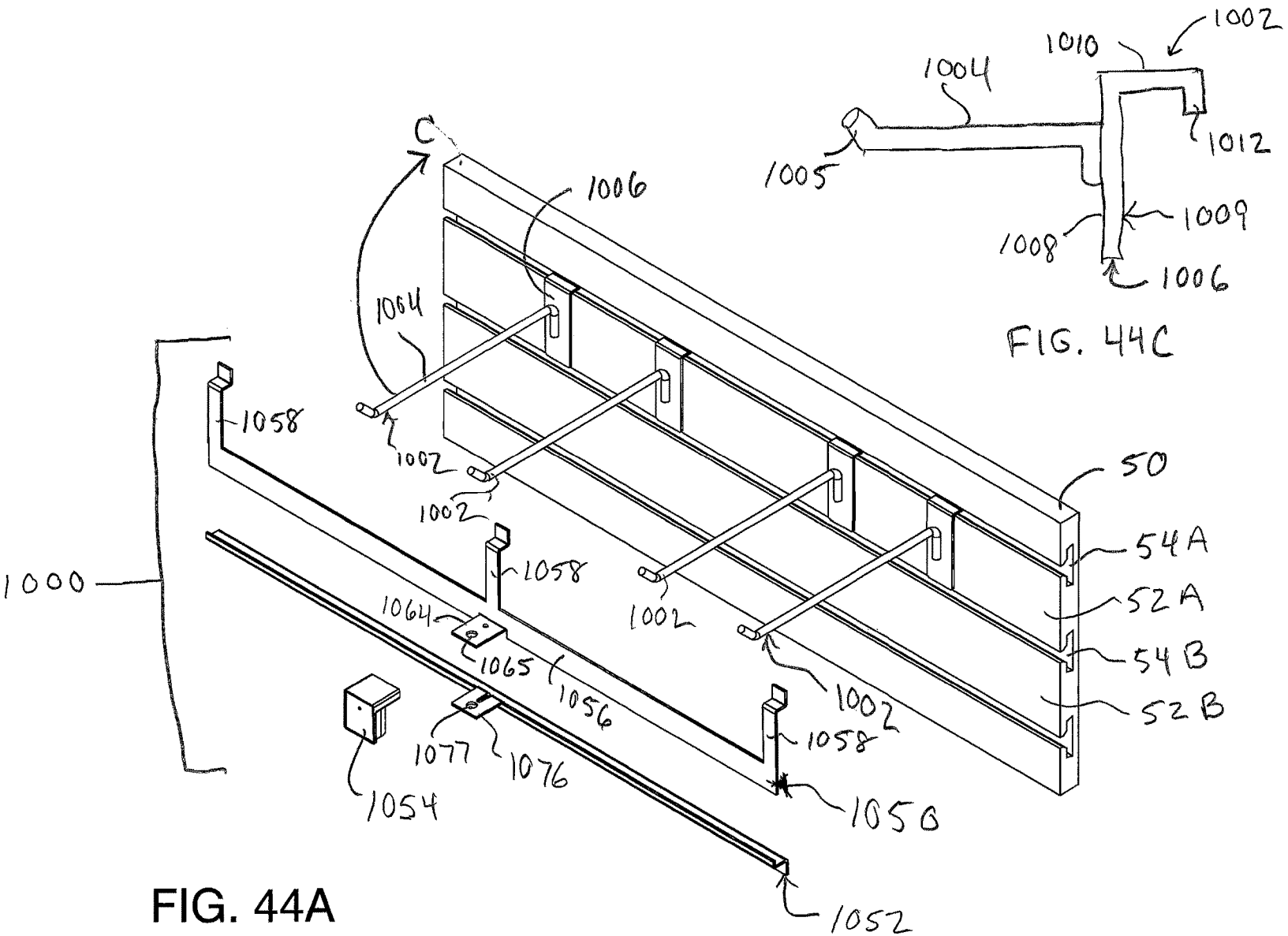
FIG. 44A is a right exploded perspective view of the hanger capture device shown in FIG. 43A.
Figure 44B:
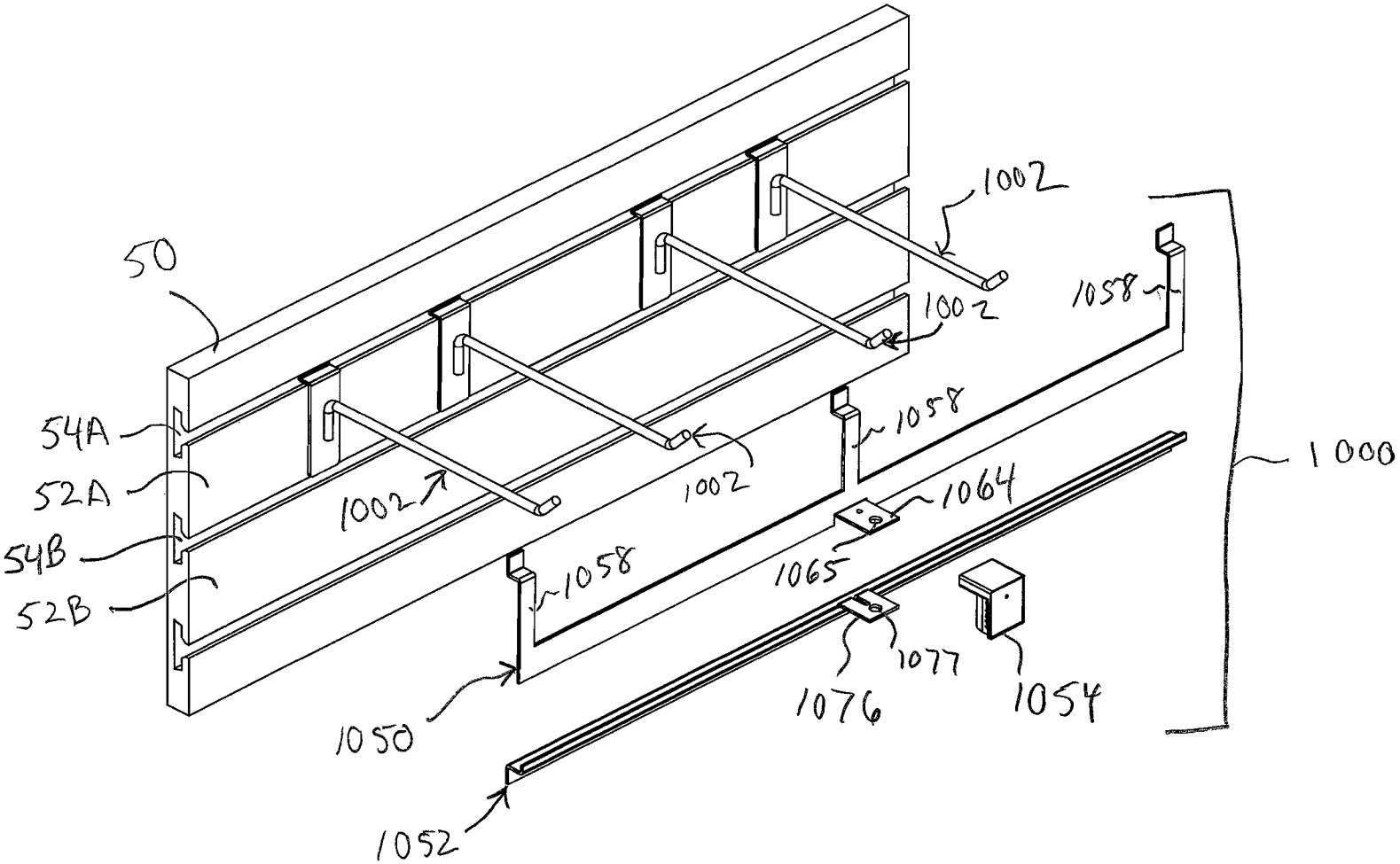
FIG. 44B is a left exploded perspective view of the hanger capture device shown in FIG. 43A.

In one embodiment, the locking member 1054 may include a lock, e.g., a plunger type locking device. An exemplary locking device is described in commonly-owned U.S. Pat. No. 10,156,088, the contents of which are hereby incorporated by reference. Referring to FIG. 44A, the first receiving member 1064 includes an aperture 1065 and second receiving member 1076 includes an aperture 1077. When the first and second receiving members 1064, 1076 align, aperture 1065 and aperture 1077 also align. Locking member 1054 is then disposed over the first and second receiving members 1064, 1076. In the embodiment using a plunger-type locking device, a plunger (not shown) will pass through the apertures 1065, 1077 locking the securing member 1052 to the retaining member 1050.

It is to be appreciated that other locks or locking devices are contemplated to be employed as the locking member and still remain in the scope of the present disclosure.

Figure 48B:
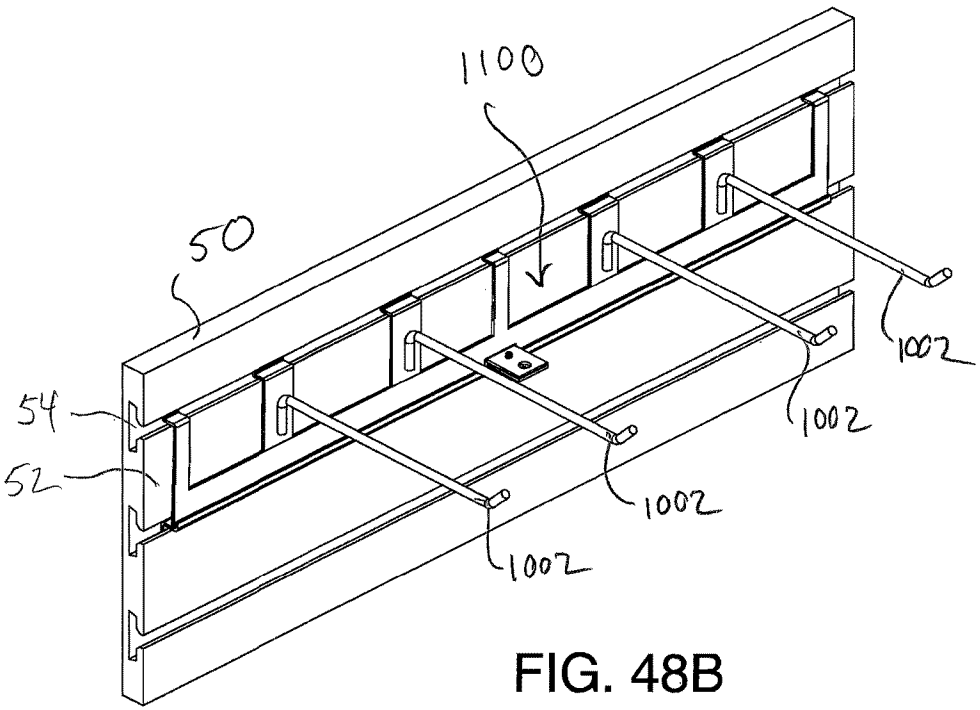
FIG. 48B is a left, perspective view of the hanger capture device shown in FIG. 48A in accordance with the present disclosure.
Figure 48A:
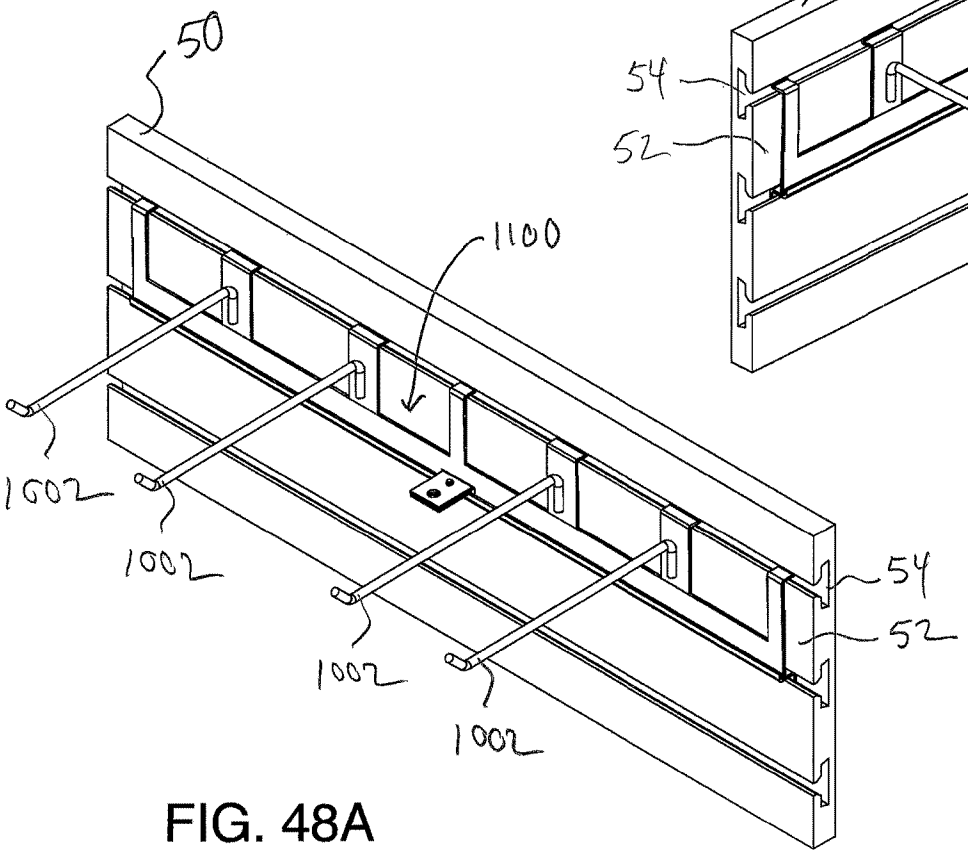
FIG. 48A is a right, perspective view of a hanger capture device on a slatwall according to another embodiment of the present disclosure.
Figure 49A:
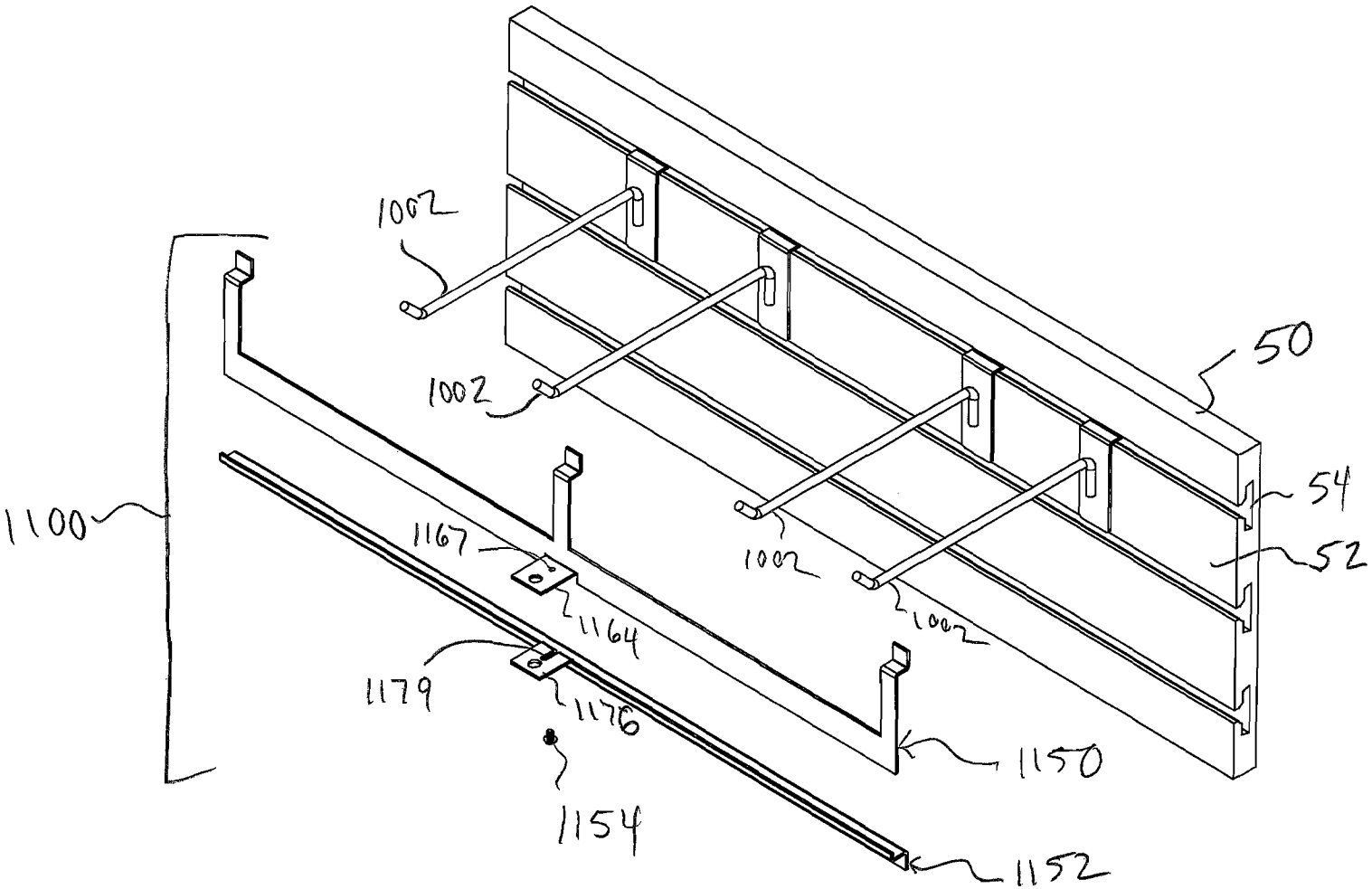
FIG. 49A is a right exploded perspective view of the hanger capture device shown in FIG. 48A.
Figure 49B:
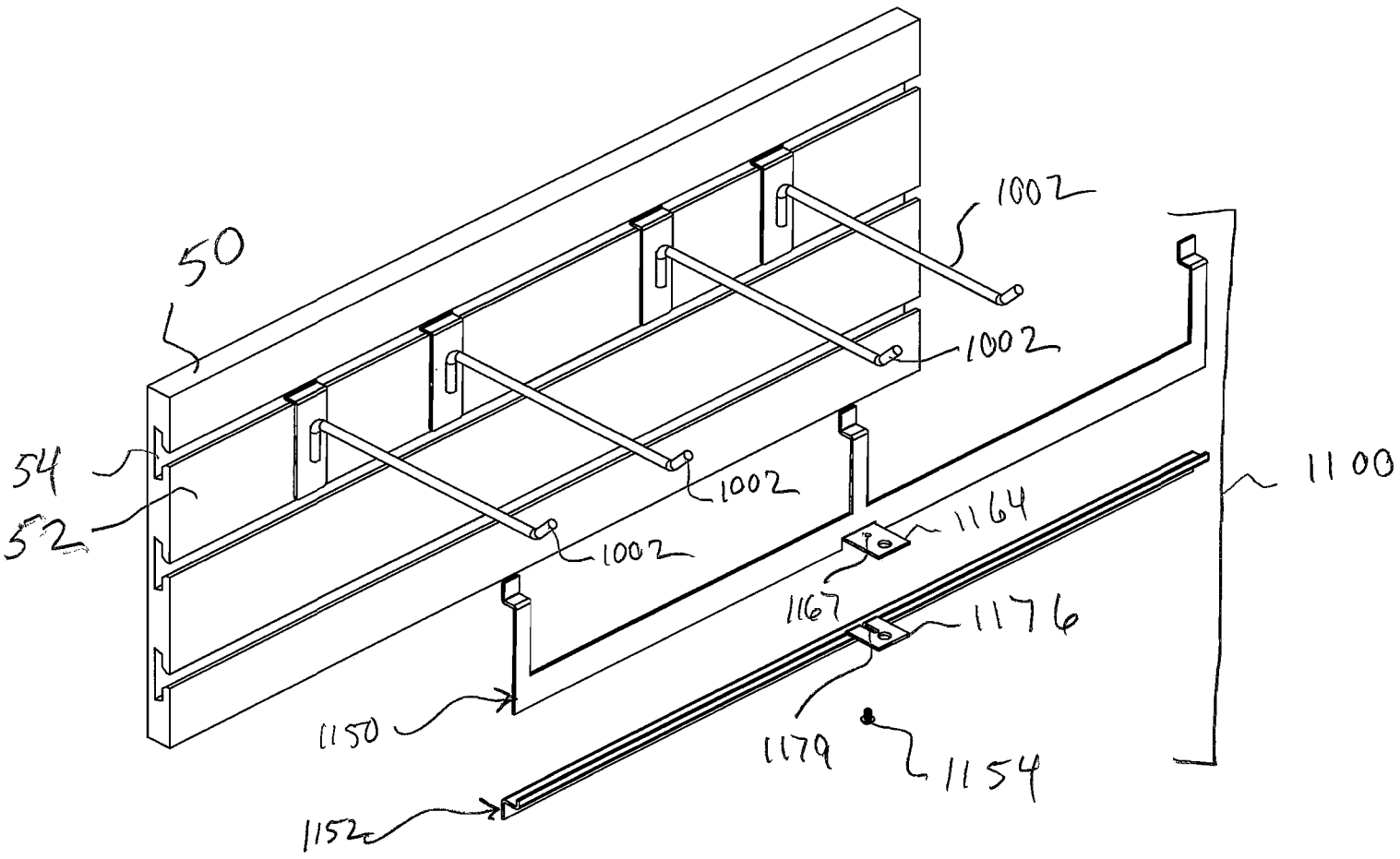
FIG. 49B is a left exploded perspective view of the hanger capture device shown in FIG. 48A.

Referring to FIGS. 48A-49B, a hanger capture device 1100 is provided in accordance with another embodiment of the present disclosure. In this embodiment, the retaining member 1150 and securing member 1152 are substantially the same as the retaining member 1050 and securing member 1052 described above. In this embodiment, the locking member 1154 may be a fastener, for example, a screw, rivet, tie wrap, etc. The retaining member 1150 includes an aperture 1167 in first receiving member 1164. The securing member 1152 includes slot 1179 in second receiving member 1176. In use, when the first and second receiving members 1164, 1176 are aligned as described above, fastener 1154 is inserted through slot 1179 and subsequently through aperture 1167 to secure the securing member 1152 to the retaining member 1150, as shown in FIGS. 48A-B.

It is also to be appreciated that the various features shown and described are interchangeable, that is, a feature shown in one embodiment may be incorporated into another embodiment.

While the disclosure has been shown and described with reference to certain preferred embodiments thereof, it will be understood by those skilled in the art that various changes in form and detail may be made therein without departing from the spirit and scope of the disclosure.

Furthermore, although the foregoing text sets forth a detailed description of numerous embodiments, it should be understood that the legal scope of the invention is defined by the words of the claims set forth at the end of this patent. The detailed description is to be construed as exemplary only and does not describe every possible embodiment, as describing every possible embodiment would be impractical, if not impossible. One could implement numerous alternate embodiments, using either current technology or technology developed after the filing date of this patent, which would still fall within the scope of the claims.

It should also be understood that, unless a term is expressly defined in this patent using the sentence "As used herein, the term ' ' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

What is claimed is:

1. A hanger for displaying at least one item of merchandise relative to a structure comprising:

a first hanger member including a support member configured to come into contact with the structure in a parallel relationship, a first hanger leg that extends perpendicularly from the support member and an offset member that couples the support member to a retaining member in a parallel relationship, the retaining member configured to be disposed in a slot of the structure;

a second hanger member including a first securing member, a second securing member and a second hanger leg that extends from the first securing member, the first securing member configured to come into contact with the structure and the second securing member configured to come into contact with the slot of the structure;

the first hanger member and the second hanger member are rotatably coupled to each other such that, when the first hanger leg aligns with the second hanger leg, the retaining member, the first securing member and the second securing member form a retaining portion that retains the hanger to the structure and the first hanger leg and second hanger leg form a hanging portion that enables items of merchandise to be placed thereon and be displayed.

2. The hanger of claim 1, wherein the structure is a slatwall including a plurality of horizontal slats where adjacent slats are spaced apart a given distance to form a number of uniform, horizontal slots, the support member configured to come into full contact with a slat of the slatwall and the retaining member configured to be disposed in a slot of the slatwall.

3. The hanger of claim 2, wherein the first securing member is configured to come into contact with a slat above the slot where the retaining member is disposed and the second securing member is configured to comes into contact with a lower lip of the slot.

4. The hanger of claim 3, wherein the first hanger member is rotatably coupled to the second hanger member via a coupling member.

5. The hanger of claim 1, wherein a locking device is disposed over the hanging portion to prevent removal of the hanger from the structure.

6. The hanger of claim 5, wherein the locking device includes at least one of a lock, a product being disposed on the hanging portion, a clip, a price ticket and/or a label plate.

* * * * *